US008016363B2

(12) United States Patent
Jackson et al.

(10) Patent No.: US 8,016,363 B2
(45) Date of Patent: Sep. 13, 2011

(54) AUTOMATED EXCAVATION MACHINE

(76) Inventors: Eric Jackson, New Westminster (CA); Hal Hirtz, Mission (CA); James Dale, Coquitlam (CA); John Jordan, Courtenay (CA); David Eddy, Maple Ridge (CA); Simon Mark Jackson, Vancouver (CA)

( * ) Notice: Subject to any disclaimer, the term of this patent is extended or adjusted under 35 U.S.C. 154(b) by 0 days.

(21) Appl. No.: 12/648,558

(22) Filed: Dec. 29, 2009

(65) Prior Publication Data

US 2010/0109417 A1 May 6, 2010

Related U.S. Application Data

(62) Division of application No. 10/688,216, filed on Oct. 15, 2003, now Pat. No. 7,695,071.

(60) Provisional application No. 60/440,995, filed on Jan. 17, 2003, provisional application No. 60/431,188, filed on Dec. 4, 2002, provisional application No. 60/418,716, filed on Oct. 15, 2002, provisional application No. 60/419,048, filed on Oct. 15, 2002.

(51) Int. Cl.
*E21C 25/00* (2006.01)

(52) U.S. Cl. ..... 299/1.4

(58) Field of Classification Search ..... 299/1.05, 299/1.4, 1.8, 10, 31, 73
See application file for complete search history.

(56) References Cited

U.S. PATENT DOCUMENTS 919,105 A 4/1909 Wischow
919,905 A 4/1909 Maltby
1,176,884 A 3/1916 Davidson
1,211,679 A 1/1917 Constantinesco
1,365,748 A 1/1921 Thorn
1,566,460 A 12/1925 Wyman
3,309,145 A 3/1967 Arentzen
3,341,254 A 9/1967 Amdt
3,371,964 A 3/1968 Weber
3,415,574 A 12/1968 Lauber
3,437,380 A * 4/1969 Lawrence ..... 299/10
3,477,762 A 11/1969 Frenyo et al.
3,544,075 A 12/1970 Sugden
3,581,500 A 6/1971 Sugden
3,584,918 A 6/1971 Gaglione et al.

(Continued)

FOREIGN PATENT DOCUMENTS

AU 56857/80 7/1980

(Continued)

OTHER PUBLICATIONS

AGH Associates, "Reef Miner Projects," http://www.reefminer.com/, Sep. 24, 2001, pp. 2.

(Continued)

*Primary Examiner* — Sunil Singh
(74) *Attorney, Agent, or Firm* — Sheridan Ross P.C.

(57) ABSTRACT

The present invention is directed to an excavator that is operable in manual and automatic modes and uses state machines to effect unit operations, rotationally offset swing actuators to rotate boom and cutter head, a fail safe hydraulic system to maintain gripper pressure in the event of a malfunction of the hydraulic system, differing position and pressure control functions in the hydraulic actuators, a kinematic module to effect pitch and roll adjustments, a cutting face profile generator to generate a profile of the excavation face, and an optimization module to realize a high degree of optimization of excavator operation.

18 Claims, 40 Drawing Sheets

U.S. PATENT DOCUMENTS 3,596,724 A 8/1971 Bechem
3,598,445 A 8/1971 Winberg
3,620,573 A 11/1971 Oxford
3,647,263 A 3/1972 Lauber et al.
3,663,054 A 5/1972 Dubois
3,695,717 A 10/1972 Birrer
3,719,394 A 3/1973 Hartley
3,776,592 A 12/1973 Ewing
3,784,257 A 1/1974 Lauber et al.
3,788,703 A 1/1974 Thorpe
3,840,270 A 10/1974 Allgood
3,847,584 A 11/1974 Houser et al.
3,860,292 A 1/1975 Bechem
3,861,748 A 1/1975 Cass
3,904,244 A 9/1975 Haspert
3,907,366 A 9/1975 Pender
3,957,310 A 5/1976 Winberg et al.
3,963,080 A 6/1976 Walker
4,045,088 A 8/1977 Bechem
4,123,109 A 10/1978 Hill
4,159,852 A 7/1979 Montgomery
4,176,884 A 12/1979 Erwien et al.
4,189,186 A 2/1980 Snyder
4,213,653 A 7/1980 Grenia
4,232,905 A 11/1980 Dick
4,284,368 A 8/1981 Albright
4,293,077 A 10/1981 Makino
4,312,541 A 1/1982 Spurgeon
4,323,280 A 4/1982 Lansberry et al.
4,330,155 A 5/1982 Richardson et al.
4,375,594 A 3/1983 Ewanizky, Jr.
4,391,469 A 7/1983 Arsuaga
4,441,616 A 4/1984 Konig et al.
4,523,651 A 6/1985 Coon et al.
4,527,837 A 7/1985 Snyder
4,531,782 A 7/1985 Ford et al.
4,541,848 A 9/1985 Masuda
4,548,442 A * 10/1985 Sugden et al. ..... 299/10
4,568,127 A 2/1986 Traumumiller et al.
4,572,583 A 2/1986 Traumumiller et al.
4,578,627 A 3/1986 Droscher et al.
4,591,209 A 5/1986 Droscher et al.
4,603,910 A 8/1986 Laneus
4,637,657 A 1/1987 Snyder
4,641,889 A 2/1987 Brandl
4,643,567 A 2/1987 Droscher et al.
4,662,685 A 5/1987 Barnthaler et al.
4,664,449 A 5/1987 Barnthaler et al.
4,669,785 A 6/1987 Brandl
4,688,855 A 8/1987 Barnthaler et al.
4,696,518 A 9/1987 Zitz et al.
4,711,502 A 12/1987 Barnthaler et al.
4,729,445 A 3/1988 Kolleth
4,735,458 A 4/1988 Wrulich et al.
4,736,987 A 4/1988 Lenzen et al.
4,741,405 A 5/1988 Money et al.
4,744,431 A 5/1988 Stollinger
4,753,484 A 6/1988 Stolarczyk et al.
4,758,049 A 7/1988 Wernigg et al.
4,770,469 A 9/1988 Schellenberg et al.
4,784,439 A 11/1988 Wrulich et al.
4,786,112 A 11/1988 Brandl
4,796,713 A 1/1989 Bechem et al.
4,805,963 A 2/1989 Kogler et al.
4,815,543 A 3/1989 Lenzen et al.
4,834,197 A 5/1989 Bauer et al.
4,875,738 A 10/1989 Zitz et al.
4,878,714 A 11/1989 Barnthaler et al.
4,884,847 A 12/1989 Bessinger et al.
4,921,307 A 5/1990 Braun et al.
4,921,309 A 5/1990 Harrison
4,957,606 A 9/1990 Juvan
4,958,696 A 9/1990 Lerchbaum
4,966,417 A 10/1990 Zitz et al.
5,007,683 A 4/1991 Granskog
5,050,934 A 9/1991 Brandl et al.
5,072,994 A 12/1991 Brandl et al.
5,098,166 A 3/1992 Ebner et al.
5,103,705 A 4/1992 Bechem
5,108,154 A 4/1992 Brandl et al.
5,121,971 A 6/1992 Stolarczyk
5,161,857 A 11/1992 Mayercheck et al.
5,178,494 A 1/1993 Zitz et al.
5,181,934 A 1/1993 Stolarczyk
5,190,353 A 3/1993 Bechem
5,228,552 A 7/1993 Brandl et al.
5,234,257 A 8/1993 Sugden et al.
5,268,683 A 12/1993 Stolarczyk
5,310,249 A 5/1994 Sugden et al.
5,333,936 A 8/1994 Zitz
5,340,199 A 8/1994 Piefenbrink et al.
5,368,369 A 11/1994 Maity et al.
5,438,517 A 8/1995 Sennott et al.
5,439,274 A 8/1995 Krueckl
5,513,903 A 5/1996 Mraz
5,557,979 A 9/1996 Krassnitzer et al.
5,582,467 A 12/1996 Drolet et al.
5,662,387 A 9/1997 Bartkowiak
5,680,760 A 10/1997 Lunzman
5,685,615 A 11/1997 Bechem et al.
5,752,572 A 5/1998 Baiden et al.
5,810,447 A 9/1998 Christopher et al.
5,896,938 A 4/1999 Money et al.
5,939,986 A 8/1999 Schiffbauer et al.
5,964,305 A 10/1999 Arzberger et al.
5,992,941 A 11/1999 Delli-Gatti, Jr.
5,999,865 A 12/1999 Bloomquist et al.
6,027,175 A 2/2000 Seear et al.
6,058,029 A 5/2000 Itow et al.
6,062,650 A 5/2000 Smith et al.
6,109,699 A 8/2000 Mraz
6,139,477 A 10/2000 Bechem et al.
6,164,388 A 12/2000 Martunovich et al.
6,206,478 B1 3/2001 Uehara et al.
6,215,734 B1 4/2001 Money et al.
6,224,164 B1 5/2001 Hall et al.
6,244,664 B1 6/2001 Ebner et al.
6,257,671 B1 7/2001 Siebenhofer et al.
6,304,973 B1 10/2001 Williams
6,308,787 B1 10/2001 Alft
6,315,062 B1 11/2001 Alft et al.
6,431,653 B1 8/2002 Kleuters
6,431,654 B1 8/2002 LeBegue
6,505,892 B1 1/2003 Walker et al.
6,547,336 B2 4/2003 Hoffmann
6,561,590 B2 5/2003 Sugden
6,612,655 B2 9/2003 Schwoebel et al.
6,799,809 B2 10/2004 Mraz
6,817,678 B2 11/2004 Seear et al.
6,848,748 B2 2/2005 Paschedag et al.
6,857,706 B2 2/2005 Hames et al.
7,695,071 B2 4/2010 Jackson et al.

FOREIGN PATENT DOCUMENTS

AU 56858/80 7/1980
AU 66910/81 8/1981
AU 71066/81 12/1981
AU 17369/83 2/1984
AU 36721/84 6/1985
AU 37937/85 8/1985
AU 45200/85 2/1986
AU 55091/86 3/1986
AU 62506/86 9/1986
AU 45843/85 2/1987
AU 12696/88 5/1989
AU 74104/94 11/1994
CA 1214797 12/1986
CA 1218388 2/1987
CA 1262368 10/1989
CA 2109921 12/1992
CA 2121044 4/1993
CA 2291043 12/1998
DE 2745928 4/1987
EP 115942 8/1984
EP 0791694 8/1997
FR 1370085 8/1964
GB 735749 8/1953

| | | |
|---|---|---|
| GB | 2120579 | 12/1983 |
| JP | 59192195 | 10/1984 |
| JP | 4-235831 | 8/1992 |
| WO | WO 82/01749 | 5/1982 |
| WO | WO 84/02951 | 8/1984 |
| WO | WO 85/02653 | 6/1985 |
| WO | WO 97/48883 | 12/1997 |
| WO | WO 98/35133 | 8/1998 |
| WO | WO 00/43637 | 7/2000 |
| WO | WO 00/46486 | 8/2000 |
| WO | WO 02/01045 | 1/2002 |
| WO | WO 03/050391 | 6/2003 |
| ZA | 82/1297 | 1/1983 |
| ZA | 83/3060 | 4/1983 |
| ZA | 84/9431 | 7/1985 |
| ZA | 92/3454 | 5/1992 |
| ZA | 92/3455 | 5/1992 |
| ZA | 94/4480 | 6/1994 |
| ZA | 97/4804 | 12/1997 |
| ZA | 98/8239 | 9/1998 |
| ZA | 99/2714 | 10/1999 |
| ZA | 99/7873 | 7/2000 |
| ZA | 2000/7587 | 12/2000 |
| ZA | 2002/6394 | 8/2002 |

OTHER PUBLICATIONS

AGH Associates, "Reef Miner Questions," http://www.reefminer.com/page3.html.
AGH Associates, "Reef Miner Description," http://www.reefminer.com/page2.html.
Brochure entitled "BAUER Trench Cutter Systems".
Application Notes, Hi-Vac, 12 pages, undated.
New-Vac Mining Brochure, 9 pages, undated.
Sixth International Symposium on Mine Mechanization and Automation, The South Africa Institute of Mining and Metallurgy, Johannesburg 2000, 284 pages.
"McArthur River Uranium," Mining Magazine (Oct. 1997), available at http://www.wma-minelife.com/uranium/mining/art138.htm.
PCT Written Opinion for International App. No. PCT/IB03/05356 dated Dec. 21, 2004.
PCT International Preliminary Examination Report for International App. No. PCT/IB03/05358 dated Feb. 3, 2005.
Larson, David A., et al. "Large-Scale Testing of the Ripper Fragmentation System," (U.S. Government Printing Office 1987) (19 pages).
Asbury et al., "A New Concept for Selective Mechnanical Mining of Hard Rock", date unknown.
Friant et al., "Mini-Cutter Technolgy—The Answer to a Truly Mobile Excavator", Proceedings of North American Tunneling 1994 Conference and Exhibition; Denver, Colorado, Jun. 6-9, 1994; 8 pages.
Ronnkvist et al., "Development of a Mechanical Alcove Excavator for the Yucca Mountain Exploratory Study Facility", 6 pages, date unknown.
Ronnkvist et al., "Testing and Performance Evaluation of a 32 Inch Cutterhead Using Mini Disc Cutters", Proceedings of ISDT Annual Technical Conference 1994; Las Vegas, Nevada; Apr. 18-21, 1994; 8 pages.
Rostami et al., "Mini-Disc Equipped Roadheader Technology for Hard Rock Mining", p. 16-1 to 16-12, Golden, Colorado, date unknown.
PCT Written Opinion for International App. No. PCT/US05/13905 dated Apr. 22, 2005.
Examiner's First Report for Australian 2003280144, mailed Oct. 25, 2006.

* cited by examiner

FIGURE 3 OUTPUT CHARACTERISTICS

AUTOMATED EXCAVATION MACHINE

CROSS REFERENCE TO RELATED APPLICATIONS

The present application is a divisional of U.S. application Ser. No. 10/688,216, filed Oct. 15, 2003, now U.S. Pat. No. 7,695,071, entitled "Automated Excavation Machine," which claims the benefit of U.S. Provisional Patent Application No. 60/440,995, filed Jan. 17, 2003, U.S. Provisional Patent Application No. 60/431,188, filed Dec. 4, 2002; U.S. Provisional Patent Application No. 60/418,716, filed Oct. 15, 2002, and U.S. Provisional Patent Application No. 60/419,048, filed Oct. 15, 2002, each of which is incorporated herein in their entireties by this reference. Cross reference is made to U.S. Pat. No. 6,857,706, which contains subject matter related to the subject matter of the present application.

FIELD OF THE INVENTION

The present invention relates generally to excavators and specifically to underground mining excavators.

BACKGROUND OF THE INVENTION

Annually, underground mining of valuable materials is the cause of numerous injuries to and deaths of mine personnel. Governments worldwide have enacted restrictive and wide-ranging regulations to protect the safety of mine personnel. The resulting measures required to comply with the regulations have been a contributing cause of significant increases in underground mining costs. Further increases in mining costs are attributable to global increases in labor costs generally. Increases in mining costs have caused numerous low grade deposits to be uneconomic to mine and therefore caused high rates of inflation in consumer products.

To reduce mining costs and provide for increased personnel safety, a vast amount of research has been performed to develop a mining machine that can excavate materials continuously and remotely. Although success has been realized in developing machines to mine materials continuously in soft deposits, such as coal, soda ash, talc, and other sedimentary materials, there continue to be problems in developing a machine to mine materials continuously in hard deposits, such as igneous and metamorphic materials. A primary problem to developing a continuous mining machine in hard materials has been an unacceptably high rate of cutter bit wear.

Development of a remotely operable or fully automatic machine has been problematic in both soft and hard deposits. The currently available logic necessary to provide for full or partial automation is relatively crude. The ability to precisely locate the machine with reference to the orebody has also been difficult, leading to unacceptably high rates of dilution of excavated ore with barren country rock. Precise, real-time, and simultaneous location of the orebody and the mining machine is extremely important to ensure that each cut of the mining machine is optimal relative to the exposed ore-bearing zone.

SUMMARY OF THE INVENTION

These and other needs are addressed by the various embodiments and configurations of the present invention. The present invention provides a remotely operable and/or semi- or fully-automatic excavation system that is capable of efficiently and effectively excavating in situ materials, particularly valuable-metal containing orebodies.

In one embodiment, the present invention is directed to an excavator that is operable in manual and automatic modes and uses state machines to effect unit operations. A control system, such as a task supervisor module or engine, invokes the various state machines depending upon operator input and/or predetermined rules and policies. A graphical user interface can be provided on the excavator and/or at a remote control station to provide the operator with operational feedback and receive the operator's mode, state, and functional commands and changes to configurable parameters. As used herein, "control system" refers to any task control logic, whether implemented as hardware and/or software, including the task supervisor module, sequencing modules, kinematic modules, servo valve controllers, sensor conditioning applications, and user interface applications. The task supervisor module is typically a high level task automation logic, whether implemented as hardware and/or software, including sequencing, mode switching, and exception handling modules. Low level task automation logic includes servo controllers, kinematic modules, sensor conditioning modules, alarm detection modules, and device interfaces.

In yet another embodiment, the excavator uses rotationally offset swing actuators to rotate a boom and cutter head. The offset swing actuators can provide a more effective torque profile throughout the rotational cycle of the boom.

In yet another embodiment, the excavator uses a fail safe hydraulic system to maintain gripper pressure in the event of a malfunction of the hydraulic system. The fail safe hydraulic system includes a number of check valves that are activated when hydraulic fluid pressure falls below a selected setpoint. An emergency retract line is used to pressurize discretely or collectively the various valves to effect drainage of the hydraulic fluid. The fail safe hydraulic system permits the excavator to maintain a current position and orientation, thereby providing for increased personnel safety and machine protection, particularly where the excavator is located on dipping formations.

In yet another embodiment, the excavator uses differing position and pressure control functions in the hydraulic actuators depending on the desired function of the hydraulic actuator. Generally, a cylinder or cavity thereof in the position control function maintains at least substantially a selected position relative to a point of reference while permitting the hydraulic fluid pressure in the cylinder or cavity thereof to be varied. A cylinder or cavity in the pressure control function maintains at least substantially a selected hydraulic fluid pressure in the cylinder or cavity while permitting the cylinder position to be varied.

In yet another embodiment, the excavator comprises a kinematic module to effect pitch and roll adjustments of the excavator using a number of hanging wall and footwall grippers. The kinematic module converts attitude data into control commands and feedback signals into attitude data and is able to determine an error vector, using feedback signals, to effect adjustment of the various grippers.

In yet another embodiment, the excavator uses a cutting face profile generator to generate a profile of the excavation face to configure automatically boom swing parameters (such as swing angle and cutting depth) and/or an optimization module to realize a high degree of optimization of excavator operation.

The excavator of the present invention can provide a number of advantages. First, the excavator can provide an efficient and cost effective way to excavate steeply dipping orebodies, particularly steeply dipping orebodies of narrow widths. The excavator can mine the material in the orebodies with dilution levels far lower than those possible with current mining methods and techniques. A conventional narrow vein stope must be of a size that allows access for people and mining equipment, which typically requires the stope to be excavated to a size greater than the width of the mineralized vein, causing dilution. The excavator of the present invention, in contrast, can use a narrower stope width and therefore cause lower dilution rates, as the excavation is typically done remotely by operating personnel.

Second compared to conventional stopes, the remote operation of the excavator can also reduce significantly the danger to personnel caused by unstable ground, and the reduced sizes of voids in and about the stope can also beneficially reduce the likelihood of a seismic event, as the impact on the regional void/rock ratio is significantly reduced. Unlike conventional stopes, personnel generally do not have to enter the stope, except in the event of operational problems and/or maintenance of the excavator system. This is particularly advantageous for steeply dipping deposits located at great depths.

Third, the reduced dilution and improved automation can reduce the mine's costs significantly. On the mining side, dilution and improved automation can reduce excavation costs by minimizing materials handling, reducing manpower, reducing equipment requirements, reducing ground support, reducing primary ventilation capacities, and permitting improved utilization of people and equipment. On the processing side, the reduced tonnage required for a given amount of metal production can have huge benefits for the milling process. Cost savings due to the reduced system capacities can apply in comminution, flotation, tailings disposal, plant manpower, electricity, diesel, and improved utilization of people in the plant. The reduced operating costs compared to conventional mining methods can increase the size of a mine's reserves (which is directly dependent on the costs to extract and process the mineralized material).

Fourth, the excavator can be highly flexible. The excavator can follow and track narrow vein ore regardless of the orientation, dip, or metal being mined. The on board sensors and navigation system can provide precise tracking in most applications.

Fifth, compared to the above prior art systems the excavator can require less underground development before the orebody is mined by the excavator of the present invention.

Sixth, the excavator is typically not limited to proper combinations of ore and adjacent country rock characteristics for the excavator to be able to mine an orebody.

Seventh, the excavator does not generally require a draw rate to be controlled to prevent losing large amounts of ore.

Eighth, the excavator, using the optimization module, can be flexible enough to allow for learning in the field and easy adaptation to varying conditions.

Ninth, the excavator can move in a predictable fashion in response to operator commands. This is so because the excavator uses a task supervisor engine and collection of state machines rather than a non-determinisitic or "chaotic" algorithm, such as neural networks or fuzzy logic. An engine invoking multiple state machines can also provide a much simpler and more efficient architecture.

Other advantages will be evident to one of ordinary skill in the art based on the descriptions of the inventions set forth below.

The above-described embodiments and configurations are neither complete nor exhaustive. As will be appreciated, other embodiments of the invention are possible utilizing, alone or in combination, one or more of the features set forth above or described in detail below.

DETAILED DESCRIPTION

The Excavator

Figure 1:
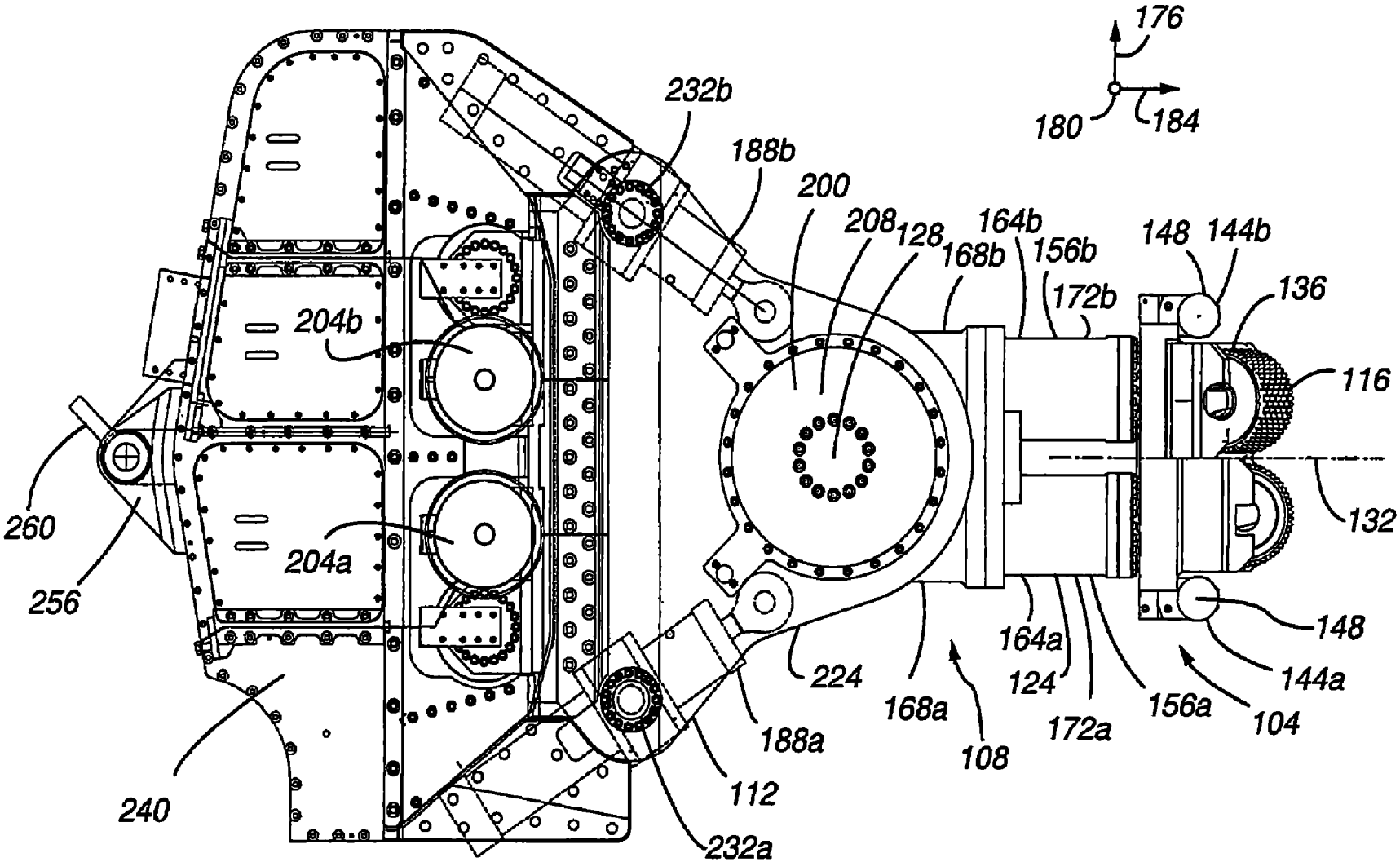
FIG. 1 is a top plan view of an embodiment of an excavator according to an embodiment of the present invention.
Figure 2:
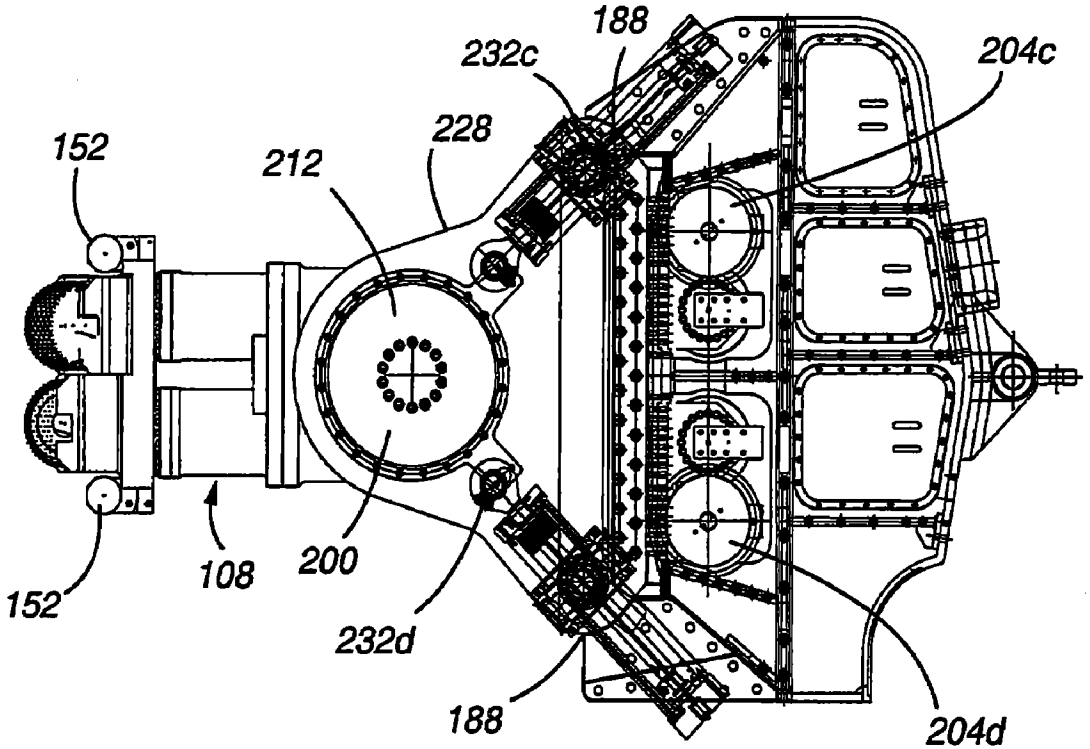
FIG. 2 is a bottom plan view of the excavator of FIG. 1.
Figure 4:
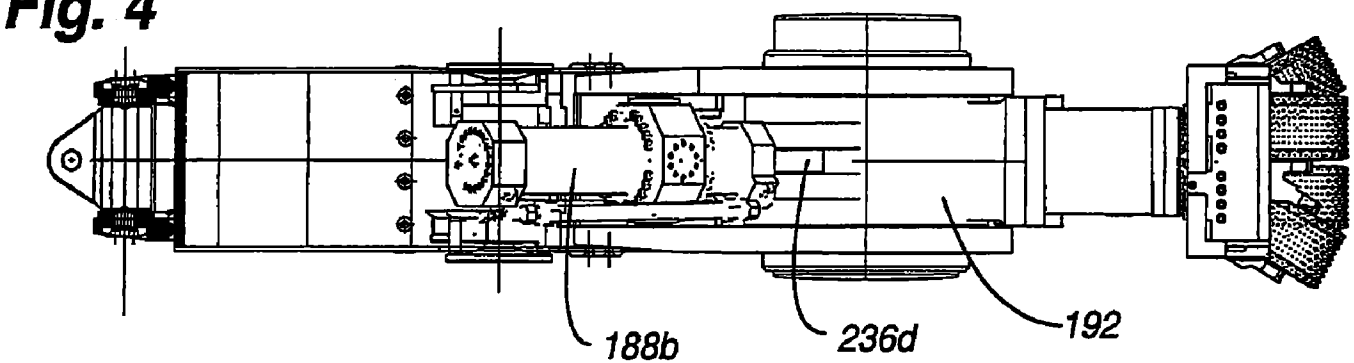
FIG. 4 is a right-side view of the excavator of FIG. 1.
Figure 3:
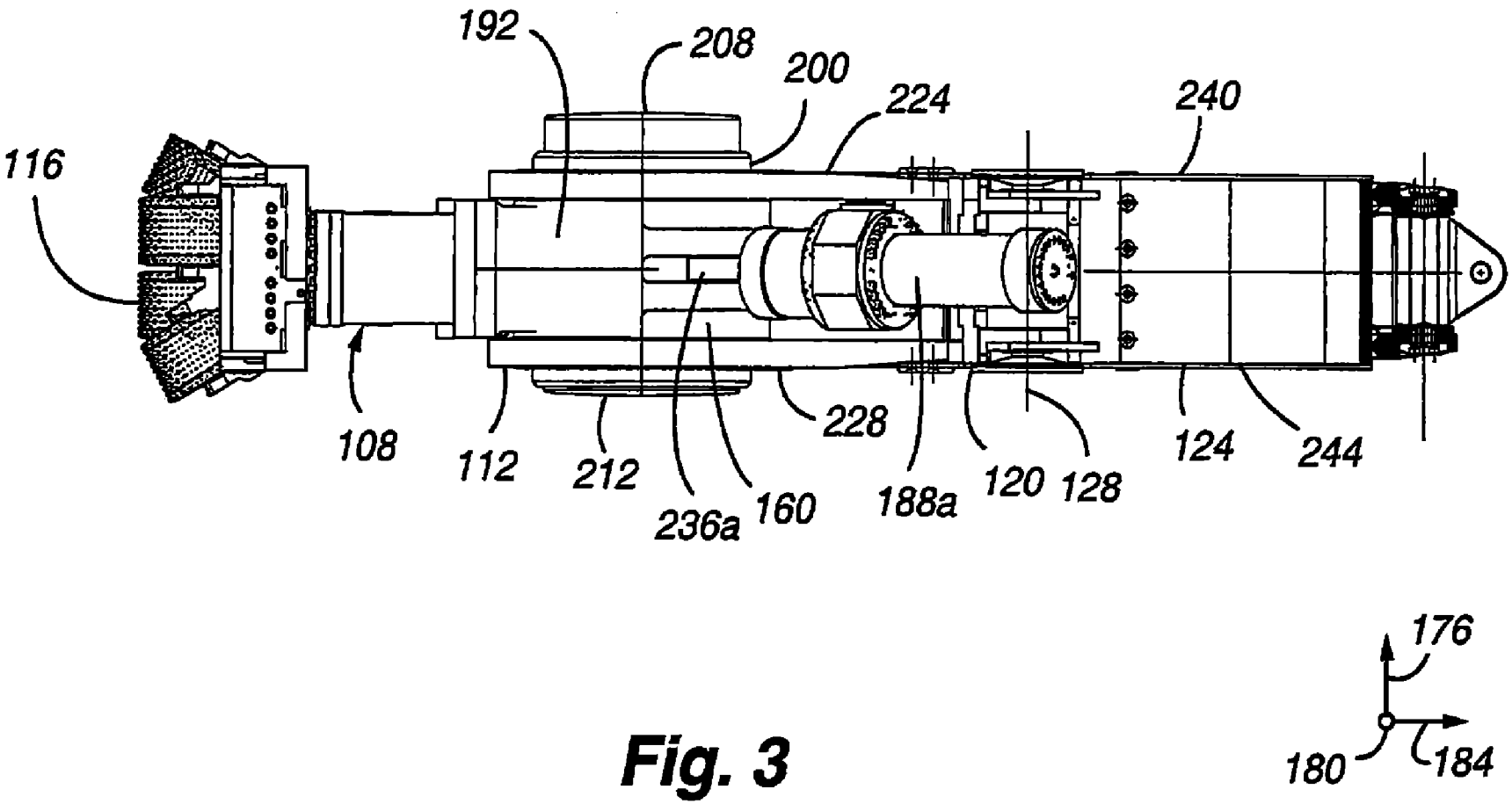
FIG. 3 is a left-side view of the excavator of FIG. 1.
Figure 5:
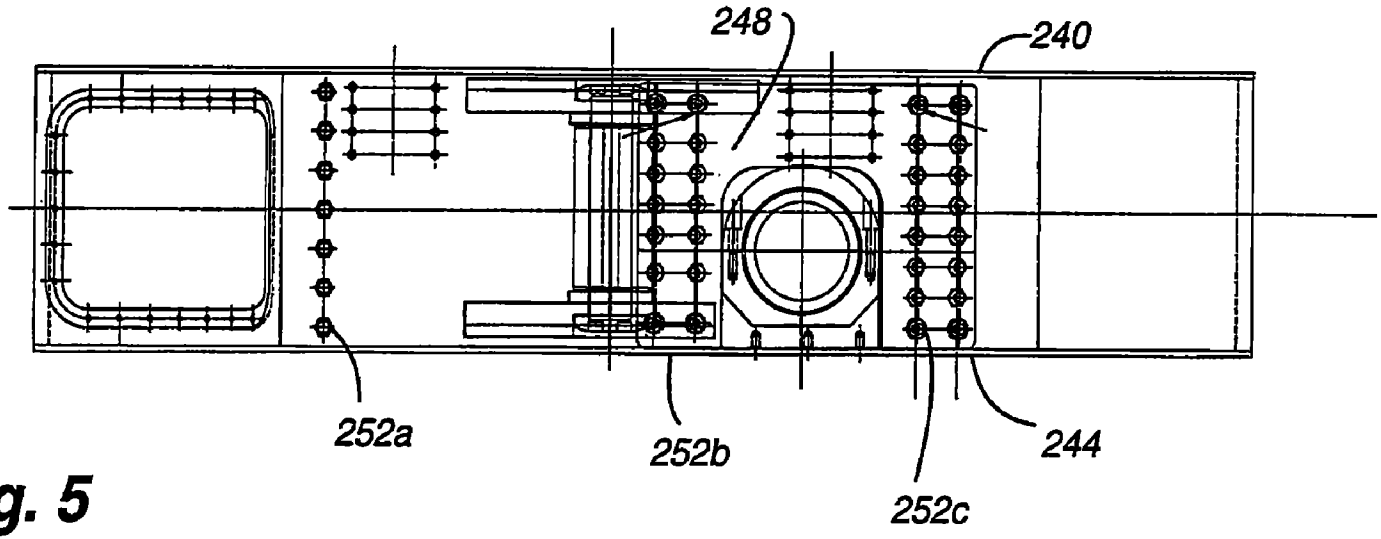
FIG. 5 is a rear view of the excavator of FIG. 1.
Figure 6:
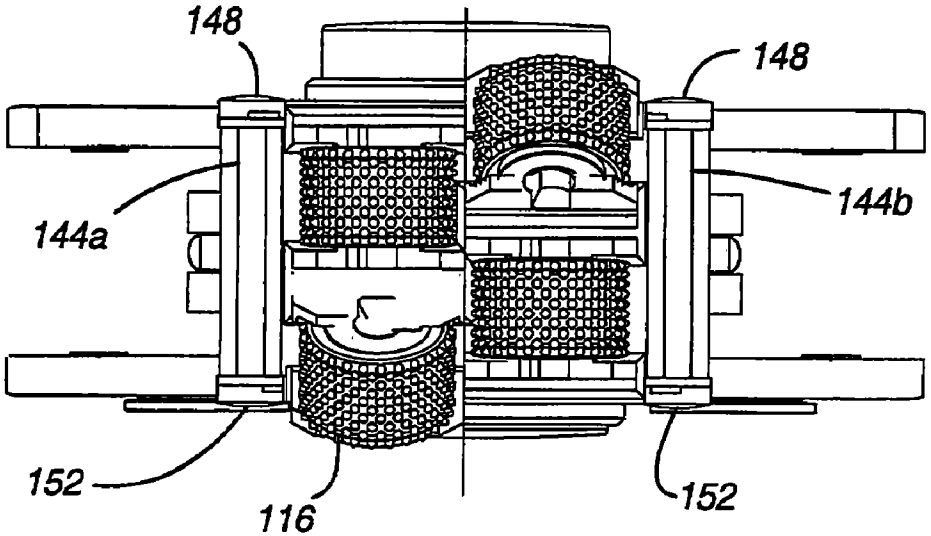
FIG. 6 is a front view of the excavator of FIG. 1.

FIGS. 1-6 depict an excavator according to the present invention. The excavator 100 includes a cutter head 104 mounted on a swinging boom assembly 108 and an anchorable body 112.

The cutter head 104 mounts a plurality of overlapping cutting discs or rollers 116, such as rolling type kerf cutters, carbide cutters, button cutters, and disc cutters. The rear end 120 of the boom 124 is rotatable about a rotational axis 128 passing through the anchorable body 112 and normal to the plane of the page (FIG. 1) and to the length or longitudinal axis 132 of the boom 124.

The cutter head 104 typically excavates rock by breaking rock in compression during boom rotation or swings. The discs or rollers work by applying high point loads to the rock and crushing a channel through the rock. The pressure exerted by the discs or rollers in turn breaks small wedges of rock away from the edge of the discs or rollers, thereby excavating the rock. The array of discs or rollers 116 in the head 136 will sweep (or cycle) across the face excavating in the order of about 2 mm of the rock face per rotational cycle.

As will be appreciated, the cutter head 104 can include any one of several suitable excavation devices. For example, the cutter head 104 can include one or more oscillating disc cutters, (vibrating) undercutting disc cutters, plasma hydraulic projectors (such as described in U.S. Pat. Nos. 6,215,734; 5,896,938; and 4,741,405), picks, white light rock removal device(s), mini-disc cutters, water jets, impact hammers, impact rippers, pick cutters, disc cutters, and button cutters. An undercut disc cutter can also be employed as the excavator. An undercut disc cutter breaks rock in tension, using discs to undermine and "rip" rock from the face.

The swinging boom assembly 108 can include a scraper to remove rock cuttings during rotation of the boom 124, left and right cutter head grippers 144*a,b*, each of which engages a hanging wall engaging shoe 148 and a footwall engaging shoe 152, two longitudinal supports 156*a,b*, and a rotating cylinder 160 rigidly engaging the thrust cylinders assemblies 164*a,b*. The cutter head grippers 144 engage the hanging wall and footwall and stabilize the excavator during walking and steering. Each cylinder assembly 164*a,b* is formed by a telescopically engaged front and rear section 168*a,b* and 172*a,b*. A hydraulic thrust actuator (not shown) is positioned within or in the interior of each of the assemblies to provide controlled extension/retraction of the supports in the direction shown. Alternatively, the assemblies themselves can be in the form of hydraulic actuators with a hydraulic fluid and/or pumps being contained within the supports and or body. The thrust cylinders assemblies control the radius of the cutting arc and the cutting force exerted on the cutter head.

Because the forces applied to the cutter head 104 typically are at least about 50,000 lbs and more typically range from about 25,000 to about 300,000 lbs, the thrust cylinders assemblies must be strong to resist a high amount of torque or torsional forces (exerted around the pitch, yaw, and roll axes 176, 180, and 184, respectively, of FIG. 1). The torsional strength of each cylinder assembly preferably is at least about 10,000 ft-lbs and more preferably is from about 5,000 to about 50,000 ft-lbs, the compressive strength of each cylinder assembly preferably is at least about 50,000 lbs and more preferably is from about 10,000 to about 300,000 lbs, and the tensile strength of each cylinder assembly preferably is at least about 10,000 lbs and more preferably is from about 5,000 to about 50,000 lbs.

The excavator includes swing actuators 188*a,b* that rotatably engage the body 112 and the boom assembly 108 to rotate the boom assembly 108 relative to a rotatable body member 192 (as shown) by extending and retracting in opposing cycles. That is, when swing actuator 188 a extends, swing actuator 188*b* retracts and vice versa. As discussed below, each swing actuator is configured to pass through a change in direction near the middle of the boom swing.

The body 112 comprises a main gripper 200, swing actuators 188*a,b*, and upper and lower and left and right rear grippers 204*a-d*. The main gripper 200 counteracts the cutting force exerted on the cutter head by the thrust actuators. The main gripper includes or is located within the rotating body member 192 or cylinder 160 (engaging the thrust cylinder assemblies) and dual central hydraulic actuators (not shown) (located within the rotating body member 192) and engaging hanging wall and footwall engaging shoes 208 and 212 for engaging hanging wall 4428 and footwall 4424 (FIG. 45)). The upper and lower and left and right rear grippers are located at the rear of the excavator and, along with the main gripper, are locked in place during mining to stabilize the excavator about the roll, yaw, and pitch axes 176, 180, and 184. The origin of the roll (X-axis), yaw (Z-axis), and pitch (Y-axis) axes is located typically at the center of the excavator along the axis 128 of the main gripper 200. Each rear gripper includes a hydraulic actuator and a shoe that engages one of the hanging wall and footwall.

The designs of the various actuators depend on the gripper. The cutter head grippers each comprise a pair of linear piston actuators that are commanded by a single command signal from the control system. Two digital outputs from the control system command the cutter head grippers to either extend or retract. The thrust cylinder assemblies each comprise a linear hydraulic actuator. The swing actuators are a tandem linear actuator set working together to produce a swing motion of the cutter head. By controlling the flow of hydraulic fluid in the swing actuators using a variable orifice control valve, the boom swing angle and swing velocity can be controlled. The main gripper is a linear actuator with two pistons that is controlled by three separate and independently controllable variable orifice control valves. The hydraulic pressure in each of the three chambers of the actuator is precisely controlled to obtain the desired force on the main gripper output shoes. The left and right rear grippers each comprise a pair of linear actuators that operate in concert to provide the desired pitch and roll of the excavator and the gripping force during cutting operations. Each actuator is a piston-type actuator controlled by a corresponding variable orifice control valve.

The body 112 further includes top and bottom plates 224 and 228 (which rotatably engage swing actuators 188 via pivots or trunions 232*a-d* and rotating body member 192 via pivots 236*a,b* located on either side of the body member), upper and lower rear shrouds 240 and 244 protecting electronic and hydraulic components 248, rear structural members 252*a-c* to provide support to the shrouds, and support assembly 256 for engaging a support cable 260.

The excavator 100 will typically have one or more umbilicals (not shown), one of which provides water to flush cuttings from the face, to control dust, and control heat buildup during excavation, another of which provides electric power, another of which provides hydraulic fluid, and/or yet another of which provides signal transmission or telemetry (for navigation, steering, video, operating level measurements, etc.).

The cutter 100 height can be selected to be no more than the thickness of the orebody. In some applications, the height is much less than the orebody thickness, thereby requiring several sweeps across the face to produce a cut having the desired height.

Boom Rotation During Excavation

The movement of the swing actuators 188*a,b* will now be discussed with reference to FIGS. 7-10. In the figures, the dashed lines 500 and 504 represent the maximum points of swing of the longitudinal boom axis 248 (which is the same as axis 132 in FIG. 1). The point 244 represents the rotational axis of the boom 124 (which is axis 128 in FIG. 1 and is normal to the plane of the page in FIGS. 7-10), and lines 512 and 508 represent the longitudinal axis of the swing actuators 188*a,b*, respectively.

Figure 7:
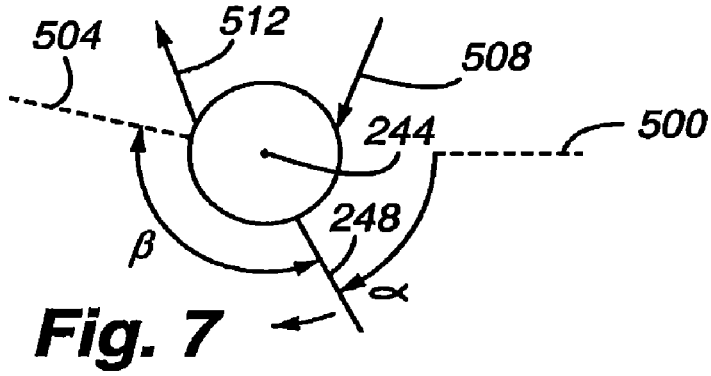
FIG. 7 is a first force diagram depicting the rotational sequence for the excavator boom.

Referring to FIG. 7, when the longitudinal boom axis 248 is in the position shown and moving clockwise, or at a rotational angle $\alpha$ (which is measured relative to dashed line 500) of about 60°, swing actuator 188*a* is pushing (as shown by the arrow) and swing actuator 188*b* is pulling (as shown by the arrow). The longitudinal axes of the swing actuators intersect on the boom side of the boom rotational axis 244 and dashed lines 500 and 504. The projection of the longitudinal axis of the swing actuator 188*b* is positioned on the boom side of the boom rotational axis 244. The angle $\beta$ between dashed lines 504 and axis 248 is typically about 120°.

Figure 8:
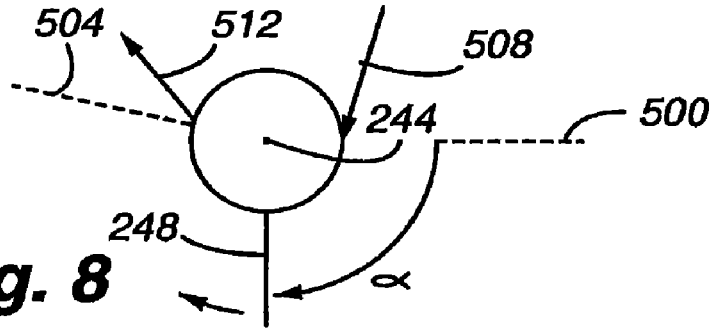
FIG. 8 is a second force diagram depicting the rotational sequence for the excavator boom.

Referring to FIG. 8, when the longitudinal boom axis 248 is in the position shown and moving clockwise, or at a rotational angle $\alpha$ of about 90°, swing actuator 188*a* is pushing (as shown by the arrow) and swing actuator 188*b* is pulling (as shown by the arrow). The longitudinal axes of the swing actuators again intersect on the boom side of the boom rotational axis 244 and dashed lines 500 and 504.

Figure 9:
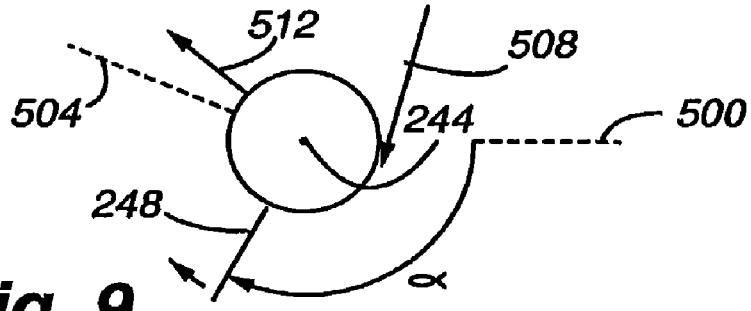
FIG. 9 is a third force diagram depicting the rotational sequence for the excavator boom.

Referring to FIG. 9, when the longitudinal boom axis 248 is in the position shown, or at a rotational angle $\alpha$ of about 105°, swing actuator 188*a* is pushing (as shown by the arrow) and swing actuator 188*b* is pulling (as shown by the arrow). The projection of the longitudinal axis of the swing actuator 188*b* has moved through the boom rotational axis 244 and is now positioned on the other side of the boom rotational axis 244.

Figure 10:
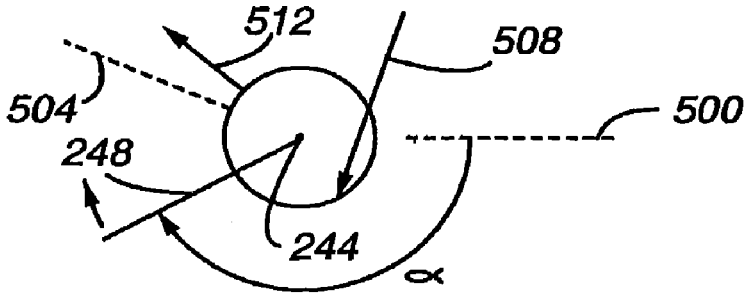
FIG. 10 is a fourth force diagram depicting the rotational sequence for the excavator boom.
Figure 11:
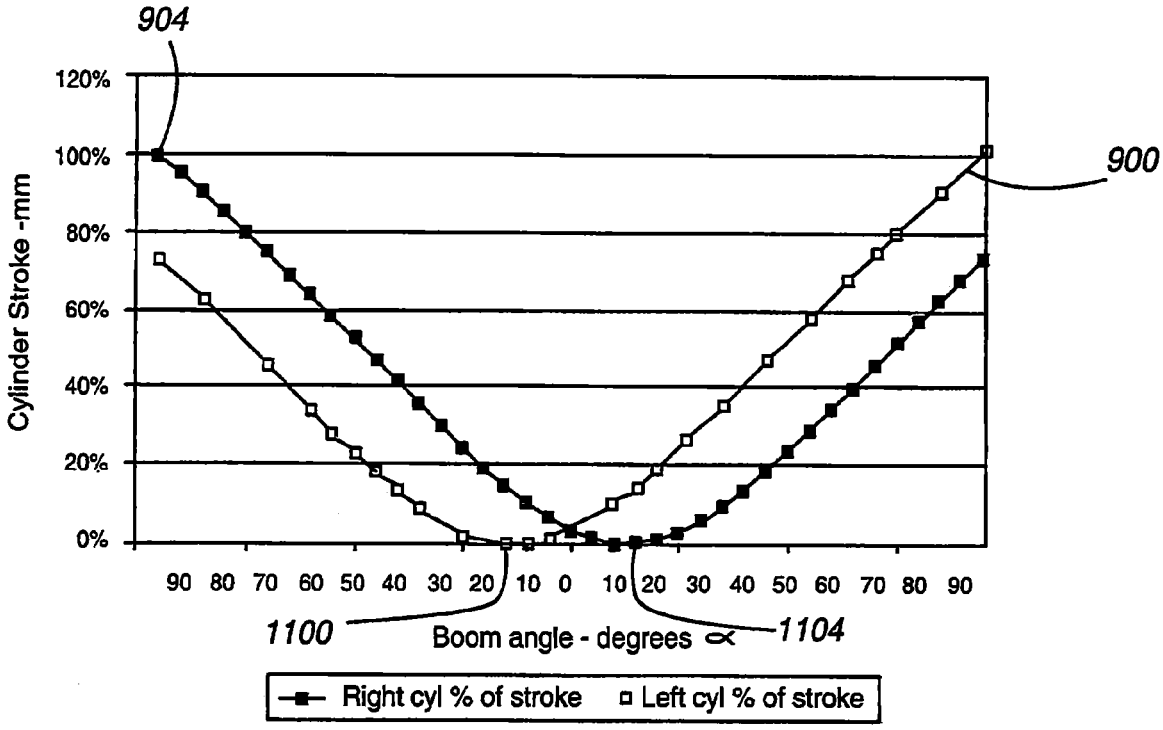
FIG. 11 is a plot of the cylinder stroke (vertical axis) against the boom angle (horizontal axis) for the excavator boom.

Referring to FIG. 10, when the longitudinal boom axis 248 is in the position shown, or at a rotational angle $\alpha$ of about 120°, swing actuator 188*a* is pushing (as shown by the arrow) and swing actuator 188*b* is now pushing (as shown by the arrow). The longitudinal axes of the swing actuators again now intersect on the other side of the boom rotational axis 244 and dashed lines 500 and 504. When the boom longitudinal axis 248 reaches dashed line 504, swing actuators 188*a,b* will transition to pulling. On the reverse swing, the previous description is reversed with respect to swing actuators 188*a,b*. As shown in FIG. 11 (in which curves 900 and 904 correspond to cylinders 188*a,b*, respectively, the factor that determines whether a swing actuator will be pushing or pulling is the extension of the cylinder.

Steering of the Cutter Head Along the Excavation Face

Referring again to FIGS. 1-6, various methodologies to steer the cutter head will now be described.

In a first steering method, the position of the top and bottom plates 224 and 228 is maintained constant relative to the positions of the shoes 208 and 212. The machine body is translated along the axes of the rear grippers 204 to cause the cutter head 104 to move up or down, as desired. In this method, the machine behaves as a rigid beam with the axis of rotation of the machine being along a line normal to the centerlines of the rear gripper.

In a second steering method, the machine body is translated up and down uniformly along the axes of the main, rear steering, and roll grippers. In this method, the boom does not rotate in the plane of the page but moves up and down relative to (and normal to) the hanging and footwalls.

In a third steering method, the positions of the top and bottom plates 224 and 228 is maintained constant relative to the positions of the shoes 208, 212, and of the rear grippers 204*a-d*. The machine body is translated along the axes of the main gripper to cause the cutter head to move up or down, as desired. In this method, the machine behaves as a rigid beam with the axis of rotation of the machine being along a line normal to the vertical centerline of the main gripper.

In the fourth method, translation occurs in all of the grippers except that the location of the cutter head is maintained stationary. In this way, the machine rotates about a point of contact between the cutter head and the rock face. Combinations of these methods are possible such that the axis of rotation of the machine is moved along the length of the machine between the main gripper and the rear steering and roll grippers. The fourth steering method is more preferred. The other methods can cause higher rates of cutter wear and place more stress on the machine components (increasing the rate of machine wear). The preferred steering method will, of course, depend on the type of rock being excavated.

Cylinder Positional Sensor

Figure 12:
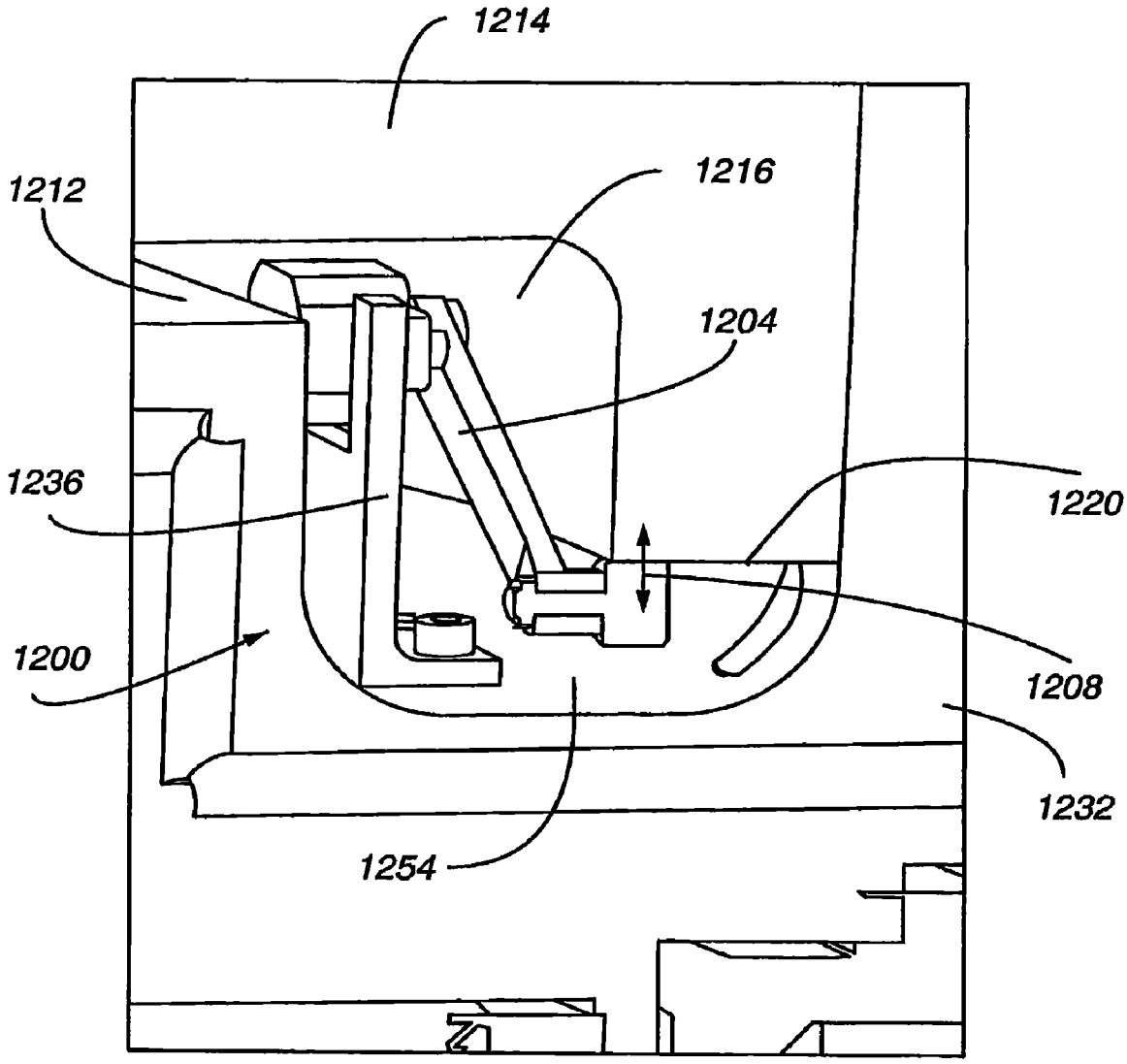
FIG. 12 is a shoe positional sensor according to yet another embodiment of the present invention.
Figure 13:
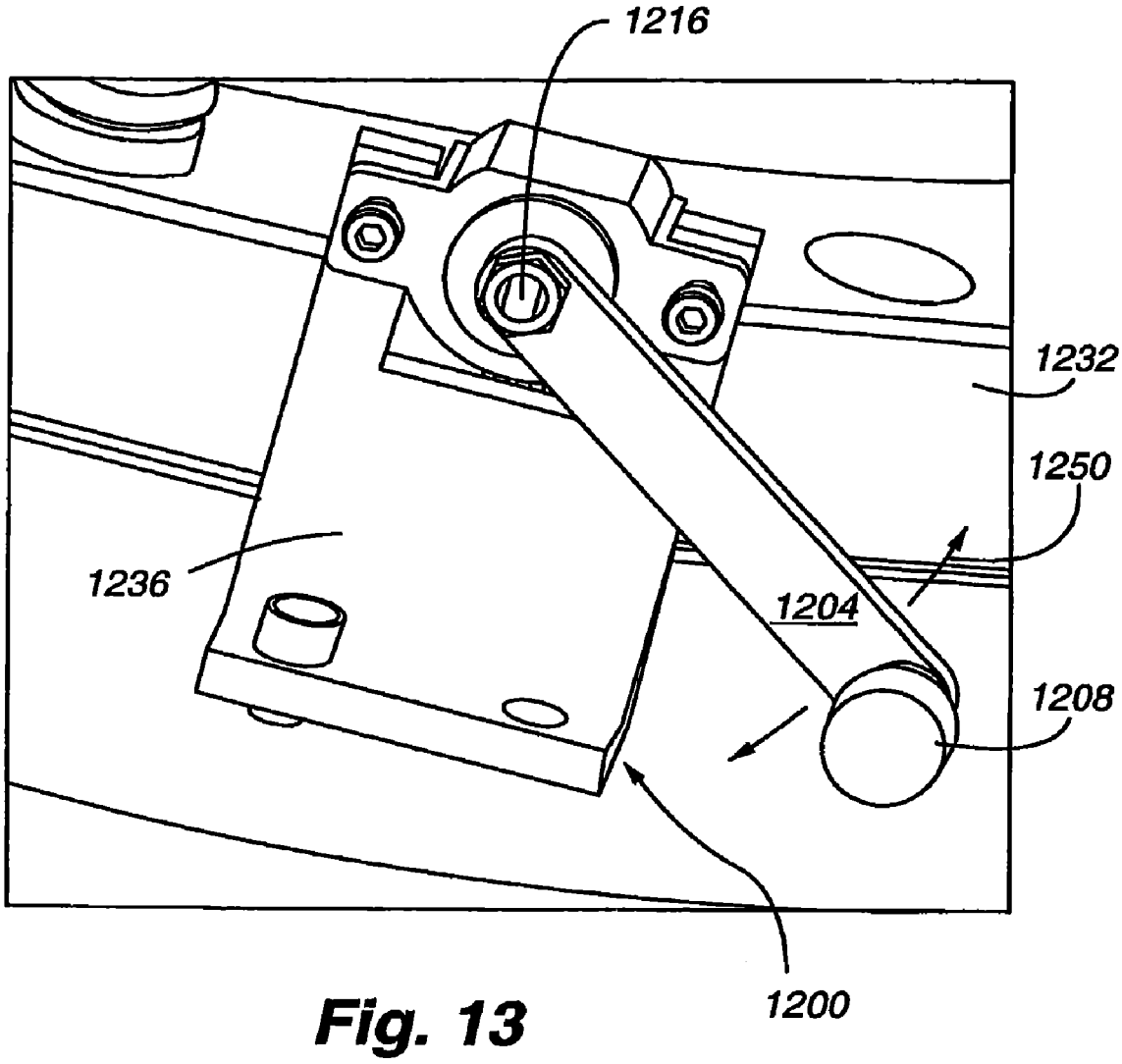
FIG. 13 is a side view of the positional sensor of FIG. 12.
Figure 14:
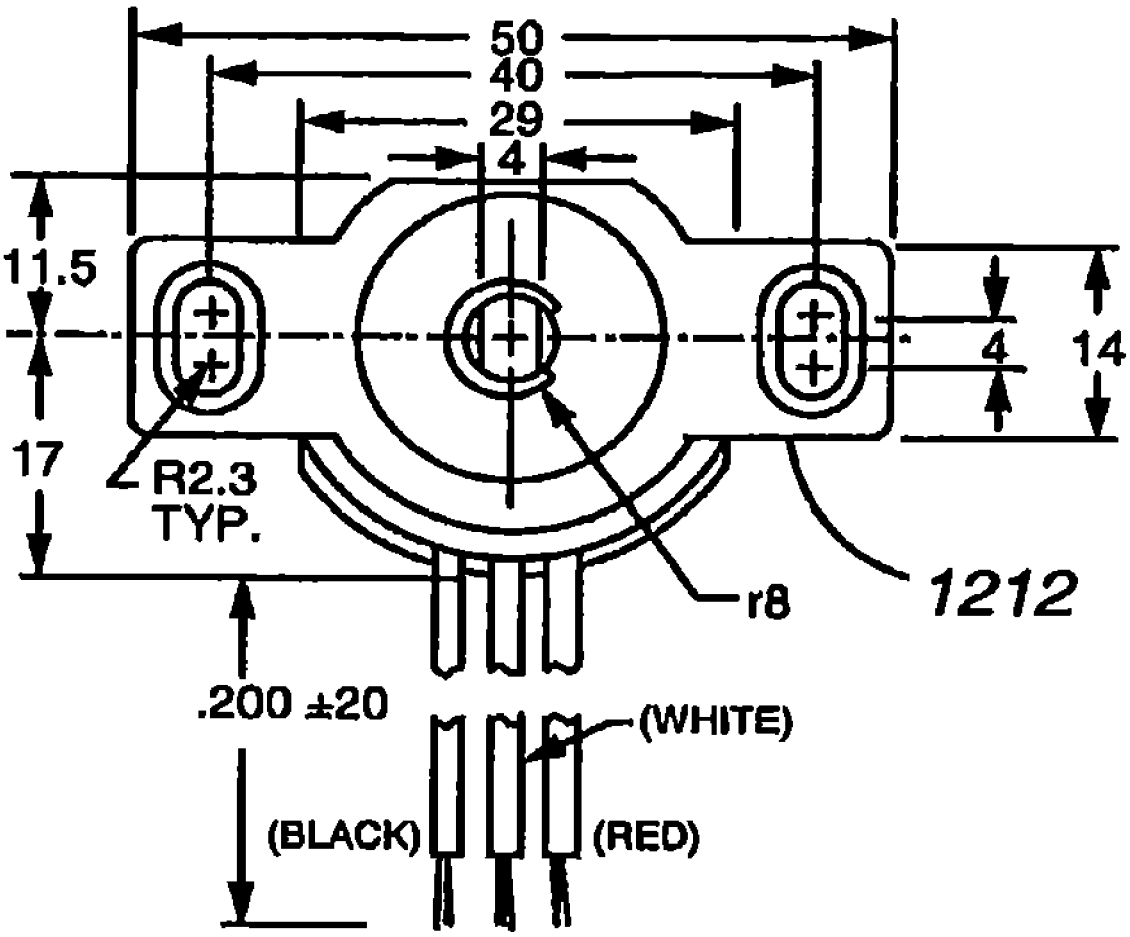
FIG. 14 is a side view of the sensor unit of the positional sensor of FIG. 12.
Figure 15:
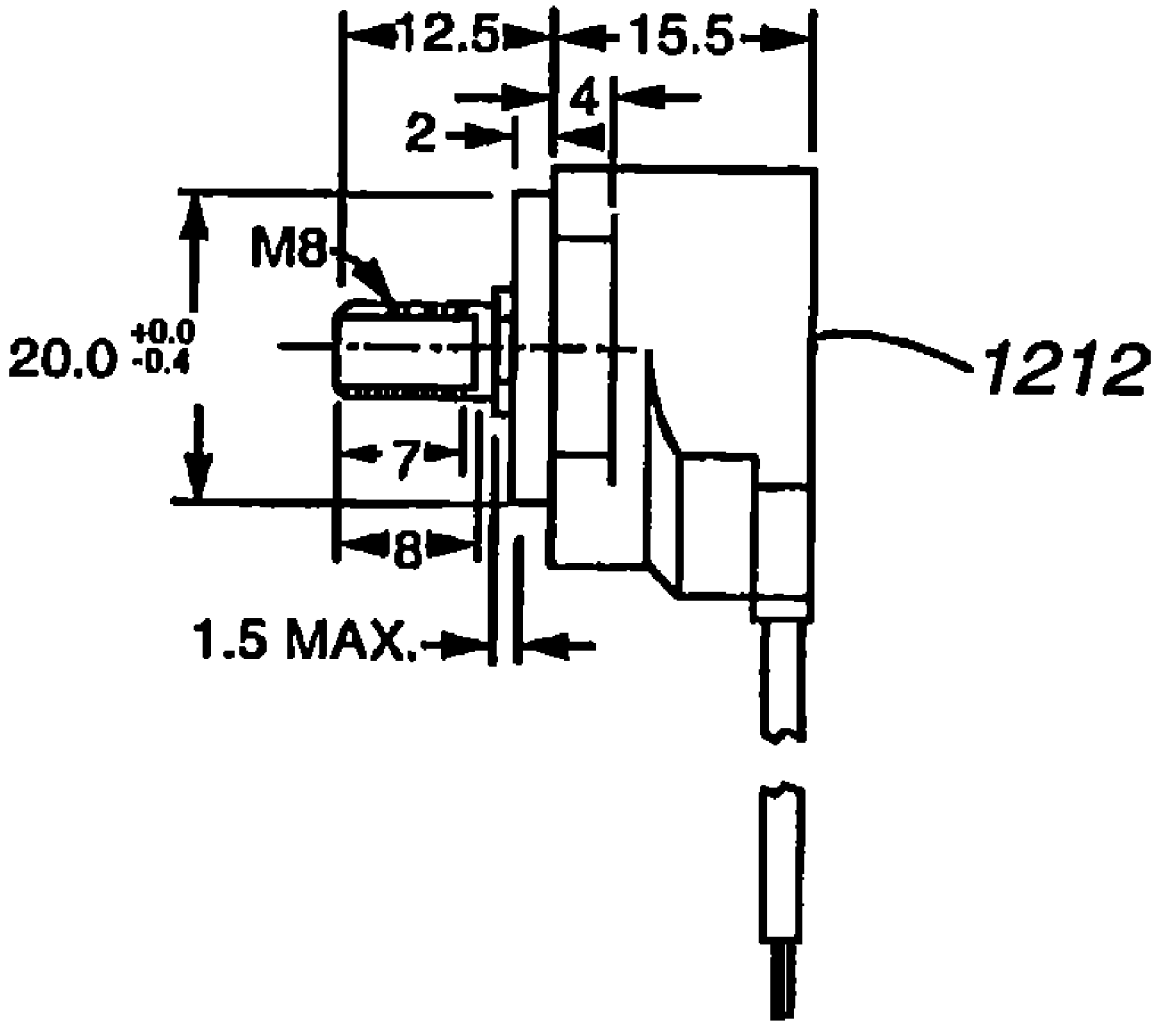
FIG. 15 is a side view of the sensor unit of the positional sensor of FIG. 12.

A positional sensor that is particularly useful for determining continuously or semi-continuously the position of the cylinder is depicted in FIGS. 12-17. The sensor 1200 comprises a rotational arm 1204, a roller 1208 on a distal end of the arm 1204, and a sensing unit 1212 for measuring angles of rotation of the arm 1204 relative to a selected arm setting or orientation. A spring (not shown) engaging the shaft 1216 of the sensing unit 1212 resists rotation of the arm from the setting, thereby causing the arm to return to the setting when force is no longer applied to the roller. As shown in FIG. 12, the roller engages a lower surface 1220 (FIG. 12) of the hydraulic actuator 1214 and is engaged with the supporting bracket 1232 (FIG. 12) via sensor mounting bracket 1236. As the hydraulic actuator 1214 moves upwards and downwards, the roller 1208 travels along the shoe surface 1220, causing rotation of the arm 1204 about the longitudinal axis of the shaft 1216 as shown by arc 1250 (FIG. 13).

Figure 16:
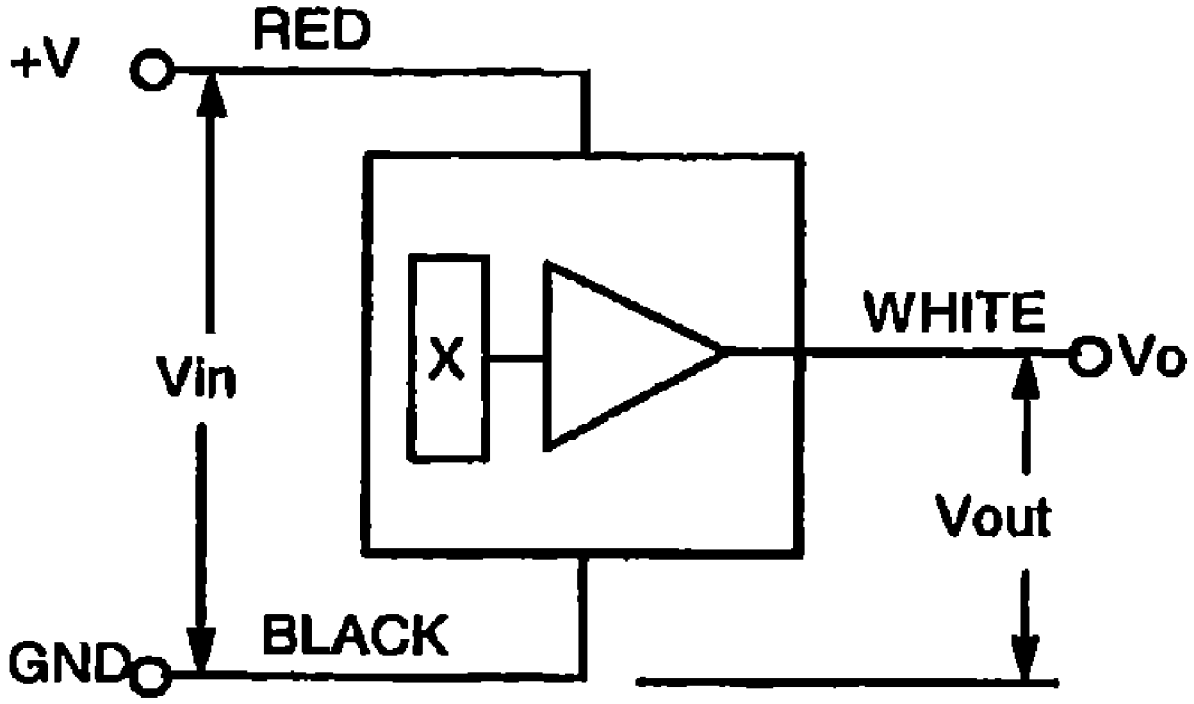
FIG. 16 is an equivalent electric circuit for the shaft position determining function of the sensor unit of FIG. 12.
Figure 17:
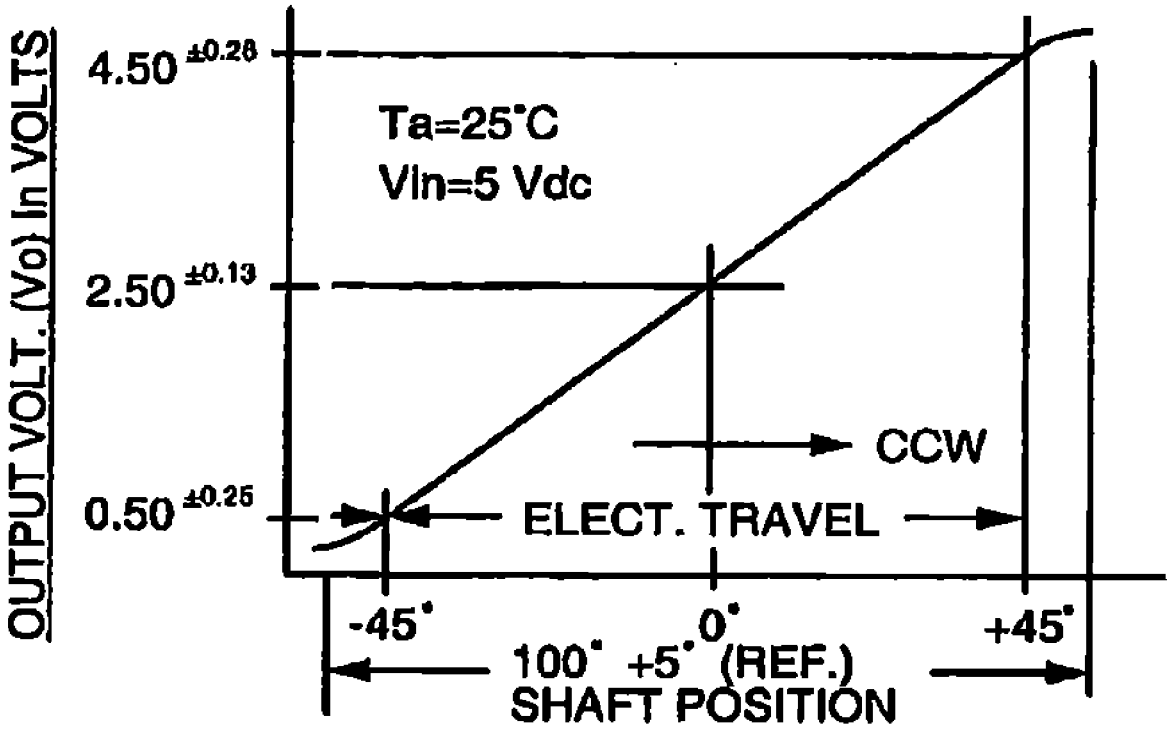
FIG. 17 is a plot of output voltage versus shaft position for the positional sensor of FIG. 12.

Many different techniques can be used to sense the angle of rotation of the arm. Examples include a piezoelectric transducer, optical techniques, potentiometer, rotary variable differential transformers, resolvers, and Hall Effect transducer. In a preferred configuration, the rotational angle is measured by a Hall Effect transducer. An electric circuit equivalent for the sensing unit using a Hall Effect transducer is shown in FIG. 16. A sample plot of output voltage versus shaft position for the circuit of FIG. 16 is shown in FIG. 17.

The sensor 1200 is preferred over conventional linear positional sensors because of the much smaller amount of space required by the sensor 1200. As will be appreciated, the distance of travel required by a linear positional sensor is much greater than that required by a rotational sensor 1200. The gap 1254 between the cylinder 1214 and the bracket 1232 is generally too small for a linear positional sensor.

Fail Safe Hydraulic System

During excavation, it is possible that the machine 100 (FIG. 18) can lose hydraulic pressure (due for example to punctured lines and/or power outages), which could cause retraction of the various cylinders, or be emergency shut down by the pilot, with potentially dire consequences particularly when mining steeply dipping orebodies. The machine 100 can slide or fall away from the excavation face, causing damage not only to itself but also to other equipment and serious injury to mine personnel. It is therefore important to provide a failsafe hydraulic system such that the various positioning actuators remain in position even when hydraulic pressure is lost, thereby locking the machine remains in position.

Figure 18:
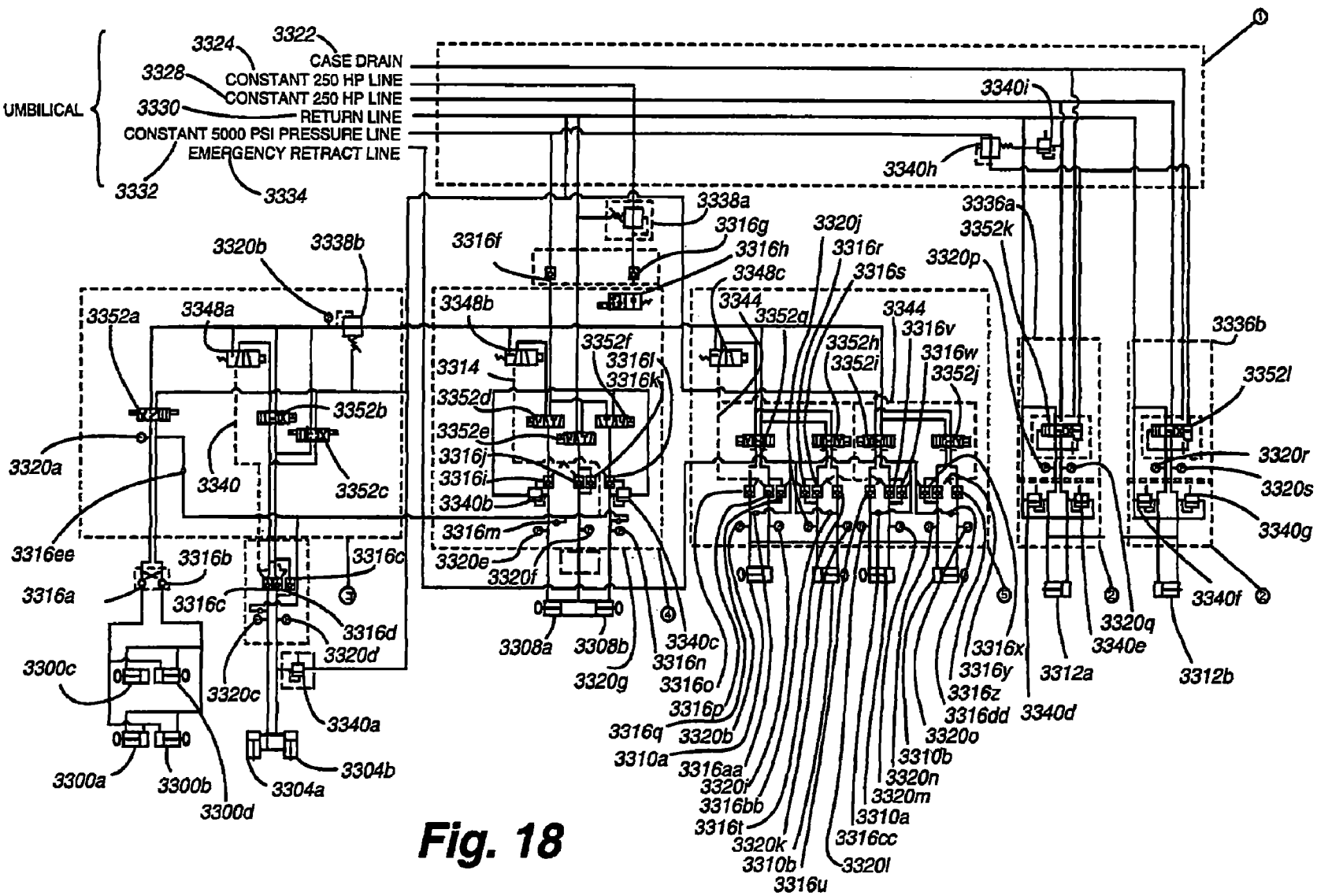
FIG. 18 is a hydraulic circuit for the excavation machine of FIG. 1.

FIG. 18 depicts a hydraulic system that accomplishes these objectives. In the figure, the system comprises the dual hydraulic cylinder assemblies 3300*a,b* for cutter head gripper 144*a*, the dual hydraulic actuator assemblies 3300*c,d* for cutter head gripper 144*b*, thrust actuators 3304*a,b* positioned inside of thrust cylinder assemblies 164*a,b*, respectively, the dual hydraulic actuator assemblies 3308*a,b* in the main gripper 200, the dual hydraulic actuator assemblies 3310*a-d* and in the left and right rear grippers 204*a-d*, and the actuator assemblies 3312*a,b* in the swing actuators 188*a,b*. A plurality of check valves 3316*a-ee* and pressure sensors 3320*a-s* are in communication with the hydraulic supply lines 3324, 3328, and 3332 to these hydraulically actuated components. Return line 3330 is in communication with a plurality of pilot-operated check valves 3316*h*, 3316*i*, 3316*j*, 3316*l*, 3316*o*, 3316*p*, 3316*q*, 3316*r*, 3316*s*, 3316*t*, 3316*u*, 3316*v*, 3316*w*, 3316*x*, 3316*y*, and 3316*z* to permit the various hydraulic cavities (defined above with reference to the first, second, and third interfaces in the various hydraulic actuators) to be drained when the check valves are shut. Case drain line 3322 drains hydraulic fluid that leaks out of the swing manifolds 3336*a,b* on the swing actuators 188*a,b*. The system further includes pressure reducers 3338*a,b*, pressure relief valves 3340*a-i*, rate valves 3352*a-l*, and pilot-operated solenoids 3348*a-c*. The various hydraulic lines 3322, 3324, 3328, 3330, 3332, and 3334 are typically carried in an umbilical (not shown).

Different groups of check valves are shut when either of two emergency events occur. In one emergency event, hydraulic pressure in one or more of lines 3324, 3328, and 3332 drops below predetermined levels. In the case of lines 3324 and 3328, the predetermined level is 2,500 psi, and in the case of line 3332 the predetermined level is 5,000 psi. The loss of hydraulic pressure causes check valve 3316*g* to close in the case of line 3324 and check valves 3316*a, b, e, f, m, n, aa, bb, cc*, and *dd* to close in the case of line 3332 to block drainage of hydraulic fluid from the various cylinders, thereby maintaining the various cylinders in their respective positions. As will be appreciated, the check valves are closed by the reverse fluid pressure imposed by the expanded cylinder. In the other emergency event, a shut off signal is received from the pilot/operator. Dashed lines 3344 denote hydraulic lines in communication with solenoids 3348*a-c*. In the event of a shut off signal, the various solenoids are opened (in the absence of a shut off signal they are closed), causing a loss of hydraulic pressure on the fluid line corresponding to each of the dashed lines. The opening of the solenoid in turn causes the pilot-operated check valve 3316*h* and check valves 3316*c, d, i, j, l*, and *o-z* in communication with each of the solenoids 3348 to close, thereby maintaining the various cylinders in their respective positions.

The emergency retract line 3334 is used to drain the hydraulic fluid in the various cavities in the cylinders (such as the cavities formed between the first, second, and third interfaces), thereby permitting the cylinders to be retracted. In operation, a hydraulic pressure is imposed via retract line 3334, such as using a manual or electrically powered pump. Sufficient pressure is exerted via the retract line 3334 to open check valve 3316*ee* and overcome the reverse pressure applied against each check valve by the corresponding cylinder. When sufficient pressure is applied, the corresponding check valve opens and the hydraulic fluid drains from the corresponding cylinder, causing retraction of the cylinder.

Swing Load Sensor

In sweeps of the cutter head along the excavation face, it can be important to maintain a substantially constant cutter head rotational velocity. A controllable variable orifice valve, typically a servo valve, has been employed to maintain such a constant rotational velocity. As will be appreciated, the servo valve operates by altering, on a semi-continuous or continuous basis, the rate of hydraulic fluid flow into the swing actuator and a differential pressure across the swing actuator in response to a constantly changing load on the cutter head as the cutter head sweeps along the excavation face. A problem with using the servo valve as the sole mechanism for controlling boom rotational velocity is that the pressure drop across the valve semi-continuously or continuously changes, which generates heat. The generated heat can lead to overheating of the hydraulic system.

To overcome this problem, the pressurizing device, which is typically a variable output hydraulic fluid pump, is controlled so as to semi-continuously or continuously vary the hydraulic flow and pressure of the hydraulic fluid provided to the servo valve. The use of the servo valve and the variable output hydraulic fluid pump to collectively control the swing velocity and the swing torque can be highly effective. Pressure lines are utilized to provide semi-continuous or continuous feedback to a controller as to the hydraulic fluid pressure in the swing actuators. The controller is configured to maintain a selected maximum hydraulic fluid pressure outputted from the pressuring device or an outputted hydraulic pressure that is a predetermined amount (e.g., 300 psi) above (or in some configurations below) a measured hydraulic pressure. The controller provides a control signal to the pressurizing device to make the necessary adjustments in the outputted hydraulic fluid pressure to realize the desired pressure level. In this manner, the mining machine of the present invention controls the combination of hydraulic fluid flow rate and the hydraulic fluid pressure to maintain a relatively constant boom rotational velocity.

In a preferred embodiment, the hydraulic fluid pressure is measured at each end of each of the swing actuators (using a total of four hydraulic pressure feedback lines with one line corresponding to each end of each of the actuators). At a selected time or sampling interval, the controller selects the highest measured hydraulic fluid pressure from among the four measurements and forwards a control signal to the controller to provide a hydraulic pressure outputted from the pressuring device that is a selected amount above the maximum measured hydraulic fluid pressure.

Vacuum Mucking System

Figure 19:
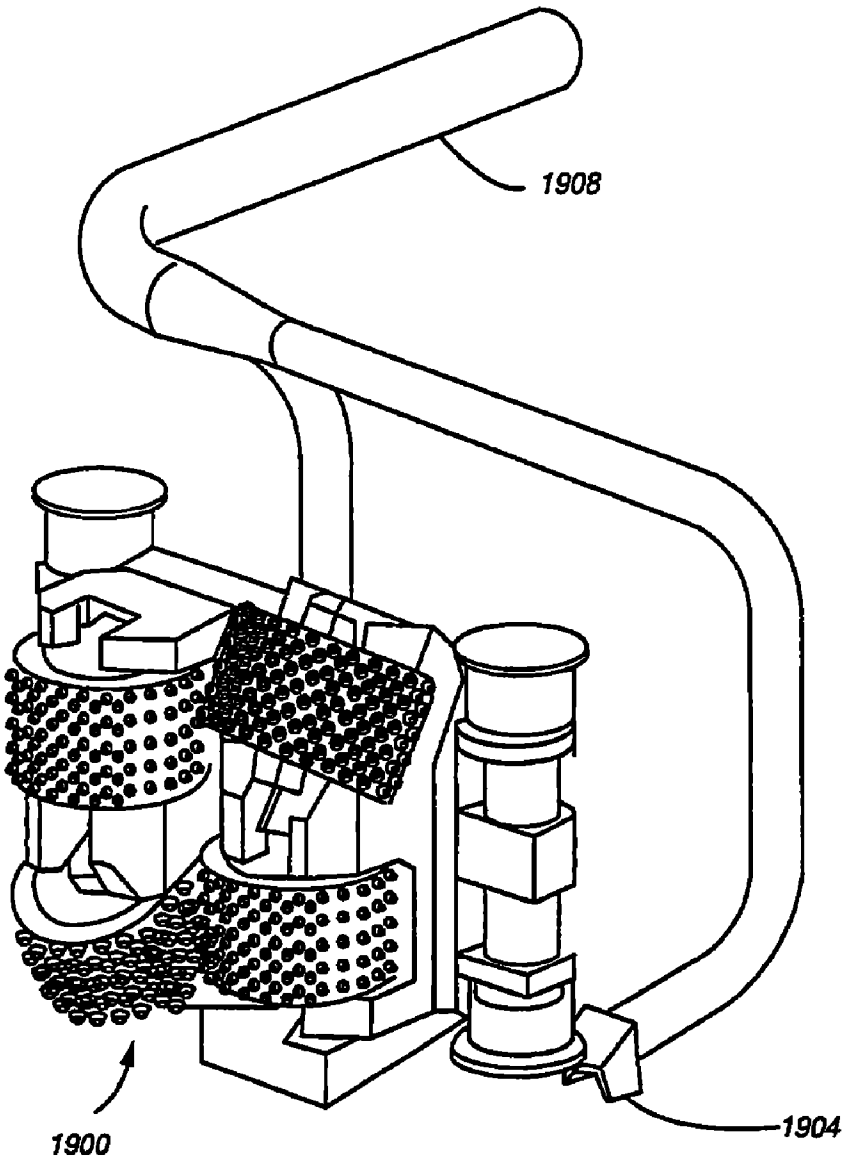
FIG. 19 is a front view of a cutter head incorporating a vacuum mucking system according to another embodiment of the present invention.
Figure 20:
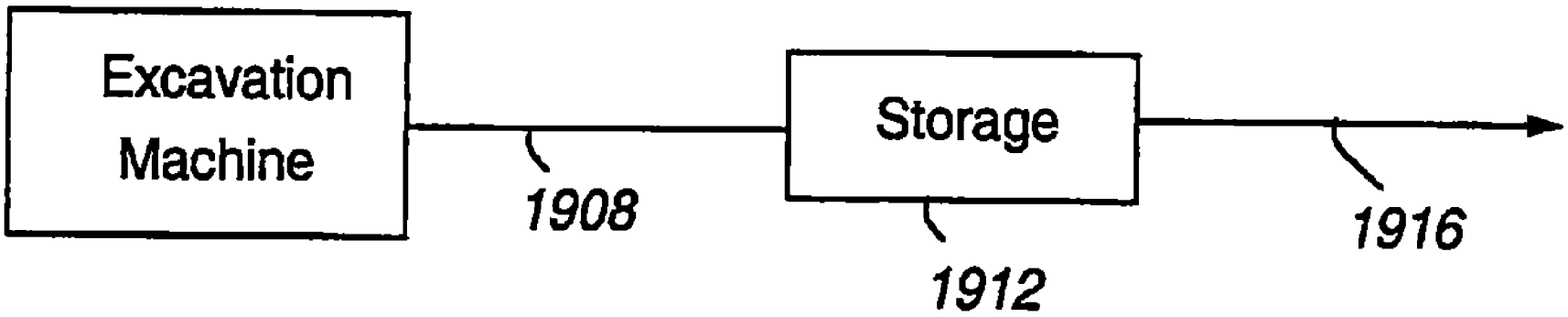
FIG. 20 is a block diagram showing the components of the vacuum mucking system of FIG. 19.

In another machine configuration, a vacuum mucking system is provided for continuous removal of material excavated by the cutter head during rotation of the boom. A cutter head 1900 according to this configuration is shown in FIG. 19. A vacuum nozzle 1904 is positioned on either side of the cutter head 1900 to remove material during forward and reverse strokes of boom. FIG. 20 depicts material handling after introduction into the vacuum nozzle(s). The material passes along main vacuum line 1908 from the excavation machine to materials storage 1912. As will be appreciated, materials storage can be any suitable storage vessel, such as a hopper. The material is removed, periodically or continuously, from the storage unit and transported by other means, such as a conveyor belt 1916, to a material processing or collection facility.

Any vacuum mucking system can be employed. Preferred vacuum mucking systems include HIVAC™ and ULTRA-VAC™ by HiVac Corporation and NEW-VAC™ by New-Vac Mining.

In one configuration, a number of water jets are used, in connection with the vacuum mucking system, to remove cuttings. Inadequate cuttings removal can cause operational inefficiencies in the cutting sequence due to the regrinding of previously generated cuttings. It is therefore important for the cuttings generated during a selected sweep to be removed before the next sweep is performed. In this configuration, a number of nozzles providing the water jets are positioned on the cutter head to spray pressurized water onto the face so as to direct the cuttings towards the input of the vacuum mucking system. The pressure of the water when outputted from the nozzles is preferably at high pressure, typically in the range of about 1,000 to about 10,000 psi. In other configurations in which a vacuum mucking system is not utilized, the nozzles are positioned so as to move the cuttings away from the face and towards a desired collection point.

Umbilical

Figure 21:
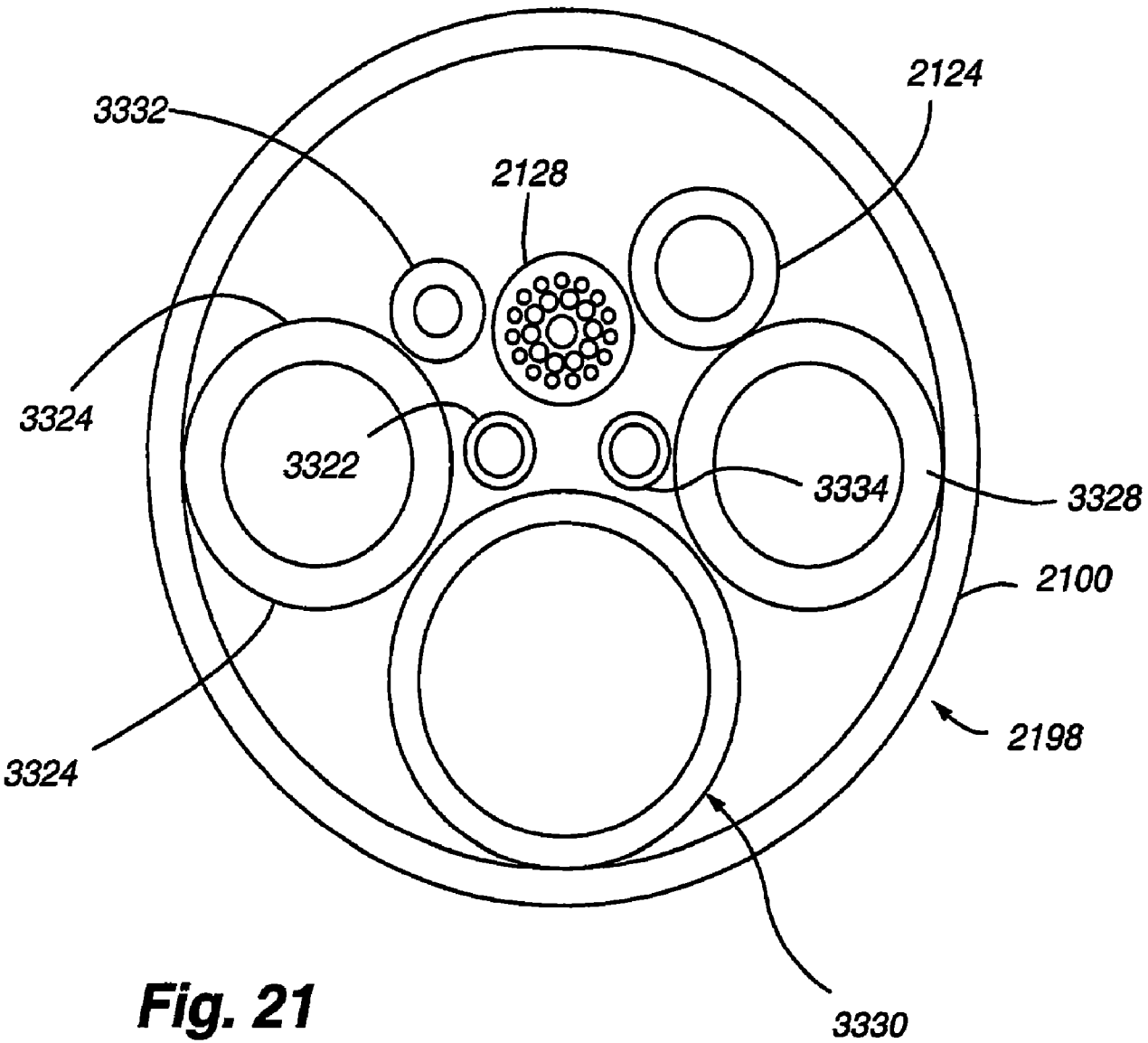
FIG. 21 is a cross-sectional view of an umbilical for the excavator of FIG. 1.
Figure 22:
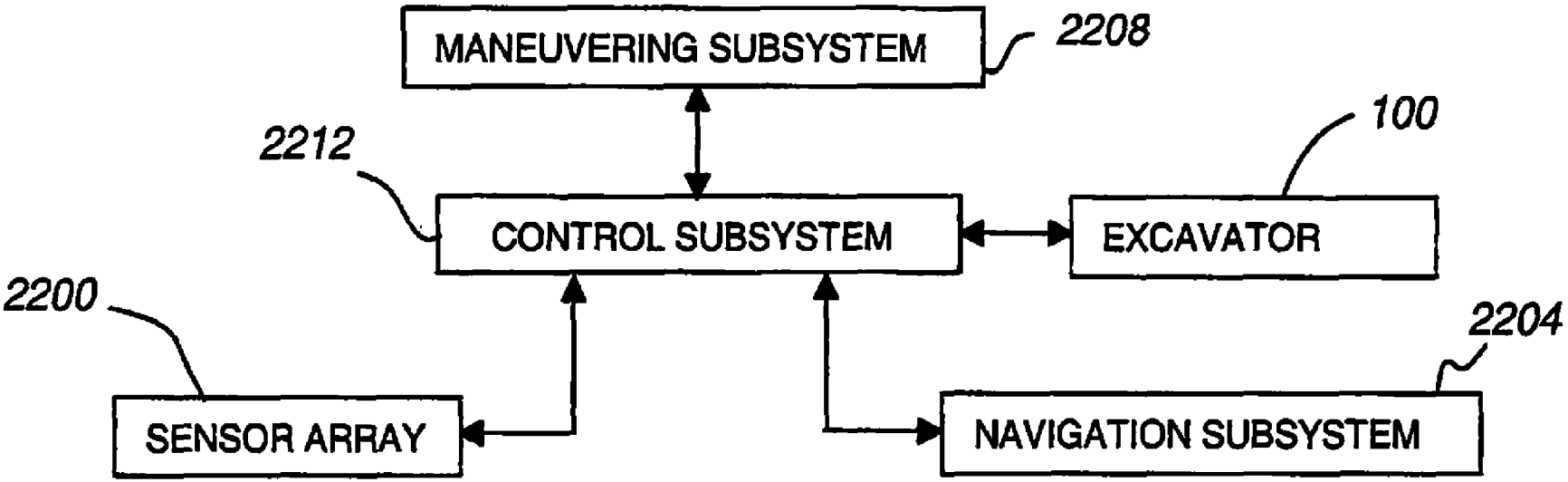
FIG. 22 is a block diagram of the various system components of an embodiment of an automated excavation system according to an embodiment of the present invention.

FIG. 21 depicts an umbilical 2198 that is particularly useful for the excavator of FIG. 1 above. The umbilical 2198 comprises a sheath hose 2100 (which may contain a strengthening component such as woven or braided steel fibers), constant power hydraulic lines 3324 and 3328, a hydraulic return line 3330, an emergency hydraulic retract line 3334, a hydraulic fluid case drain line 3322, a constant pressure hydraulic fluid line 3332, a water hose 2124, and a plurality of electrical power/signal conductors 2128.

Automated Excavation System for Mining Method

The mining method described above can be used with a manned or fully or partly automated excavation system. Due to the relative inaccessibility of the excavator, a fully or partly automated excavation system is preferred. An embodiment of an automated excavation system will now be discussed.

The automated excavation system includes a number of subsystems. Referring to FIGS. 22-25, the system includes not only the excavator 100 to excavate the orebody but also a sensor array 2200 to assist in positioning the excavator 100, a navigation subsystem 2204 to track the position of the excavator 100, a maneuvering subsystem 2208 to maneuver the excavator 100, and a control subsystem 2212 to receive input from sensor array 2200 and the navigation subsystem 2204 and provide appropriate instructions to the maneuvering subsystem 2208, excavator 100, sensor array 2200, and/or navigation subsystem 2204.

The sensor array 2200 and navigation subsystem 2204 are important to the effectiveness of the excavator 100. As will be appreciated, location errors can result in increased dilution and a reduced economic outcome. The systems are capable collectively of defining the position of the excavator 100, whether the excavator's position is relative to a known 3D model (such as the digital map or model discussed below) or to a real time and/or previously sensed vein or structure. The subsystems are preferably at least partially integrated, operate in a complementary manner, and are typically distributed systems, with some components being on the excavator and other components being a remote control station (not shown).

Figure 24:
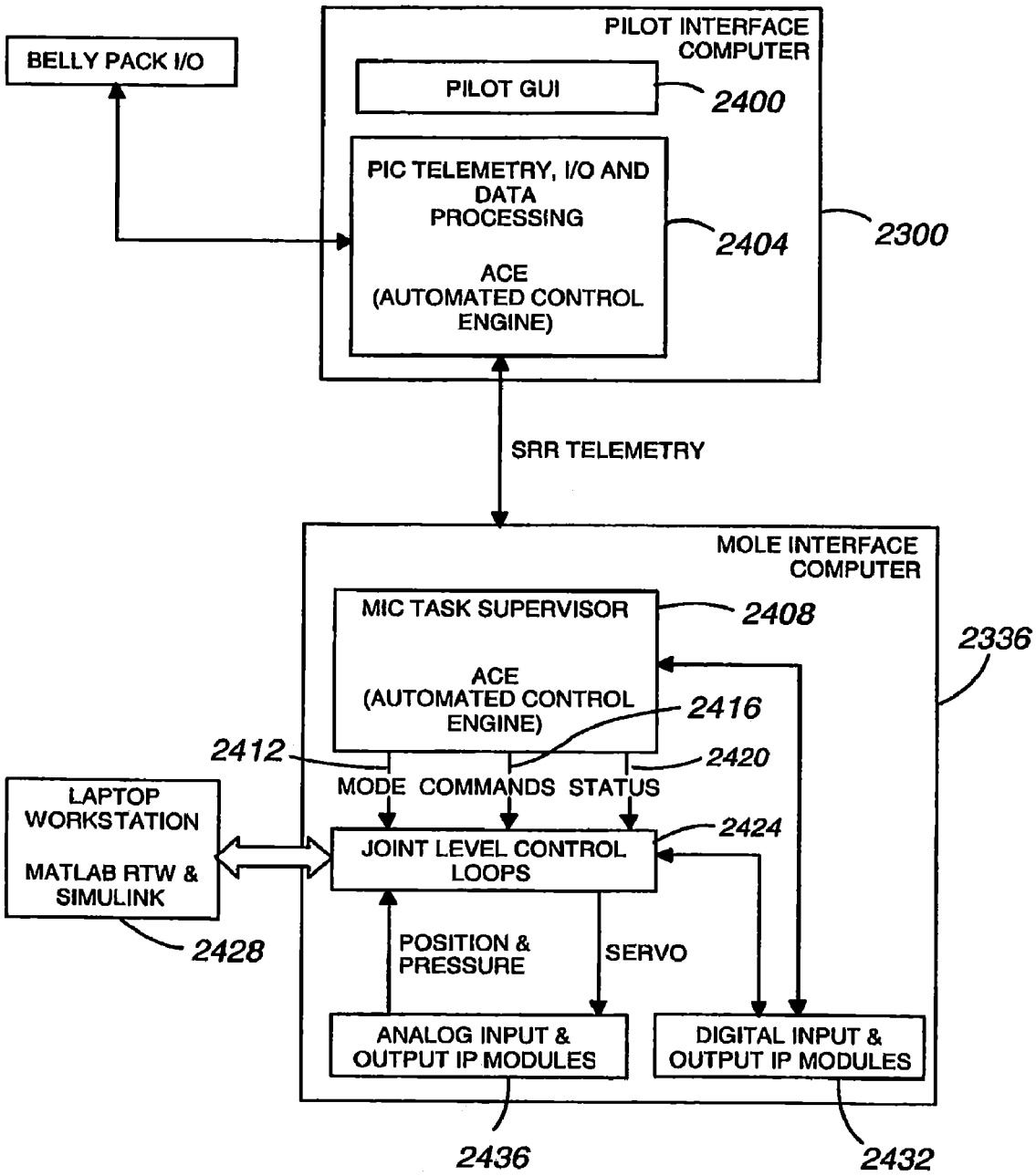
FIG. 24 is a block diagram providing the various states and modes for the excavator of FIG. 1 according to an embodiment of the present invention.
Figure 25:
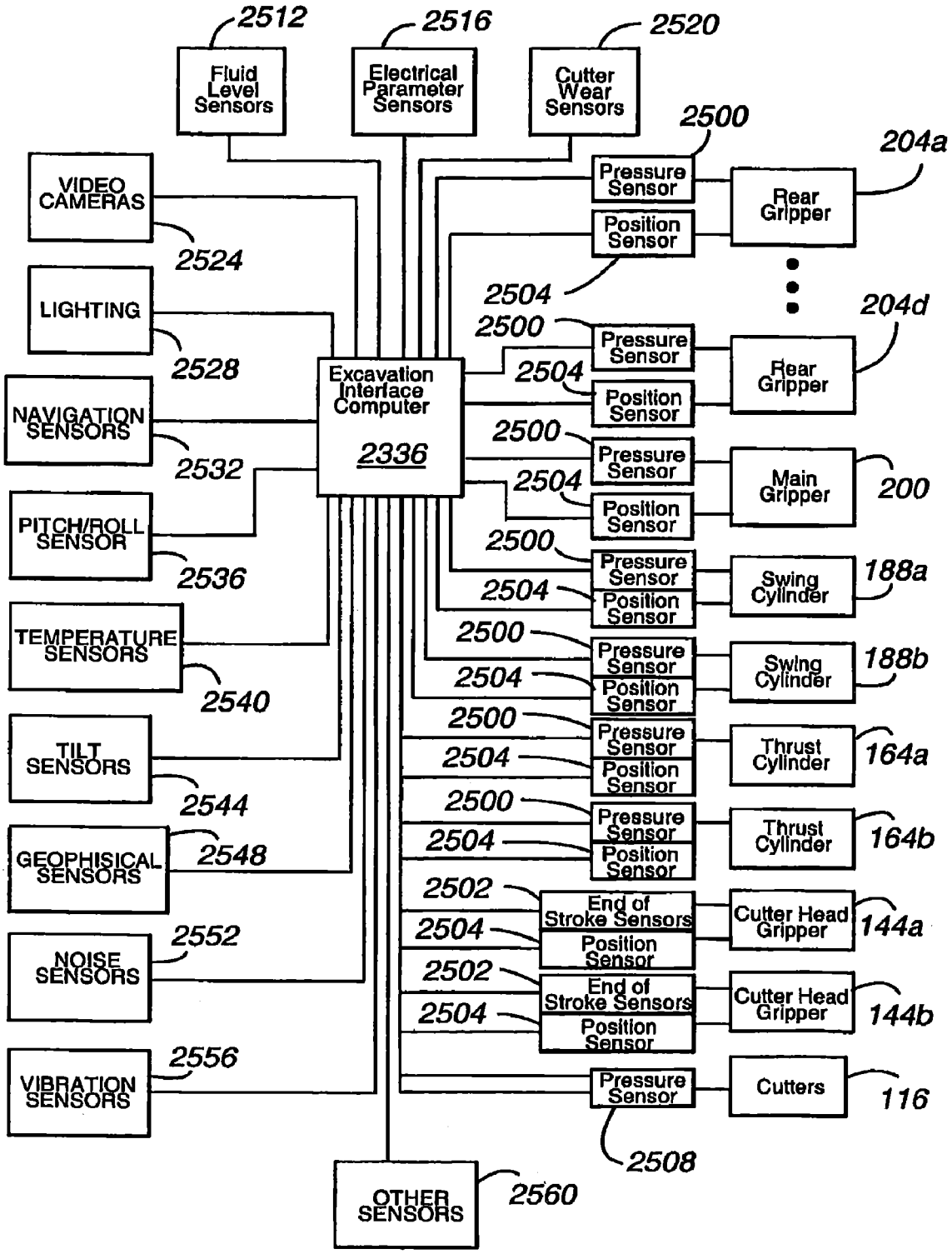
FIG. 25 is a block diagram of the sensor assembly according to an embodiment of the present invention.

FIG. 25 is a block diagram depicting the various sensors in the sensor array 2200. Each of the sensors in the array is in communication with the excavator interface computer 2336 (FIG. 24). Each of the rear grippers 204, the main gripper 200, the swing actuators 188, the thrust actuators 164, and the cutter head grippers 144 operatively engage one or more pressure and/or force sensors 2500 to measure hydraulic fluid pressure in the various cavities of the gripper/cylinder and position sensors 2504 and/or end-of-stroke sensors 2502 to determine the relative linear positions of the telescopically mounted parts of the hydraulic actuator. Using the relative linear positions of the telescopically mounted parts of each of the swing actuators, the rotational angle of the boom relative to a selected axis can be estimated. The pressure and/or force sensors are typically provided on both the extend and retract sides of the hydraulic actuators and can be any suitable fluid pressure sensing device, such as strain gauge or quartz oscillator transducers. The position sensors can be any suitable device for measuring relative displacement of two components, such as the sensor of FIGS. 12-17, end-of-stroke sensors, and transducers. Each actuator typically has one or two position sensors, one or two end-of-stroke sensors or a combination of the two located on the actuator housing. The cutters operatively engage pressure and/or force sensors 2508, such as transducers, to measure the pressure applied against the cutter by the face and therefore by the cutter against the face. The excavator interface computer 2336 is further in communication with one or more fluid (such as oil and hydraulic fluid) level sensors 2512, electrical parameter sensors 2516 (such as voltage and current sensors and electrical discharge sensors), cutter wear sensors 2520, video cameras 2524 (such as conventional, infra-red, and/or ultraviolet cameras), lighting 2528, navigation sensors 2532 (can include position determining components such as GPS sensors, heading sensors (e.g., compasses), electromagnetic transmitters and receivers and triangulation logic, inertial navigation sensors, systems for measuring the distance traveled by the excavator from a fixed reference point, and laser tracking position sensors), pitch/roll sensors 2536 and tilt sensors 2544 (such as inertial sensors, attitude sensors, gyros, accelerometers), temperature sensors 2540, geophysical sensors 2548 (such as directional gamma radiation sensors, x-ray sensors, chemical sensors, and seismo-electric sensors), noise sensors 2552, vibration sensors 2556, and other sensors 2560 (such as sensors to monitor methane concentration, atmospheric particulate levels, humidity, stresses or strains in structural components, and the like).

As will be appreciated, the desired combination of geophysical sensors depends on the rock properties, orebody geometry, and access configuration. It is believed that the highest resolution of orebody geometry will be provided by geophysical sensors using the seismic and radar reflection methods, particularly if parallel access to the vein is possible. Other geophysical sensor technologies that may also be effective include radio imaging and optical techniques.

The navigation subsystem 2204 provides the real-time capability for defining position with respect to a fixed 3D reference (e.g., in geographical coordinates) and/or a geologic feature and following a prescribed trajectory or path. The navigation subsystem 2204 preferably provides in real time the position and/or attitude of the excavator 100 relative to the orebody. The navigation subsystem 2204 uses feedback from the navigational sensors, operator positional input, and a digitally accessed coordinate system such as the static or continuously or semi-continuously updated digital map or model of the orebody; and one or more navigation computational components. The digital map is typically generated by known techniques based on one or more of an orebody survey (performed using diamond core drilling logs, surrounding geologic patterns or trends, previously excavated material, chip samples, and the like). The map typically includes geophysical features, such as target orebody location and rock types (or geologic formations), and excavation features, such as face location, tunnel locations, shaft locations, raise and stope locations, and the like. The map can be updated continuously or semi-continuously using real time geophysical, analytical and/or visual sensing techniques. Examples of digital mapping algorithms that may be used include DATAMINE™ sold by Mineral Industries Computing Ltd. and VULCAN™ sold by Maptek. The navigation computational components can include any of a number of existing off-the-shelf integrated inertial navigation systems, such as the ORE RECOVERY AND TUNNELING AID™ sold by Honeywell, the Kearfott Sea Nav system, and the Novatel BDS Series system.

The maneuvering subsystem 2208 can be any positioning system for the excavator 100 that preferably is remotely operable. The maneuvering subsystem 2208 should be a secure and robust carrier which can steer (tightly) through cutting action in three dimensions and adapt to varying stope widths. Illustrative methods of implementing these capabilities include hydraulic (or pneumatic) cylinders or rams, rotational mounts and extendable arms to enable the excavator to walk, articulated arms capable of allowing the excavator to work in various vein widths and pitches, extendible (or expandable) caterpillar style tracks to maintain contact with the hanging and footwalls, and combinations of these techniques. Typically and as shown by the excavator of FIG. 1, the subsystem 2208 includes a plurality of hydraulically activated cylinders that exert pressure against surrounding rock surfaces to hold the excavator in position and provide suitable forces to exert against cutting device(s) in the excavator.

The control subsystem 2212 typically includes a real time operating system such as QNX™ sold by QNX Software Systems Ltd. or Vxworks from Wind River, a control engine such as SIMULINK REAL TIME WORKSHOP™ sold by The Mathworks Inc. or ACE™ or Automated Control Engine from International Submarine Engineering, to provide suitable control signals to the appropriate components, and application software that can receive information from the sensor array, maneuvering subsystem, navigation subsystem, excavator, and/or operator and convert the information into usable input for the control engine.

Figure 23:
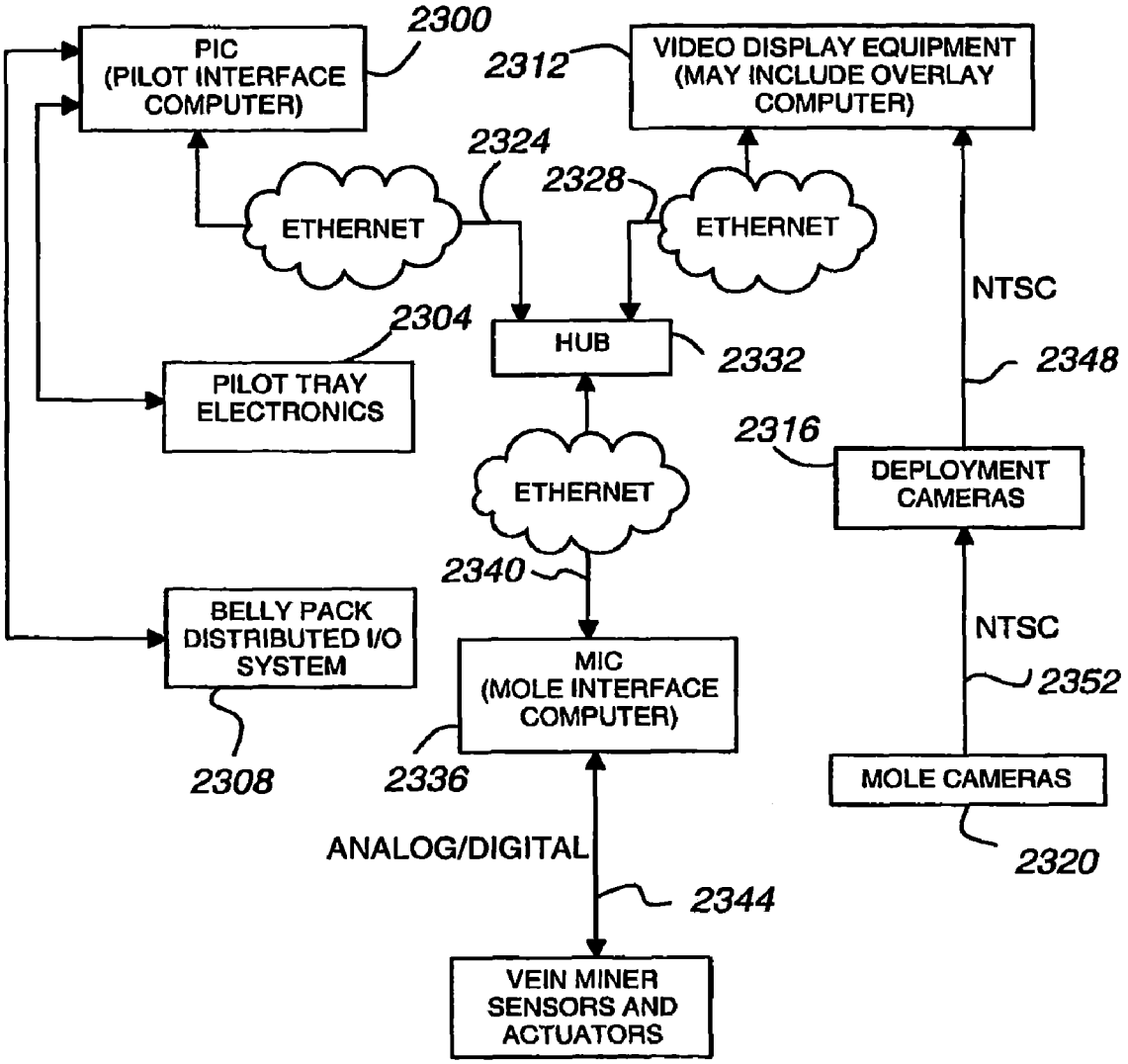
FIG. 23 is a front view of a remote pilot interface according to an embodiment of the present invention.

FIG. 23 depicts an embodiment of a system architecture and FIG. 24 a control architecture according to the present invention. Referring to FIG. 23, the control system components for implementing the various modules comprise a pilot interface computer 2300 interfacing with the pilot tray electronics 2304 and a belly pack distributed input/output system 2308; video display equipment 2312 (which is part of the operator interface and may include an overlay computer) in communication with deployment cameras 2316 and excavator cameras 2320; communication links 2324 and 2328 and communications hub 2332; excavator interface computer 2336 (which is mounted on the excavator as part of reference number 248); and excavator sensors (the sensor array 2200); and cylinders (the cutter head grippers 144, the thrust assemblies 164, the main gripper 200, the swing actuators 188, and the rear (steering) grippers 204). The communications links 2324, 2328, 2340, 2344, 2348, and 2352 among the various components of the control subsystem 2212 are typically provided via wired and/or wireless communication paths. In a preferred embodiment, communications on communication links 2324, 2340, and 2328 are in accordance with the Ethernet protocol and on links 2348 and 2352 with the PAL or NTSC protocol.

FIG. 24 is a block diagram of a control architecture implementing the architecture of FIG. 23. The architecture includes the pilot interface computer 2300 and the excavator interface computer 2336. The pilot interface computer 2300 comprises a pilot Graphical User Interface or GUI 2400 and a functional block 2404 (or task supervisor) providing interfaces and processing for telemetry, data input and output, and a processing engine, such as the Automated Control Engine™. The task supervisor 2404 controls the state of the system based on predetermined rules and policies and operator commands. The input and output of the pilot interface computer (PIC) 2300 is in part output to and input from the belly pack, the pilot console, and the excavator interface computer. The excavator interface computer (EIC) 2336 comprises a task supervisor module 2408 (such as the Automated Control Engine™) to perform sequencing of excavator operational modes and provide commands to perform tasks, such as mode settings 2412, other commands 2416, and status requests 2420, joint level control modules 2424 to execute applications for modes/states invoked by the task supervisor module 2404 (e.g., to perform analog input/output, pressure and position control function), a workstation 2428 to permit personnel to interface with the excavator interface computer 2336, digital signal input and output modules 2432 to receive and transmit digital signals from the task supervisor 2404 and/or joint level control modules 2424 and forward digital signals to the task supervisor and/or joint level control modules, and analog input and output modules 2436 to provide, among other things, cylinder position and pressure signals from position and pressure and/or force sensors 2500 and 2504 and receive digital servo valve command signals which are converted into analog command signals provided to the various servo valves. The pilot interface computer 2300 and excavator computer 2336 communicate with one another by any suitable wired or wireless technique, with digital telemetry being preferred.

Figure 26:
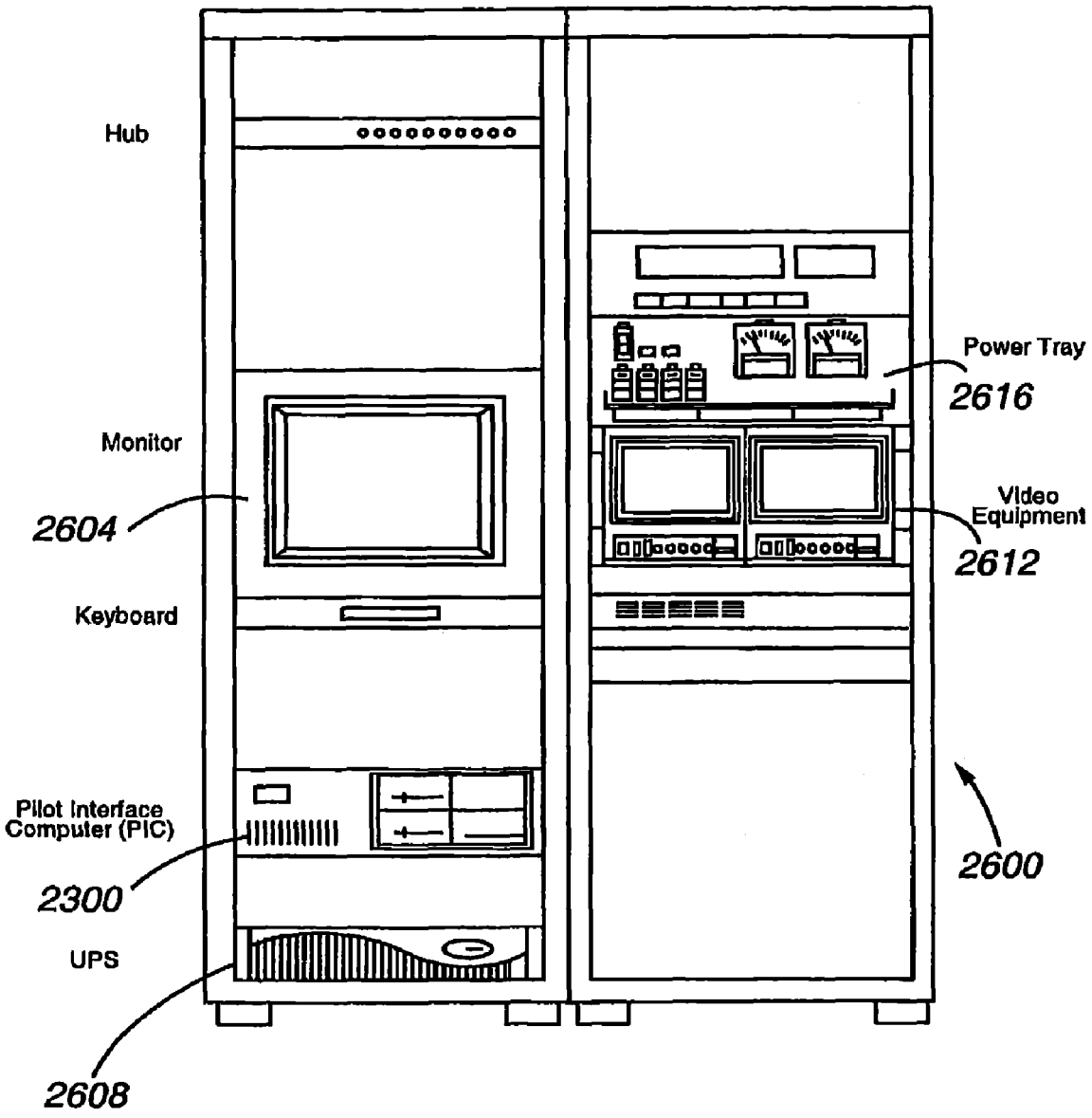
FIG. 26 is a front view of a remote excavator control station according to an embodiment of the present invention.

FIG. 26 depicts a pilot console layout according to a configuration of the present invention. The pilot console layout 2600 is typically located remotely from the excavator 100. The layout 2600 includes one or more monitors 2604 for the operator to display to the operator output from the pilot interface computer 2300, an Uninterruptible Power Supply or UPS 2608, video equipment 2612 to record and display feedback from the deployment and/or excavator cameras, and a power tray 2616 containing assorted components for providing power to the foregoing components and to the EIC and sensors.

Figure 27:
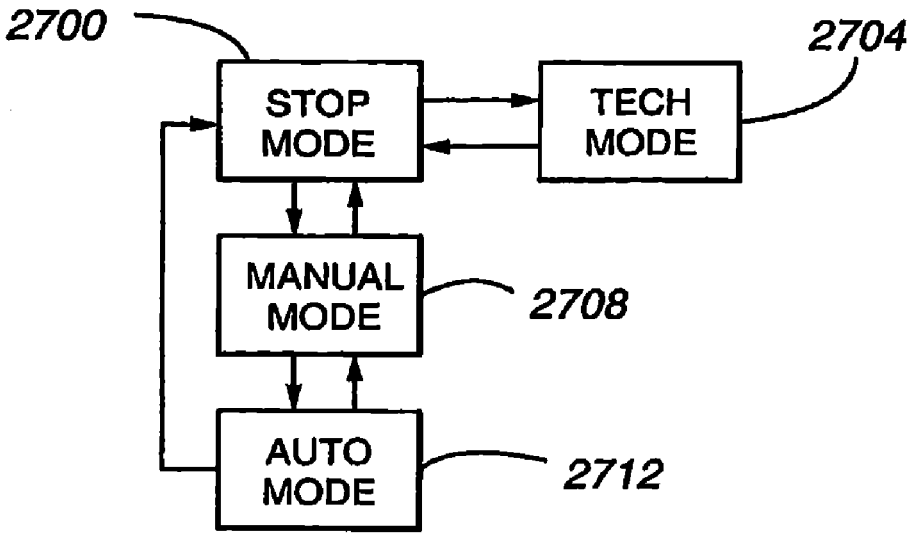
FIG. 27 is a block diagram of the operational modes of the excavator according to an embodiment of the present invention.

The architecture uses various modes and states for excavator operation. With reference to FIG. 27, the overall system at any point in time is in one of four modes, namely a stop mode 2700, a technician or tech mode 2704, a manual mode 2708, and an automated or auto mode 2712. In the stop mode, none of the actuators are enabled. The mode is initiated by system startup, operator command, or automated responses from the system logic, such as in response to an alarm. In the tech mode, low level maintenance, calibration and/or testing is being performed. The mode is invoked only by the operator. In this mode, low-level testing such as open-loop joint control is allowed. In the manual mode, the operator is controlling operation of the excavator. The mode is invoked only by the operator. In this mode, the machine can perform non-autonomous movement. Each movement must be initiated by the operator and can allow mid-level functions such as a single boom sweep. This mode is typically in effect at initial setup of the excavator before commencing the autonomous mode. In the auto mode, intelligent system logic controls wholly or partly excavator operation. The mode is invoked only by the operator. As explained below, the excavator autonomously cycles through mining, walking, and steering sequences or states until stopped by the operator or upon detection of a fault or other type of predetermined condition. Faults include loss of hydraulic pressure, excessive levels of vibration, unacceptable levels of roll, pitch, and/or yaw, system conflicts such as software conflicts and incompatible or unacceptable settings of configurable parameters. Various manually set parameters, such as boom swing span and boom swing rate, are used during the sequences and can be modified during operation. Operator commands can be initiated from the hardware or software interfaces of the EIC or PIC.

Figure 29:
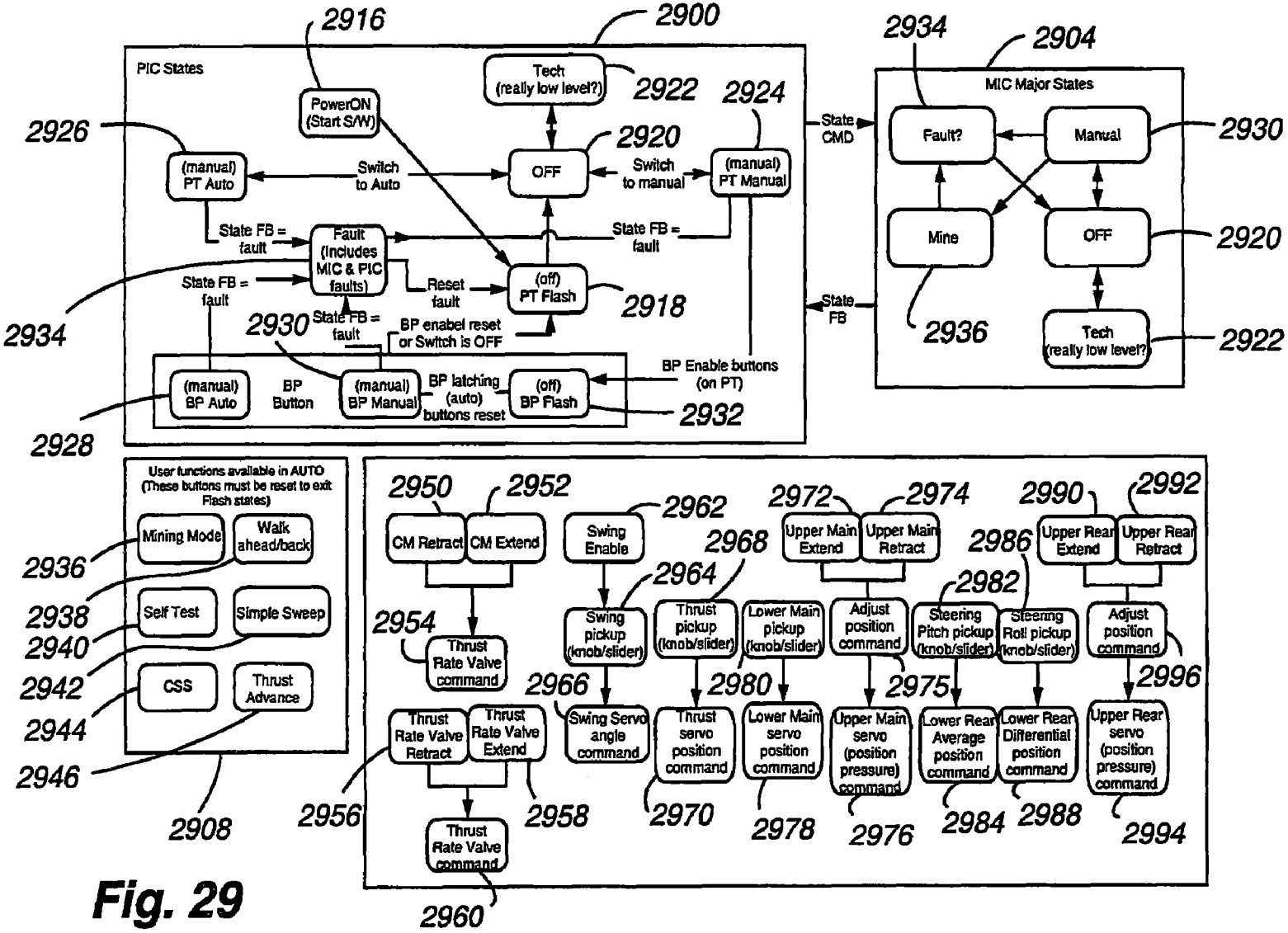
FIG. 29 is a block diagram showing the various operational modes and states of the excavator according to an embodiment of the present invention.

FIG. 29 depicts the various modes and states in which the excavator can be placed. Boxes 2900 and 2904 represent the PIC and EIC, respectively, and boxes 2908 and 2912 the autonomous and manual modes, respectively. In box 2900, the excavator can move between a "power on" or initialization state 2916 to a PIC flash state 2918.

Typical fault response states include ignoring a fault condition, alerting an operator about a fault but taking no other action, disabling automatic control and placing the excavator in a manual control mode, freezing the excavator which prevents the excavator from accepting new commands until the fault condition is acknowledged by the operator, disabling hydraulics and/or disabling hydraulic power to the excavator to place the excavator into the fail-safe hydraulic configuration discussed above, and emergency stop in which both hydraulic and electric power are shut off to the machine. Combinations of these states can be used in the excavation for differing types and severities of faults.

The flash state is typically used to synchronize transfer of control between the excavator computer and the pilot computer on the console. Once control is transferred, the transferee (whether the excavator computer or the pilot computer) is put into a flash state until it has disabled all commands to the excavator. When all of the commands to the excavator have been disabled, the transfer of control is completed, and the transferee is thereafter allowed to output new commands to the excavator.

Returning again to FIG. 29, from the PIC flash state the excavator proceeds to the off mode 2920. From the off mode, the excavator can be switched to the tech mode 2922, the manual mode 2924, or the auto mode 2925. From the manual mode or auto mode, the excavator 100 can be switched to any one of a EIC auto mode 2928, EIC manual mode 2930, or EIC flash state 2932 by enabling the EIC and back to a PIC mode by disabling the EIC. When a state fault occurs, the excavator is switched from the manual mode or auto mode to the fault state 2934. A fault includes either a PIC or EIC detected fault.

Figure 28:
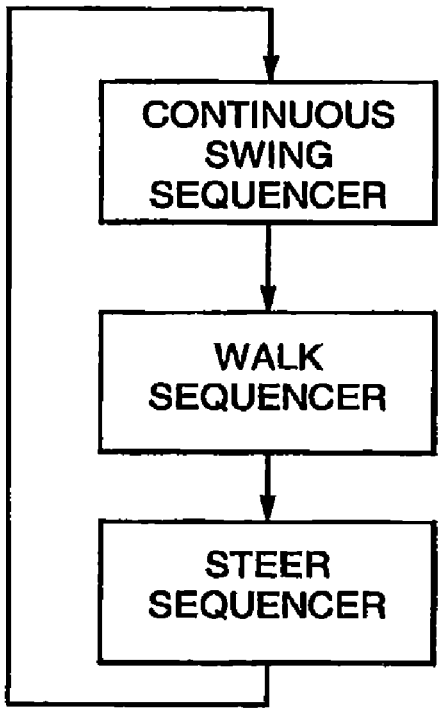
FIG. 28 is a block diagram of the sequencing modules according to an embodiment of the present invention.

In box 2908, user states available in the auto mode 2928 include a mining state 2936, a walk (forwards or backwards) state 2938, a self test state 2940, a single boom sweep state 2942, a continuous boom sweep state 2944, and a thrust (cylinder) advance state 2946. As shown in FIG. 28 in the mining state, the excavator cyclically performs a continuous swing sequence 2800, a walk forward sequence 2804, and a steering sequence 2808 until the mining state is disabled by the operator or by the occurrence of a fault.

In box 2904, the EIC can be in any one of the fault state 2934, the manual state 2930, the mine state 2936, the off state 2920, or the tech state 2922.

In box 2912, user functions available in the manual mode 2708 include cutter head gripper retract 2950 and cutter head gripper extend 2952 using a thrust rate valve command 2954, thrust rate valve retract 2956 and thrust rate valve extend 2958 using a thrust rate valve command 2960, swing (actuator) enable 2962 and swing (actuator) pickup 2964 using a swing servo angle command 2966, thrust (actuator) pickup 2968 using a thrust servo position command 2970, lower main (gripper) pickup 2980 using a lower main servo position command 2978, upper main (gripper) extend 2972 and upper main (gripper) retract 2974 using an adjust position command 2975 and an upper main servo (position/pressure) command 2976, steering pitch pickup 2982 using a lower rear (gripper) average position command 2984, a steering roll pickup 2986 using a lower rear (gripper) differential position command 2988, and an upper rear (gripper) extend 2990 and an upper rear (gripper) retract 2992 using an adjust position command 2996 and an upper rear servo (position/pressure) command 2994.

To implement the various commands, the hydraulic actuators require different control functions to achieve desired behavior at different times in the mining and walking/steering sequences. These functions are: (a) pressure/force control function in which a single cylinder or pair of cylinders are controlled to provide an at least substantially constant external force or gripping force against an adjacent surface(s) with the relative position(s) of the shoe(s) being changeable; (b) position control function in which a single cylinder is controlled to remain at least substantially in a desired position relative to a defined reference point with the pressure exerted by the cylinder against an adjacent surface being changeable; (c) a differential position control function in which a pair of cylinders are controlled to maintain at least a substantially constant desired ratio between their respective positions, e.g., retract the lower rear gripper cylinder and extend the upper rear gripper cylinder while maintaining contact with the hanging wall and footwall with the pressure exerted by either cylinder against an adjacent surface being changeable; (d) combinations of pressure control function with position and/or differential position control function(s) (such that the exerted pressure and the position and/or differential positions (e.g., the body of the two opposing cylinders are positioned with respect to the center of the two gripper positions, remain at least substantially constant), possibly using an impedance control technique; and (e) for the swing actuators, a cooperating position/pressure control function. In the impedance control technique, the mass, stiffness, and damping of the controlled system are settable by the operator.

The implementation of the various functions will now be illustrated with reference to FIGS. 30 and 31.

Figure 30:
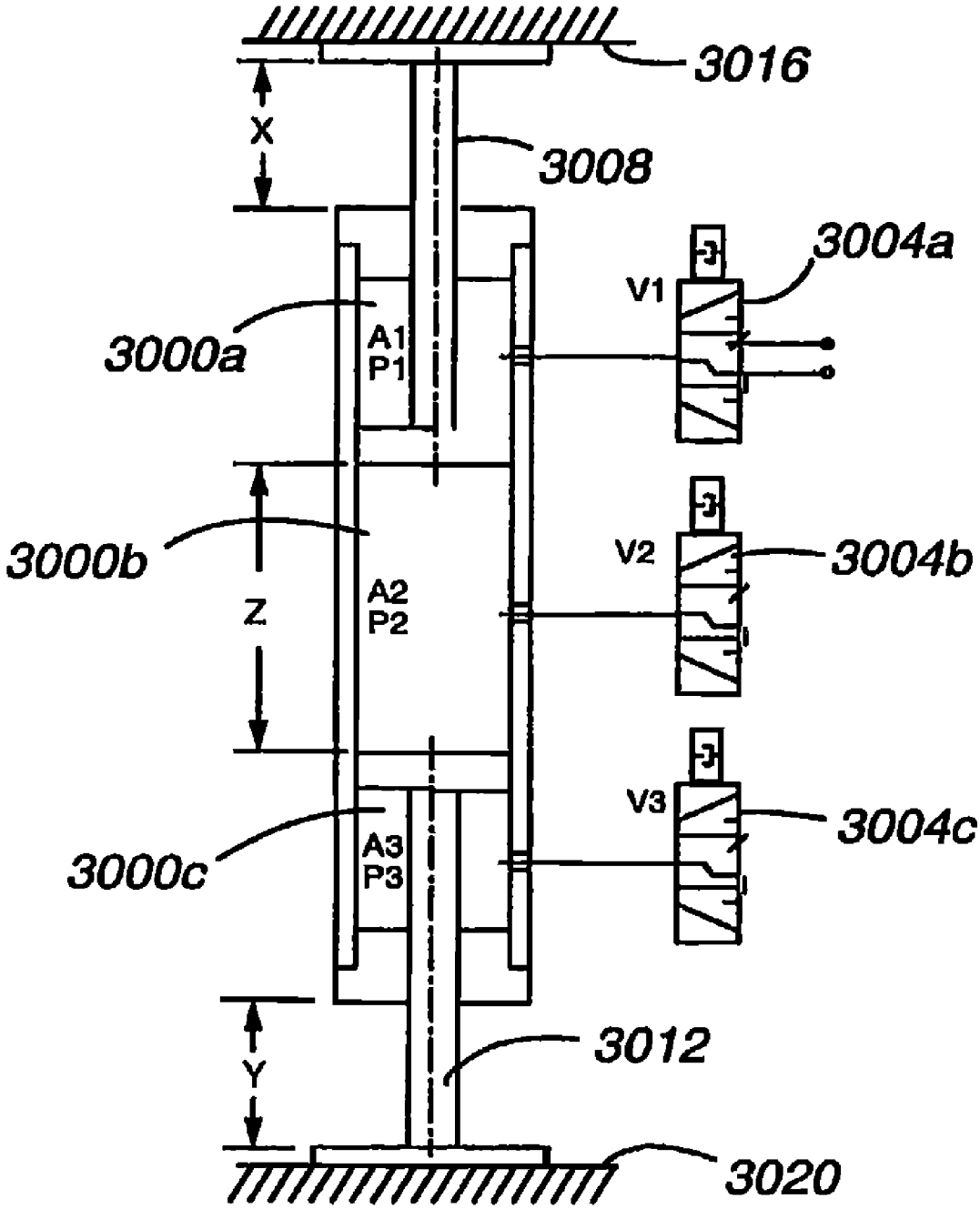
FIG. 30 is a cross-sectional side view of the main gripper assembly.

FIG. 30 depicts the main gripper 200, which has three chambers 3000*a-c*, each of which is in communication with one of the three variable orifice valves, depicted as servo valves 3004*a-c*, controlled respectively by voltage commands V1, V2, and V3. The valves independently and respectively control pressures P1, P2, and P3. By varying the relative pressures, the positions X and Y of the gripper shoes 208 and 212 can be independently controlled. The position Z is a function of X and Y and therefore is not independently controllable. When the gripper shoes are in contact with the walls, the position Z is fixed; however, at this time the pressure P3 can be increased to full pressure while still allowing independently control of X and Y using V1 and V2. The three chambers 3000*a-c* are each pressure sensed and the two pistons 3008 and 3012 are each position sensed. To change X and Y the volume of hydraulic fluid in the chambers 3000*a* and 3000*b* is altered. For example, to decrease X and increase Y the volume of hydraulic fluid in chamber 3000*a* is decreased. In a pressure control function, the pressures P1, P2, and P3 are maintained equal and constant to maintain a substantially constant pressure against walls 3016 and 3020. In a position control function, the pressures P1, P2, and P3 are varied as necessary to maintain X, Y, and Z substantially constant. When the shoes are in contact with the adjacent walls, the pressure P2 can be increased to full pressure while still allowing independent control of X and Y using V1 and V3. In one configuration, upper chamber 3000*a* is set to a pressure control function and lower chamber 3000*c* to a position or translation control function. Middle chamber 3000*b* is set to full pressure (or a thrust control function) to maintain the gripping face against the adjacent walls. Normally, the middle chamber 3000*b* is set to the pressure control function. The volume of hydraulic fluid in each chamber can be maintained constant by activating operator-controlled check valves.

In one configuration, the main gripper control architecture includes three control layers, namely a chamber pressure control layer, shoe-force-to-pressure command compensation layer, and force/position control layer. The chamber pressure control layer represents the lowest control layer in which there is a dedicated pressure controller for each chamber that receives pressure commands from the next layer of controller, pressure feedback from the three pressure and/or force sensors on each chamber, and supplies a voltage command to the variable orifice valve, which is typically a servo valve, to regulate the flow and pressure in each of the chambers. The shoe-force-to-pressure-command compensation layer represents the next highest control layer. This layer receives desired shoe force commands for each of the main gripper shoes and calculates the optimal pressure commands for each of the three pressure controllers at the lowest layer of the actuator controller. Force/position control is the highest control layer. This layer has three, mutually exclusive actuator modes of operation, namely the position/position actuator mode, the force/position bottom actuator mode, and the force/position top actuator mode. In the position/position operational actuator mode, the variable orifice valves are commanded to place each shoe of the main gripper to a commanded shoe position. In this case, gripping pressure exerted on the hanging wall and foot wall is not controlled but can be determined by a simple computation. In the force/position bottom operational actuator mode, the bottom or lower shoe position is controlled and the gripping force is also controlled. In a confined orebody, the lower shoe will stay at its position setpoint as the top or upper shoe expands to touch the hanging wall. In the force/position top operational actuator mode, the upper shoe position is controlled and the gripping force is also controlled. The upper shoe will stay at its position setpoint as the lower shoe expands to touch the foot wall. In both the force position bottom and force/position top actuator modes, the controller also controls the resultant gripping force.

Figure 31:
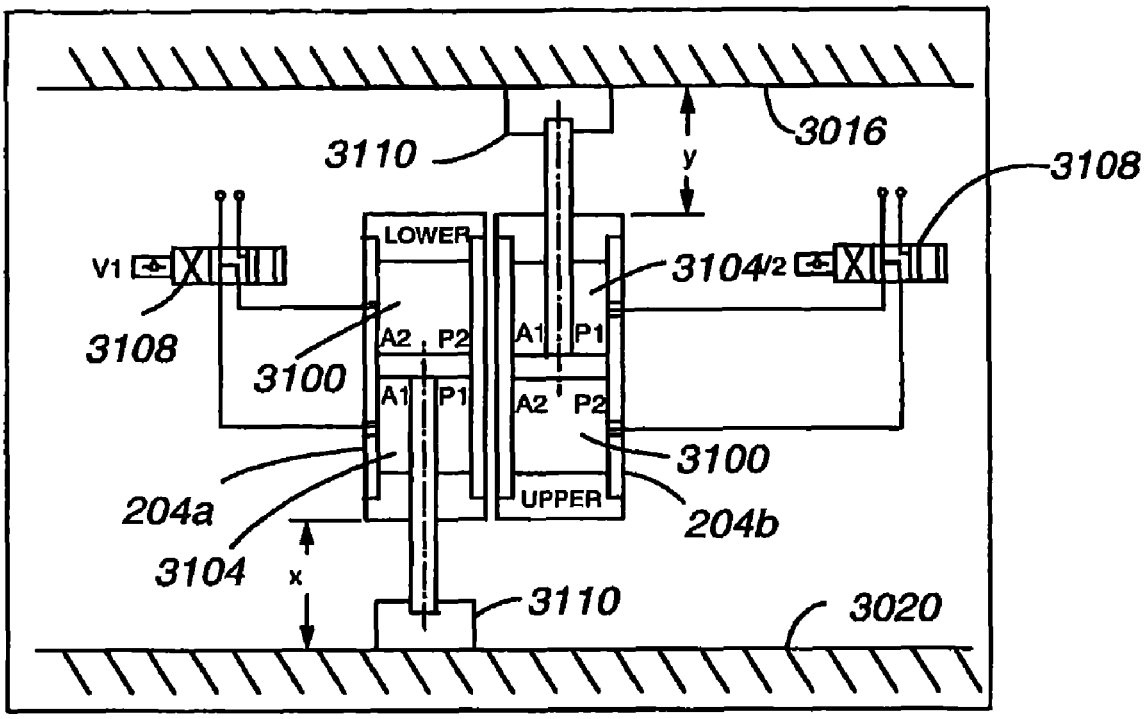
FIG. 31 is a cross-sectional side view of a pair of adjacent rear gripper assemblies.

FIG. 31 depicts an adjacent pair of rear grippers 204*a,b*. Each rear gripper cylinder has two chambers 3100 and 3104 served by a variable orifice valve shown as servo valve 3108. The position of each cylinder is sensed by one or more position sensor(s) and the pressure is sensed on both the input and output ports of each cylinder. When the gripper shoes 3110 are in contact with walls, the pressure P2 in each cylinder can be increased to full pressure while still allowing independent control of X and Y using V1 and V2. The function of each of the grippers is independently settable. Thus, one of the grippers can be in one control function while the other is in another control function. Normally when the main and rear grippers are exerting pressure against the hanging wall and footwall, the lower chamber 3000*c* of the main gripper 200 and the chambers 3104 of the lower left and right rear grippers 204*a,b* are set to a position control function to set the height of the excavator while the upper chamber 3000*a* of the main gripper and the chambers 3100 of the upper left and right rear grippers 204*a,b* are set to the pressure control function to grip against the adjacent walls without affecting the relative position of the excavator.

In one configuration, the rear grippers are actuated in either the pressure control or position control function. The underlying control of each actuator is a pressure controller that controls precisely the hydraulic pressure in each chamber of the actuator. Thus, the position controller generates pressure commands to the pressure controller. Alternatively, a pressure command can be given directly to the underlying pressure controller depending on which actuator mode the controller is set in. Each left and right set of actuators are controlled in conjunction with one another. Thus, the right upper and lower grippers and left upper and lower grippers are controlled in conjunction with one another. The right upper and lower grippers and the left upper and lower grippers are each controlled together as an actuator pair. Each actuator pair can be controlled in one of three actuator modes, namely the position/position, position/pressure, and pressure position actuator modes. In the position/position actuator mode, each upper and lower actuator's position is controlled independently. Position feedback from the cylinders is used in conjunction with a position set point for each cylinder to produce a command signal to each variable orifice control valve. In the position/pressure actuator mode, the lower actuator's position is controlled as well as the gripping pressure. The position of the upper actuator is fed back to the operator for information purposes. In the pressure/position actuator mode, the upper actuator's position is controlled as well as the gripping pressure. The position of the lower actuator is fed back to the operator for information purposes. In both the position/pressure and pressure/position actuator modes, the low-level pressure controllers are used to precisely control the gripper pressure required to grip the rear of the excavator body.

The thrust cylinder assemblies can have several functions, namely a thrust position control function in which, after each cut or rotation of the boom, the thrust assembly advances by a depth of cut selected by the operator, a thrust pressure control function in which a selected thrust pressure is maintained by the thrust actuators against the excavation face during boom rotation, and a thrust lock function in which cylinder ports are closed by operating check valves used in combination with the position control function to set a cut depth.

In one configuration, the thrust actuators have two basic actuator modes of operation, namely precise control and walking control. In the precise control actuator mode, the pressure/force control function and position control function are used. In the walking control actuator mode, a secondary high speed proportional valve (which can be a three position rate valve) operatively connected in parallel with the variable orifice control valve is used to provide high speed extension and retraction of the cutter head during walking operations. The high speed proportional valve alone is used during walking, and the variable orifice control valve alone is used when the cutter head is rotated along the excavation face to effect mining operations.

The swing actuators are also independently controlled by variable orifice valves, which are typically servo valves. Since the cylinders are constrained by the rotating mechanism, the positions of the two cylinders are converted to a swing angle measurement. The position of each cylinder leads to two possible positions for the other cylinder. When one cylinder is close to its minimum extension the other cylinder is used to determine the swing angle. Pressure and/or force sensor readings from pressure and/or force sensors in each chamber of the swing actuators are converted into effective torque on the boom and therefore the cutting force being generated at any point of the swing motion. During rotation, a swing angle controller (not shown) controls the servo valves proportionally to the effective moment arm. The calculated swing angle is used to determine singular regions 1100 and 1104 (FIG. 11). Thus, when one cylinder passes through a corresponding singular region the cylinder's corresponding servo valve is at rest while the other cylinder's servo valve is alone controls the boom torque and position. The swing angle controller is able to convert the swing actuator positions, at a selected point of time, into a swing angle measurement, convert a swing angle measurement into swing actuator positions at the selected point of time, and/or convert a commanded swing torque into corresponding commanded swing actuator pressures.

The various cylinders are lockable via operator controlled check valves. In other words, the hydraulic fluid in each chamber of the cylinder can be maintained constant by enabling appropriate check valves.

The PIC and EIC provides the user with graphical displays (or a GUI interface), text displays, alarm displays, lights, various indicators, graphical inputs, and various actuators, such as buttons, dials, and switches. The GUI's of the PIC and EIC can display all input data acquired on the PIC and EIC and all control data outputs on the EIC and PIC. Excavator control modes (discussed below) are selectable and the current control mode displayed on the GUI's of the EIC and PIC.

FIGS. 32-40 provide illustrative interfaces on the PIC and EIC. The interfaces are preferably a Microsoft Windows™ or other, e.g., QNX Photon™ based system interface with a panel containing various actuators.

Figure 32:
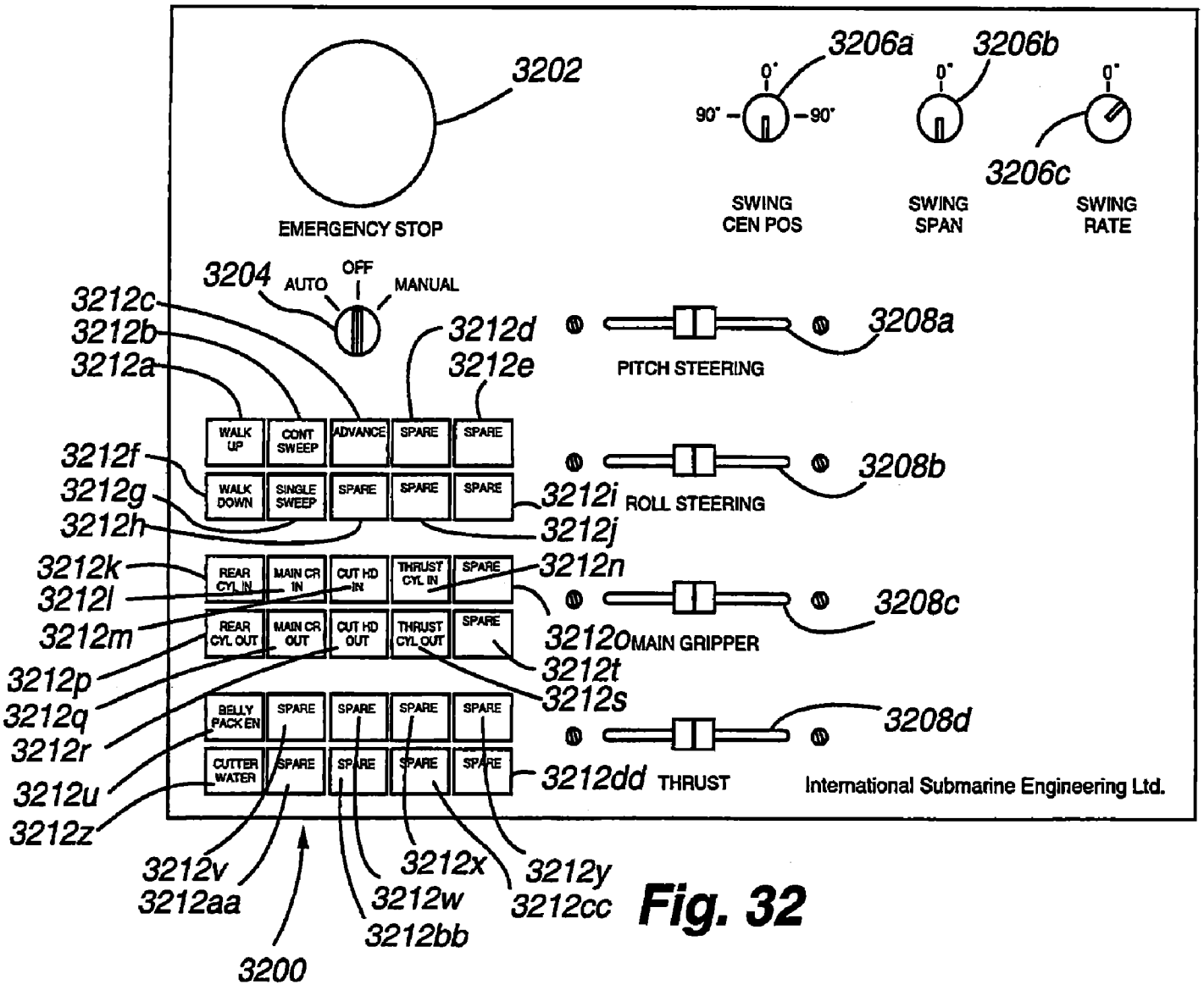
FIG. 32 is a user interface for the excavator according to an embodiment of the present invention.

Referring to FIG. 32, a configuration of the panel portion of the interface is depicted. The interface 3200 provides various actuators, including an emergency stop actuator 3202, a mode setting switch 3204 for selecting between the automatic and manual modes, a "walk up" actuator 3212*a* for invoking the "walk up" function (the logic for walking up grade), a "walk down" actuator 3212*f* for invoking the "walk down" function (the logic for walking down grade), the "continuous sweep" actuator 3212*b* for invoking the "continuous sweep" function (the logic for continuously sweeping or rotating the cutter head 104 back and forth across the excavation face), the "single sweep" actuator 3212*g* for invoking the "single sweep" function (the logic for effecting a single sweep of the cutter head across the excavation face), the "advance" actuator 3212*c* for automatically advancing the thrust actuators 164 by a selected or predetermined distance, a "rear cyl in" actuator 3212*k* to manually retract the rear grippers 204, a "rear cyl out" actuator 3212*p* to manually extend the rear grippers 204, the "main gr in" actuator 3212*l* to manually retract the main gripper 200, the "main gr out" actuator 3212*q* to manually extend the main gripper 200, the "cut hd in" actuator 3212*m* to manually retract the cutter head grippers 144, the "cut hd out" actuator 3212*r* to manually extend the cutter head grippers 144, the "thrust cyl in" actuator 3212*n* to manually retract the thrust actuator 164, the "thrust cyl out" actuator 3212*s* to manually extend the thrust actuator, a "cutter head" actuator 3212*z* for turning water to the cutter head 104 on and off, and a "belly pack" actuator 3212*u* for enabling/disabling the interface on the EIC. The interface 3200 further includes adjustable actuators 3206*a*, 3206*b*, 3206*c*, 3208*a*, 3208*b*, 3208*c*, and 3208*d* for setting, respectively, the boom center swing position, the boom swing angle, the rate of boom rotation or "swing rate", pitch steering value, roll steering value, main gripper extension, and thrust actuator extension.

Figure 33:
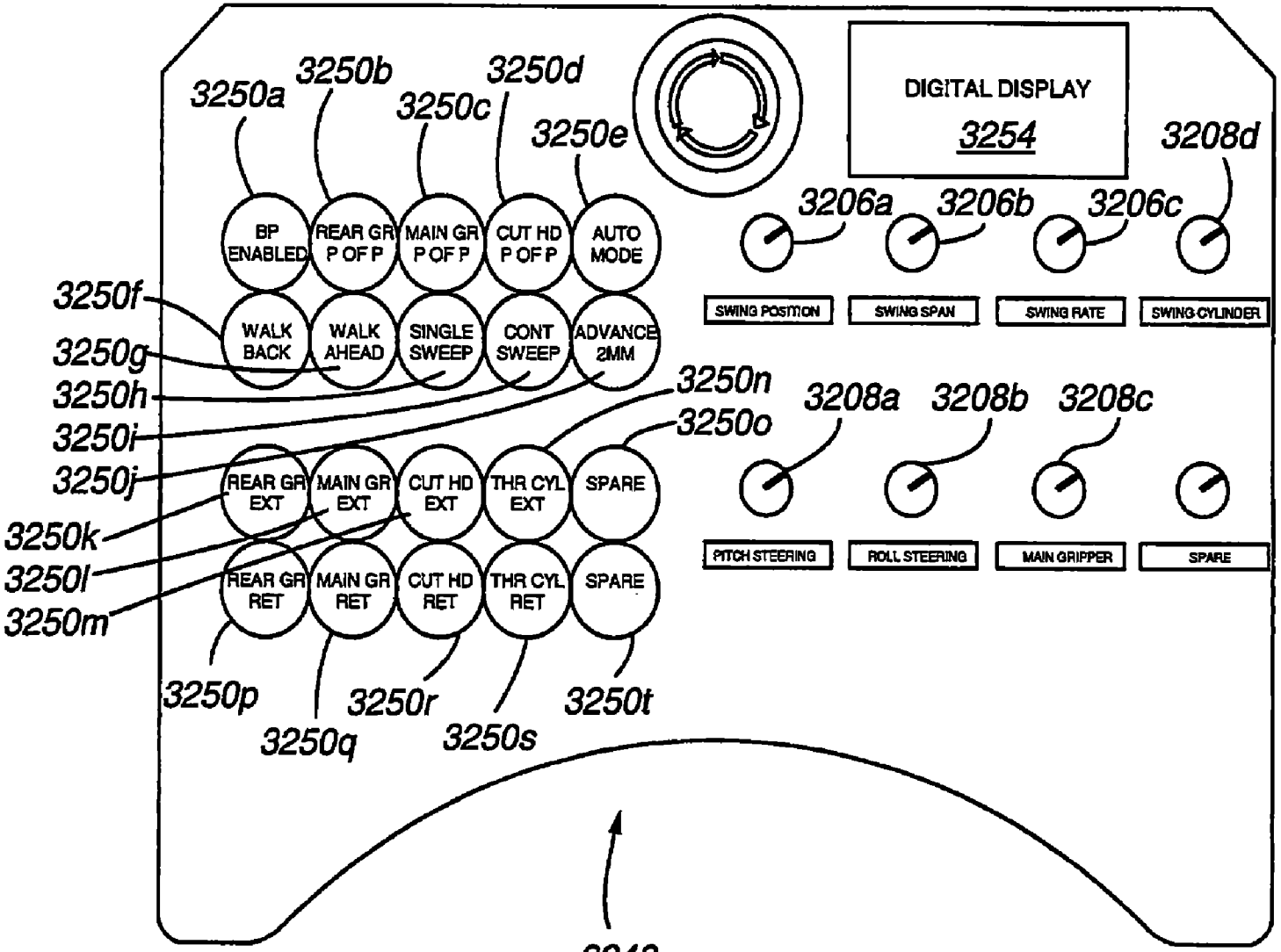
FIG. 33 is a user interface for the excavator according to an embodiment of the present invention.

FIG. 33 depicts a configuration of the panel portion of the interface 3248 on the EIC. As in the case of FIG. 32, the interface includes various actuators 3250*a-t*. Actuators 3250*a* and *e-s* provide the same functionality as a corresponding one of actuators 3212*a-c, f-g, k-m, p-s, u* and *z* in FIG. 32. Additionally, the panel includes a digital display 3254 and a "rear gr P or P" actuator 3250*b*, a "main gr P or P" actuator 3250*c*, a "cut HD P or P" actuator 3250*d* for selecting between pressure and position modes for the corresponding gripper(s).

FIGS. 34-40 depict GUI displays for the PIC and EIC.

Figure 34:
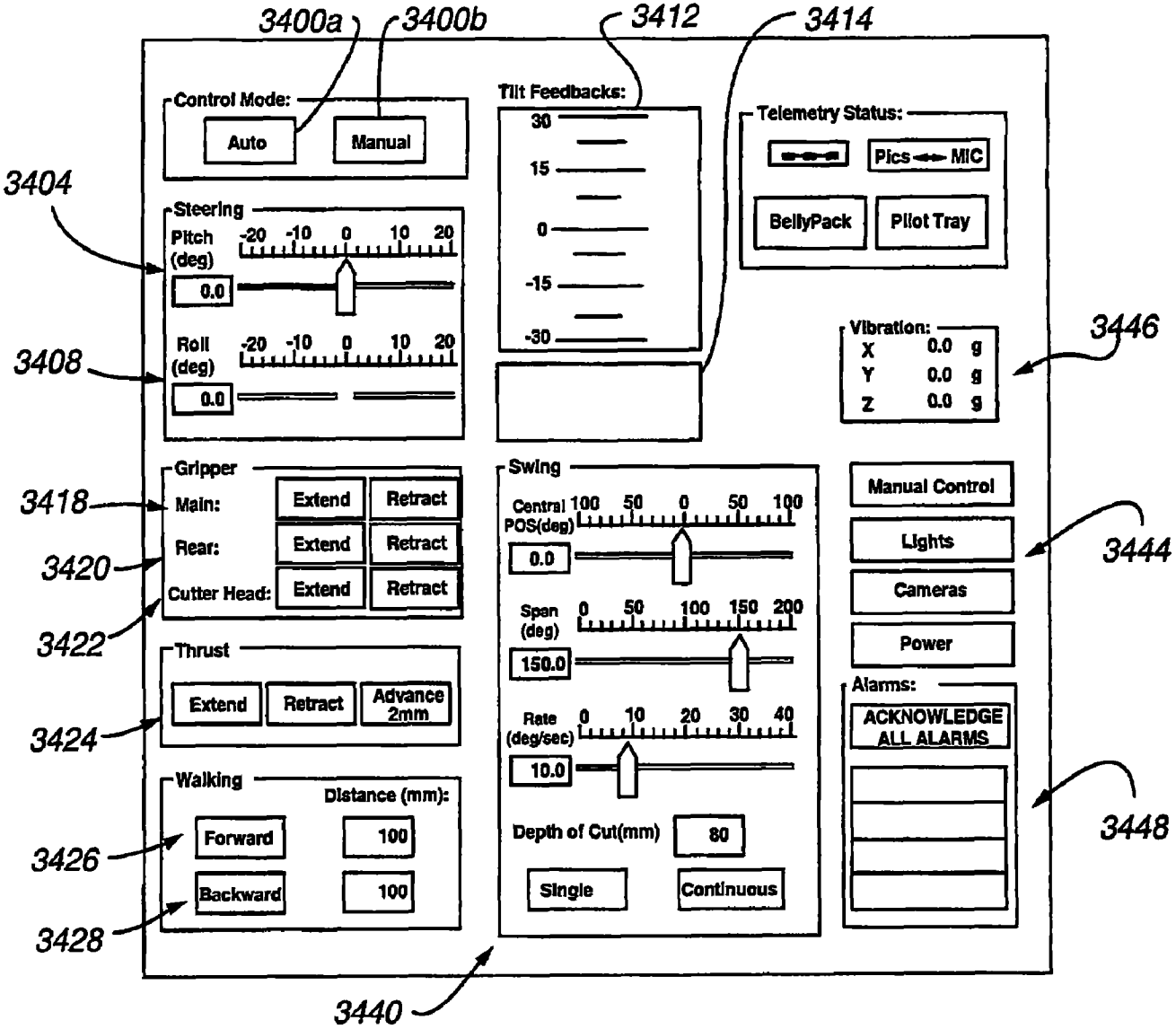
FIG. 34 is a graphical user interface for the excavator according to an embodiment of the present invention.

FIG. 34 is the main or parent display. The display includes fields 34900,*b* to indicate whether the excavator is in automatic or manual modes, pitch and roll indicators 3404 and 3408 and related display fields to provide, respectively, selected values for pitch and roll, display fields 3416 to provide real time values for pitch and roll, gripper display fields 3418, 3420, and 3422 to indicate whether the corresponding gripper is extended or retracted, thrust cylinder or actuator display fields 3424 to indicate whether the thrust actuators are extended or retracted and whether the thrust actuators are to be advanced the selected distance after each swing of the boom, the walking fields 3426 and 3428 which indicate whether the excavator is to walk forwards or backwards and, if so, the distance, tilt feedback field 3412 provides real time feedback on the degree of tilt of the excavator, central field 3440 which indicate the currently selected boom center position, the currently selected boom swing span, the currently selected swing rate, the currently selected depth of cut, the single and continuous fields which indicate whether the boom is to be rotated only once or continuously, and vibration field 3446 which provides the degree of vibration relative to a three-dimensional reference axis system. The various fields can be configured to provide, using a stylus, keyboard, or a touch screen, the ability to select a desired function and change the currently selected values. Fields 3444 provide the user with the ability to select or disable manual control, activate/deactivate lights, activate/deactivate cameras, and activate/deactive power to the excavator. Display field 3448 displays alarms.

Figure 35:
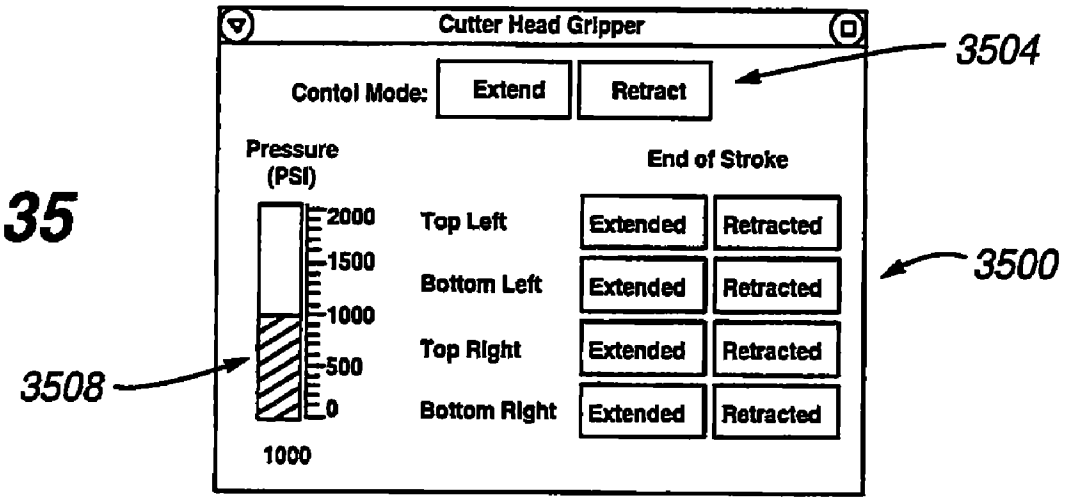
FIG. 35 is a graphical user interface for the excavator according to an embodiment of the present invention.
Figure 36:
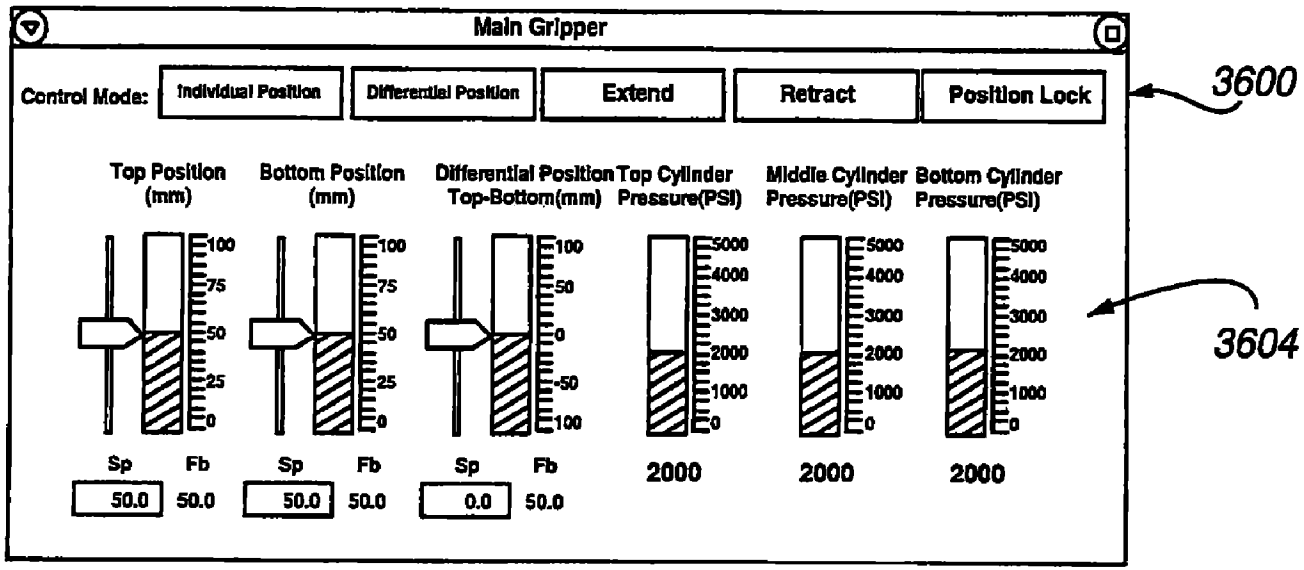
FIG. 36 is a graphical user interface for the excavator according to an embodiment of the present invention.
Figure 37:
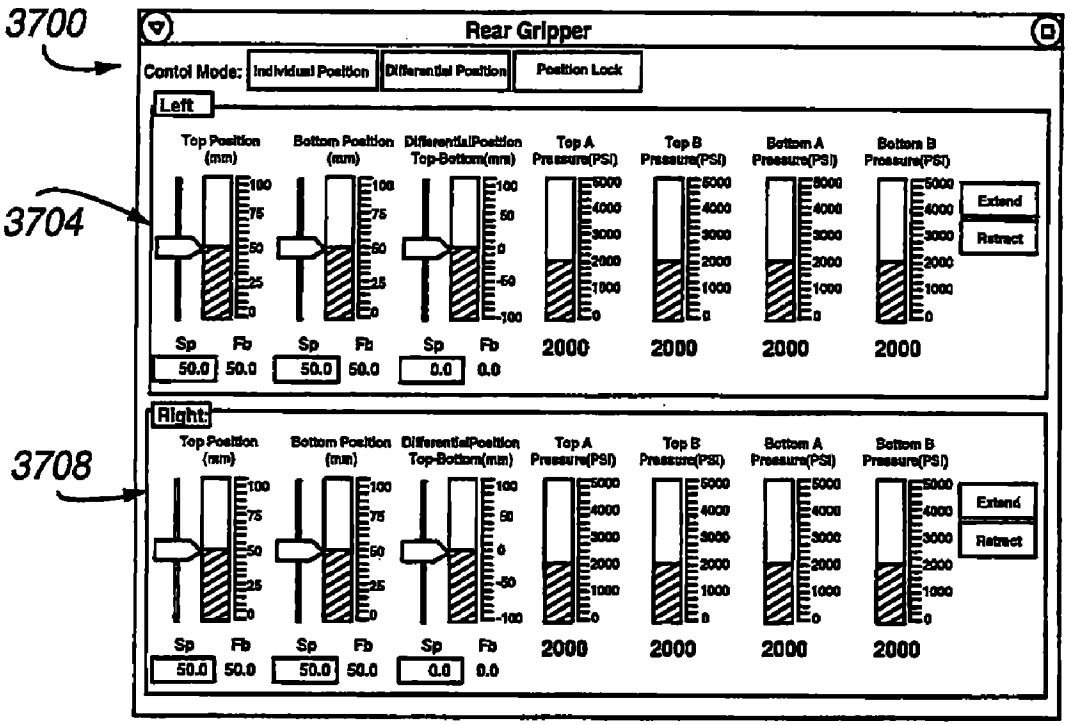
FIG. 37 is a graphical user interface for the excavator according to an embodiment of the present invention.
Figure 38:
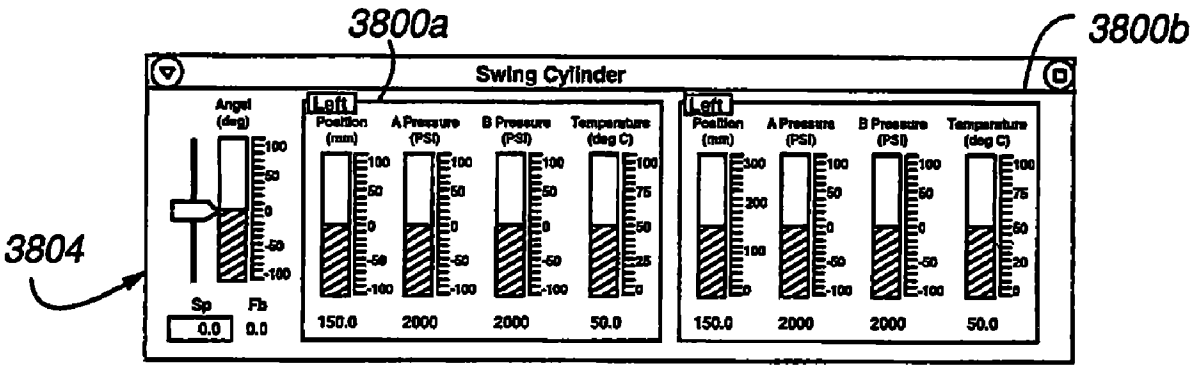
FIG. 38 is a graphical user interface for the excavator according to an embodiment of the present invention.
Figure 39:
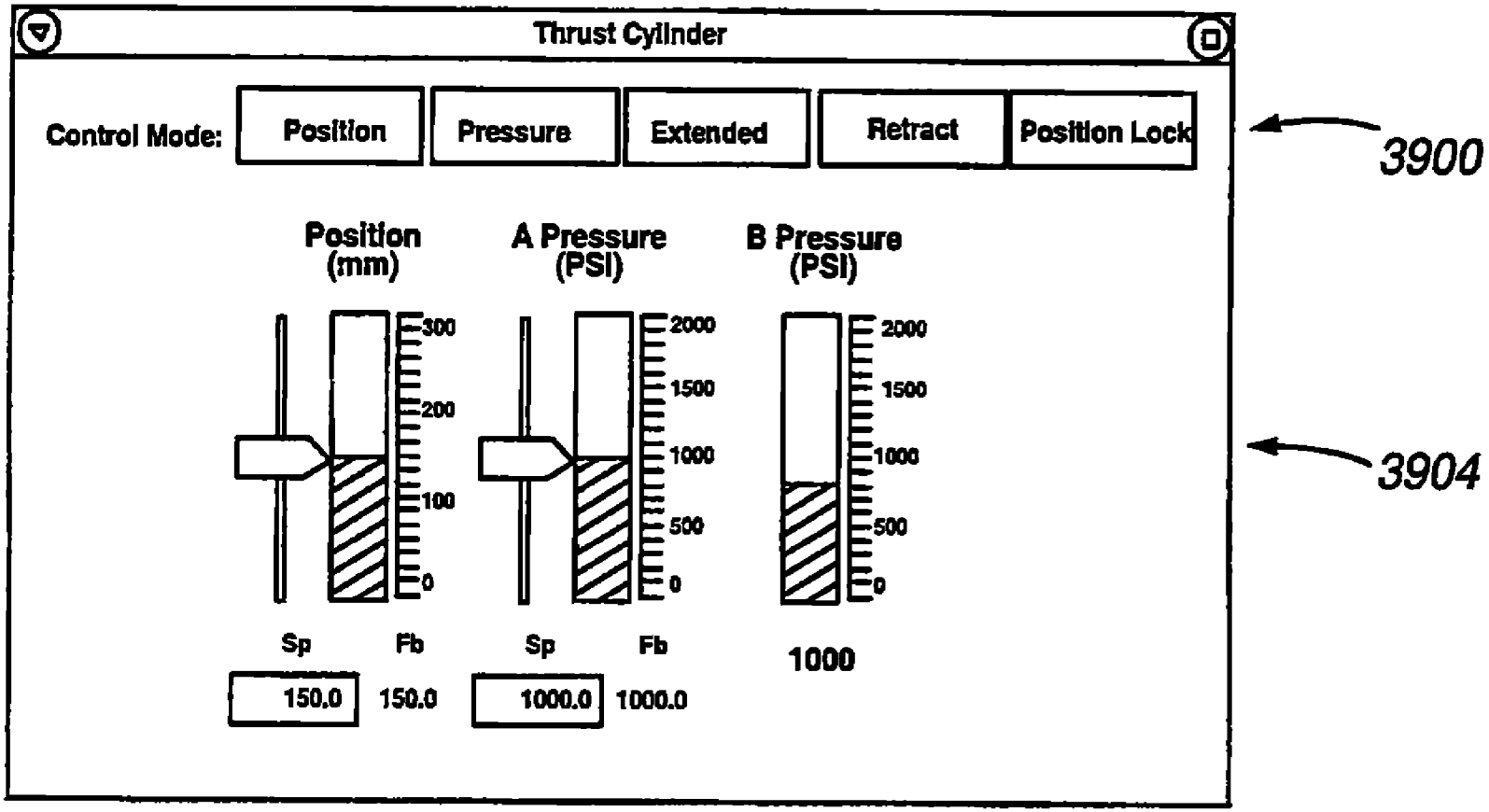
FIG. 39 is a graphical user interface for the excavator according to an embodiment of the present invention.

From the main or parent display, various child displays can be accessed. FIG. 35 corresponds to the cutter head grippers 144*a-b* and includes actuator fields 3504 to extend or retract the grippers and display fields 3500 to provide, for each shoe, whether it is extended or retracted and 3508 to provide the hydraulic pressure in the grippers. FIG. 36 corresponds to the main gripper 200 and provides actuator fields 3600 to select among individual position, differential position, and position lock states and to extend or retract the main gripper and various display fields 3604 to provide information on top shoe position, bottom shoe position, and differential shoe position and top cylinder hydraulic pressure, middle cylinder hydraulic pressure, and bottom cylinder hydraulic pressure. FIG. 37 corresponds to the rear grippers 204 and provides similar fields as FIG. 36 for the right and left rear grippers. These fields include control mode 3700 and feedback field 3704 and 3708 for left and right rear grippers. FIG. 38 corresponds to the swing actuators and provides display field 3804 for swing actuator angle, and display fields 3800*a,b* for left and right swing actuator position, hydraulic fluid pressure and hydraulic fluid temperature. Finally, FIG. 39 corresponds to the thrust actuators and provides actuator fields 3900 for the position, pressure, and position lock states and extend and retract and display fields 3904 for cylinder position and hydraulic pressure.

Figure 40:
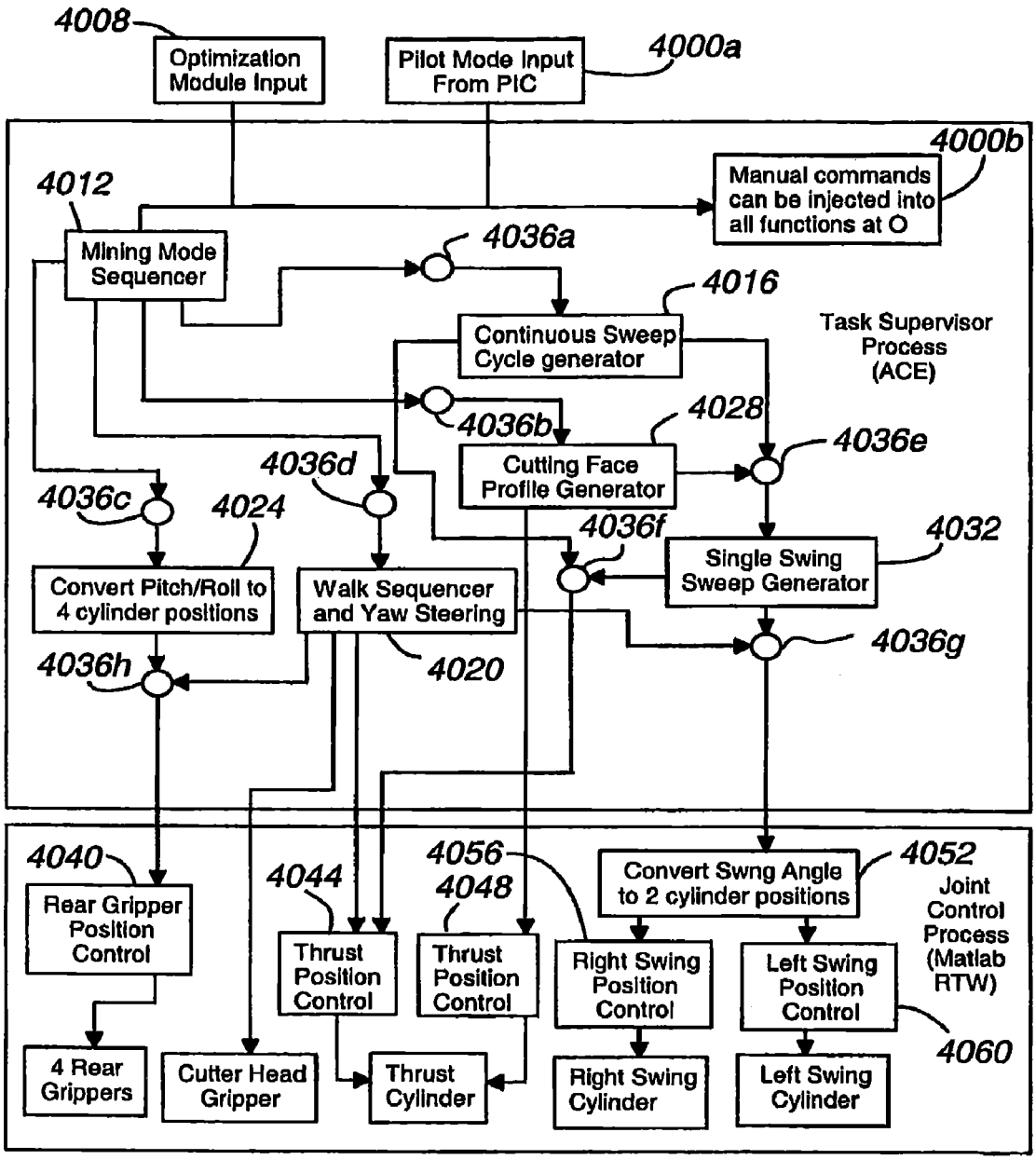
FIG. 40 is a block diagram of the control function hierarchy according to an embodiment of the present invention.

The autonomous operation of the excavator will now be described. The control function hierarchy is shown in FIG. 40. Operator input 4000*a,b* is received by the task supervisor 4004 along with input from an optimization module 4008 (discussed below) feedback from the various sensors. Based on the operator input and feedback, the task supervisor 4004 invokes the mining mode sequencer module 4012, which sequences invocation of a continuous sweep cycle generator module 4016, a walk sequencer module 4020, a kinematic module 4024, until terminated by the operator. The continuous sweep cycle generator module 4016 configures and causes execution of the cyclical rotations of the boom. The walk sequencer module 4020 configures and causes execution of the walk forward (and backward) logic and effects yaw steering. The kinematic module 4024 converts cylinder positions to attitude data and vice versa. Other modules in the task supervisor 4004 include the cutting face profile generator 4028 which can determine the real-time or near real-time configuration of the excavation face after each boom rotation or before a set of boom rotations and use the profiling data to determine the radius of curvature for the next boom rotation. The profiling data may be a two-dimensional view depicting the excavation face in plane view or in side (cross-sectional) view, at a plurality of points along the excavation face, or a three-dimensional view depicting the excavation face using an X, Y, and Z coordinate system. This data may then be used to determine correct sweep angles for each increment of the thrust actuator. Another module is the single swing angle sweep generator 4032 which configures and causes execution of a single boom rotation. Operator input to each module may be provided at each circle 4036. The various modules may be implemented as state machines. As will be appreciated, each module may be selectively invoked by the task supervisor and/or operator due to the hierarchical layers of control utilized by the architecture. Each module is responsible for a particular level of control and is unconcerned and unknowledgeable about modules at higher or lower levels of control. For example, in the auto mode each state, such as continuous sweeping of the boom, walking, and steering, is implemented as its own sub-sequence; thus, the transitions between states are events generated by other sub-systems, such as higher level control modules in the task supervisor.

Each of the task supervisor modules can invoke one or more joint control process loops. The loops include a rear gripper position control loop 4040, a thrust position control loop 4044, a thrust pressure control loop 4048, a swing angle conversion module 4052 to convert swing angle into cylinder positions), and left and right swing position control loops 4056 and 4060 (which use the output of the swing angle conversion module to provide each swing actuator's corresponding servo valve with the appropriate swing servo angle command.

In an alternative embodiment, the optimization module 4008 may be incorporated into the task supervisor 4004 to monitor various selected parameters during operation of the excavator and, based on the monitored parameters, provide suggested parameter changes to other modules of the task supervisor to realize more efficient operation of the excavator 100. The parameters having suggested parameter changes may be the same as or different from the monitored parameters. For example, the optimization module could receive information from the sensor array 2200 regarding a rate of excavation material output by the excavator as a function of time. If too little material is excavated, the optimization module can instruct the continuous swing sequencing module 4016 to increase a torque applied by the cutter head against the excavation face. If too much material is excavated, the optimization module can instruct the continuous swing sequencing module 4016 to decrease the torque applied by the cutter head against the excavation face to decrease rates of cutter wear. In another example, the grade of the excavated material is monitored and, when the grade falls below a predetermined level, a pilot alarm is activated and/or the position of the boom relative to the rock face is altered until the grade rises above the predetermined level. Yet another example is to monitor drag force exerted on the cutter head as a function of time during a cyclic swing of the boom. If the drag force falls below a predetermined level, the optimization module suggests to the continuous swing sequencing module 4016 an amount that the angle of swing of the boom be decreased as the boom is likely not excavating rock during part of the sequence. Other parameters, such as energy/power consumption, cycle time, depth of cut, time of noncontact of the cutters with the rock face, oil fluid temperature, bearing temperature, component stress/strain, component wear, rock cuttability, and excavation rates, may be monitored by techniques appreciated by those of ordinary skill in the art and, when the measured parameters fall below, rise above, or meet predetermined thresholds, suitable suggestions can be provided to other modules of the task supervisor to attempt to remedy the undesirable condition. In one configuration, the optimization module 4008 balances thrust pressure by the thrust actuator and swing rate and pressure of the swing actuators to substantially maximize the available electrical and hydraulic power.

Figure 41:
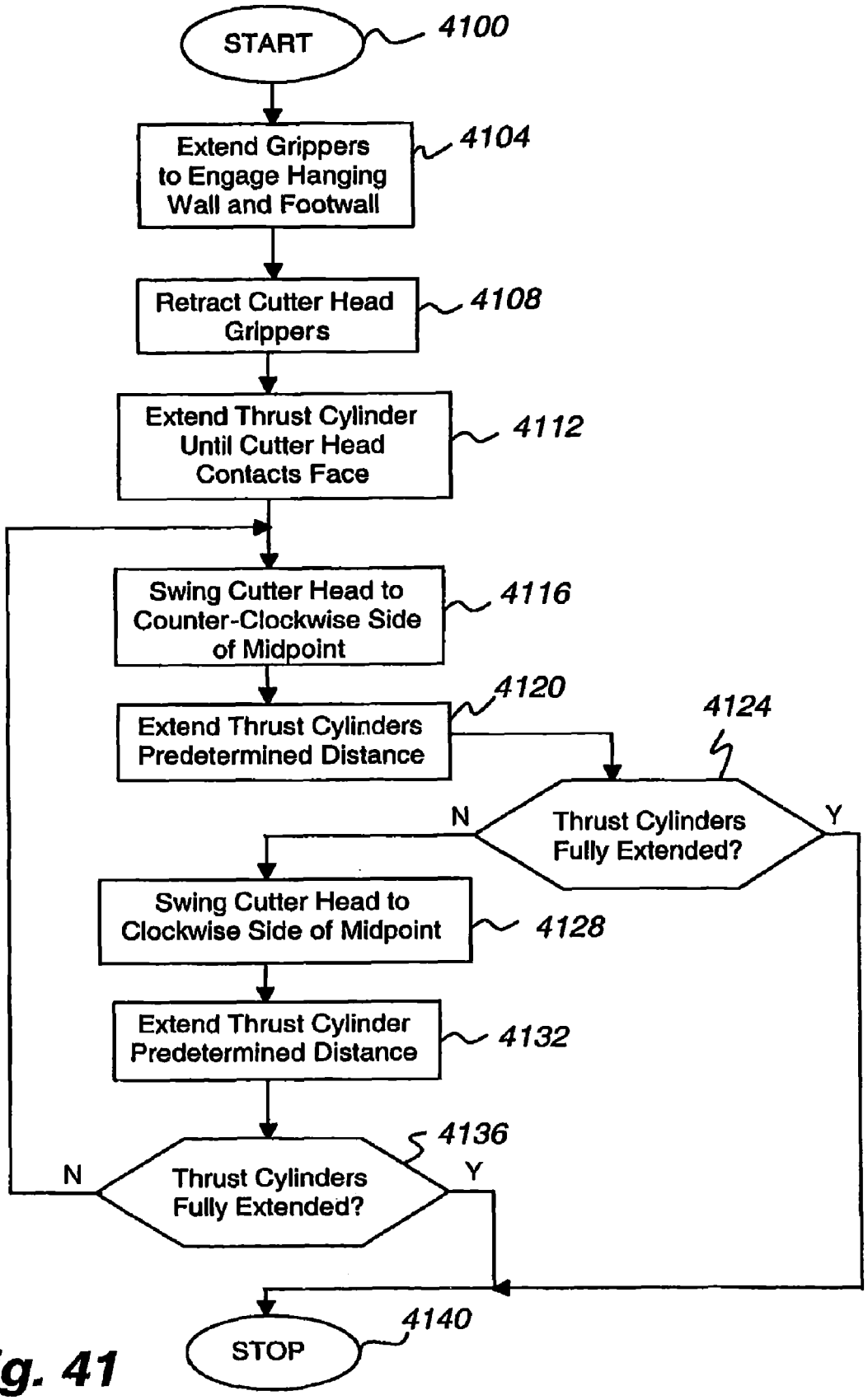
FIG. 41 is a flow chart showing the operation of the continuous swing sequencer module according to an embodiment of the present invention.

The operation of the continuous swing sequencer module 4016 will now be discussed with reference to FIG. 41.

In the start step 4100, the operator manually aligns the excavator with the excavation face, sets the configurable boom parameters (namely the swing motion, rate of motion, thrust pressure by the thrust actuators, and depth of cut (FIG. 32-39)), extends the various grippers until the excavator is locked in position, switches to the auto mode, and commands the performance of a continuous swing sequence or the mining sequence.

In steps 4104 and 4108, the task supervisor confirms that the main and rear grippers are extended to the proper positions and that the cutter head grippers are retracted. These checks are done by comparing hydraulic pressure measurements and shoe displacement measurements from the pertinent gripper sensors against predetermined values. The values are user configurable and depend on the control function selected for the respective gripper. If one or more of the grippers are not in the proper positions, the task supervisor places the gripper(s) in the proper position(s).

Generally, a cylinder is assumed to be retracted when a retract end of stroke sensors (one of which is located on each end of the cylinder) is triggered. The end-of-stroke sensors are typically the position sensors 2500, though the cutterhead grippers typically have dedicated end-of-stroke sensors (and may not have position sensors). A functional pair of actuators (e.g., the pair of actuators forming the main gripper, the left rear grippers, the right rear grippers, the left cutter head grippers, the right cutter head grippers, and the thrust actuators) is assumed to be extended and in contact with an adjacent wall when the pressure and/or force sensor indicates full pressure and at least two of the end of stroke sensors are not triggered. Two may or may not active. One or both of a functional pair of actuators is assumed to be extended and not in contact with an adjacent wall when the pressure and/or force sensor indicates full pressure and more than two end of stroke sensors are triggered.

In step 4112, the task supervisor determines if the thrust actuators and swing actuators are properly set. This check is done in the case of the thrust actuators by comparing hydraulic pressure measurements and cylinder displacement measurements from the pressure and position sensors in the thrust actuators against predetermined configurable values and in the case of the swing actuators by comparing the hydraulic pressure measurements and swing angle measurement against predetermined configurable values. In the case of the thrust actuators, the values depend on the control function selected for the thrust actuators. The swing actuators are set to the position control function. If the thrust or swing actuators are not properly positioned, the cylinders are placed in the proper position by the task supervisor.

In step 4116, the cutter head is rotated a selected swing angle (or until a first angular orientation is realized) to the counter-clockwise side of the boom rotation midpoint. The angle may be selected by the operator using actuators 3206*a-c* (FIGS. 32-33) and/or using GUI field 3440 (FIG. 34) or GUI field 3804 (FIG. 38), selected using input from the cutting face profile generator module 4028, and/or determined using swing cycle optimization. When swing cycle optimization is enabled, the boom automatically reverses direction when the hydraulic pressure in the swing torque and/or the thrust actuator hydraulic pressure feedback drops below a predetermined threshold(s). When the swing torque and/or thrust actuator hydraulic pressure feedback drops below predetermined levels, the task supervisor assumes that the cutter head is disengaged from the excavation face.

In step 4120, the thrust actuators are extended a predetermined distance in preparation for the next cut. The distance is user configurable using the actuators 3208*d* (FIGS. 32-33) and/or GUI field 3440 (FIG. 34). The thrust actuators are set to the thrust position control function, the thrust pressure control function, or a combination of the two functions.

In decision diamond 4124, the task supervisor determines whether or not the thrust actuators 164 are extended a predetermined total distance or to the limit of their extension. This decision is made by comparing position measurements from the thrust actuator position sensors 2504 against predetermined values. If the thrust actuators 164 are fully extended, the task supervisor proceeds to step 4140 and terminates operation of the continuous swing sequence. If the thrust actuators 164 are not fully extended, the task supervisor proceeds to step 4128. The task supervisor also proceeds to step 4128 in the event of a boom-related failure or stalling of the boom.

In step 4128, the cutter head is rotated a selected swing angle (or until a second angular orientation is realized) to the counter-clockwise side of the boom rotation midpoint. The angle may be selected by the operator, selected using input from the cutting face profile generator module 4028, or determined using swing cycle optimization. As will be appreciated, the boom angular orientation may be unique (or different) for each motion.

In step 4132, the thrust actuators are extended the predetermined distance in preparation for the next cut.

In decision diamond 4136, the task supervisor again determines whether or not the thrust actuators 164 are extended the predetermined total distance or to the limit of their extension. If the thrust actuators 164 are fully extended, the task supervisor proceeds to step 4140. If the thrust actuators 164 are not fully extended, the task supervisor returns to step 4116 and repeats steps 4116, 4120, 4124, 4128, 4132, and 4136.

Figure 48:
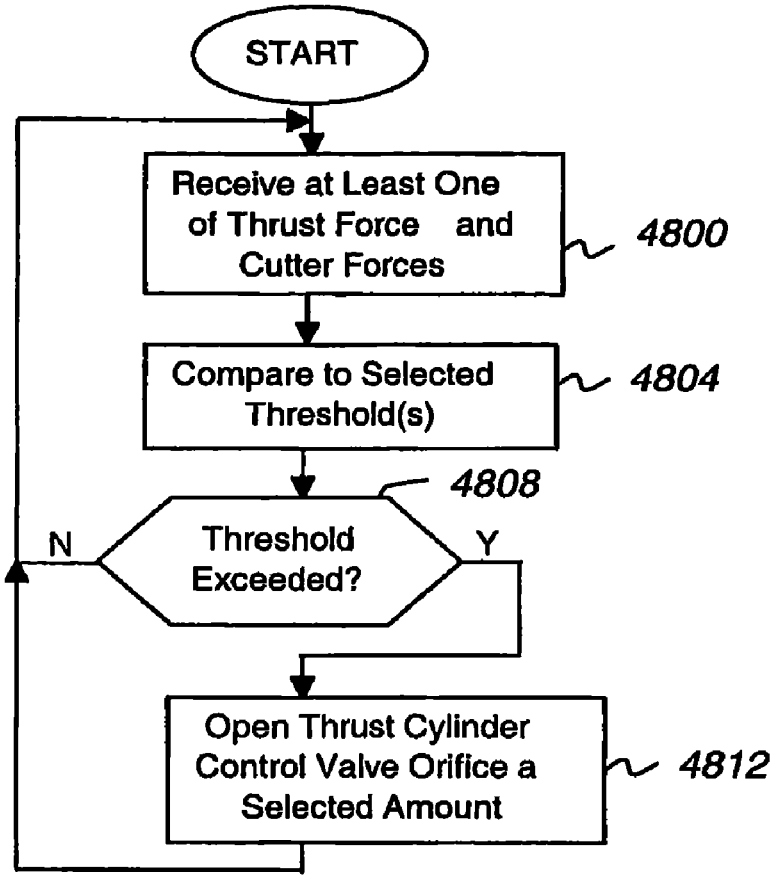
FIG. 48 is a flow chart illustrating an algorithm to protect the cutters from overloading.
Figure 49:
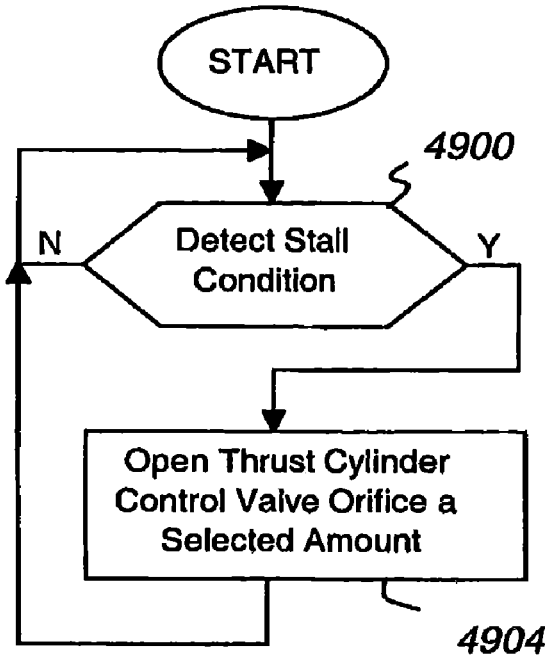
FIG. 49 is a flow chart illustrating an algorithm to prevent stalling of the cutter head during a boom rotation sequence.

The logic used to control dynamically the thrust actuators during boom rotation to protect cutters on the cutter head from overloading and the boom from stalling is presented in FIGS. 48 and 49.

Referring to FIG. 48, the control system, in step 4800, receives at least one of an overall thrust force and an individual cutter force from one or more sensors. The overall thrust force is determined either by calculating the force using the hydraulic pressures measured in the fluid reservoir on each side of one or both of the thrust actuators and the known areas of the thrust actuators or by using feedback from dedicated force sensors, such as load cells or strain gauges positioned on the thrust actuators. The individual cutter force(s) is determined by monitoring the individual cutter forces using strain gauges or load cells on the individual cutter mounts. A number of strain gauges can be used, one for each cutter mount. The highest measured cutter force is the cutter force selected in the subsequent steps.

In step 4804, the overall thrust force and/or cutter force is compared to a corresponding selected threshold(s). In decision diamond 4808, the control system determines whether or not the selected threshold(s) is exceeded. If not, the control system repeats step 4800. If so, the control system, in step 4812, opens one or more thrust actuator control valves (which are typically variable orifice valves) a selected amount to relieve the thrust pressure. The selected amount is preferably a function of the amount by which the cutter force(s) exceeds a threshold value (which is less than their maximum rating), the speed at which the cutter forces are increasing, and/or the amount of time that the threshold has been exceeded. The relationships may be set forth in a mathematical algorithm and/or in a lookup table.

Referring to FIG. 49, the control system, in step determines whether or not a stall condition exists. A "stall" condition exists when the boom is unable to complete a rotational sequence to a selected final set point or is unable to maintain a selected rotational speed due to excessive forces exerted by/against the cutter head. The stall condition is typically detected by comparing the speed at which the boom is sweeping against the commanded sweep speed and/or the actual swing torque against a maximum swing torque threshold. If the actual sweep speed is no less a specified percentage (e.g., 70%) of the commanded sweep speed and/or if the actual swing torque is less than a specified percentage (e.g. 95%) of the maximum torque threshold, the control system determines that there is no stall condition and repeats step 4900. If the actual sweep speed is less than a specified percentage (e.g., 70%) of the commanded sweep speed and/or if the actual swing torque is more than a specified percentage (e.g., 95%) of the maximum torque threshold, the control system determines that there is a stall condition and proceeds to step 4904. To relieve the thrust pressure, the system controller causes the thrust actuator control valve to open a selected amount. The selected amount is a function of the amount that the difference between the commanded swing speed and the actual swing speed exceeds a threshold value, the speed at which the speed differential is increasing, and/or the amount of time that the threshold has been exceeded. An alternative approach to relieving the thrust pressure is to open the thrust actuator control valve orifice as a function of the amount by which the swing torque exceeds a threshold value (which is less than its maximum rating and may vary as a function of boom angle), the speed at which the swing torque is increasing, and/or the amount of time that the threshold has been exceeded.

Figure 42:
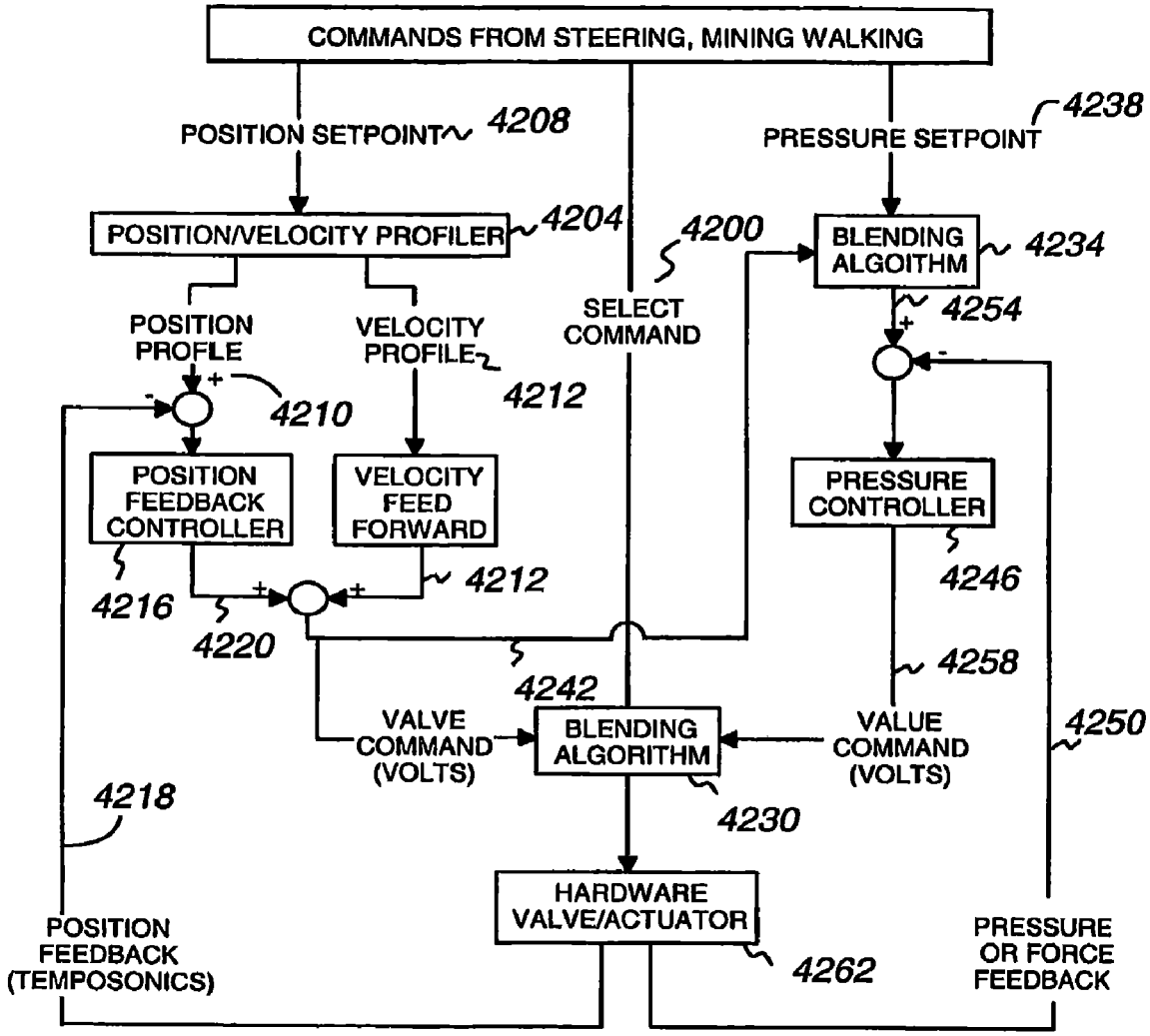
FIG. 42 is a flow schematic illustrating the operation of the cylinder control module according to an embodiment of the present invention.

The logic used to effect cylinder control manually or automatically in the rear gripper control loop 4040, the thrust position and pressure control loops 4044 and 4048, the left and right swing actuator control loops 4056 and 4060 and control loops for the cutter head grippers and main gripper is depicted in FIG. 42.

Referring to FIG. 42, commands 4200 are received from the higher level control module. The steps performed by the loop depend on whether the gripper/cylinder is set to the position control function, pressure control function, or both. When the gripper/cylinder is set to the position control function, a position/velocity profiler 4204 converts the position setpoint 4208 (by any suitable technique such as a linear transformation) to a corresponding voltage position command 4210 to the cylinder controller (not shown). When the cylinder is a swing actuator, the position/velocity profiler 4204 further provides a velocity command 4212 based on the desired rate of change of hydraulic fluid pressure in the cylinder. In one configuration, the position/velocity profiler acts as a trajectory generator and generates commands that produce smooth boom trajectories in position and velocity (e.g., by generating a sinusoidal acceleration profile or a trapezoidal velocity profile between the start and end positions). A position feedback controller 4216 receives a position feedback signal 4218 from the position sensor(s), compares the position command 4210 to the position feedback signal 4218, and suitably adjusts the command (such as by decreasing the command by the signal) to produce a position feedback adjusted command 4220. The position feedback adjusted and velocity commands are provided to blending algorithms 4230 and 4234. When the gripper/cylinder is set to the pressure control function, the pressure setpoint 4238 is converted into a pressure command 4254 to the servo valve serving the corresponding chamber of the cylinder and combined with the position feedback adjusted (and/or velocity) commands 4242 to another chamber of the cylinder when a combination of pressure and position control functions is desired. When the gripper/cylinder is set only to the pressure control function, the blending algorithm ignores the position feedback adjusted command 4218. A pressure feedback controller 4246 receives a pressure feedback signal 4250 from the pressure and/or force sensor(s), compares the pressure command 4254 to the pressure feedback signal 4250, and suitably adjusts the command (such as by decreasing the command by the signal) to produce a pressure feedback adjusted command 4258. The pressure feedback adjusted and velocity commands are provided to blending algorithm 4230.

Blending algorithm 4230 selects which set of commands are to be provided to the valve controller of the hardware valve/actuator controller 4262. As will be appreciated, the valve controllers refer to the various processors distributed in various locations in the excavator for controlling the hydraulic fluid parameters in the various chambers of the cylinders. A select command 4200, such as received from the operator via actuators 3250*b-d* or GUI fields 3600, 3700, and 3900, controls which set of commands are to be provided to the valve controller 4262. When the various chambers of the gripper/cylinder are only set to the position control function, the position feedback adjusted and velocity commands (if appropriate) are forwarded by the blending algorithm to the valve controller. When the various chambers of the gripper/cylinder are only set to the position control function, the pressure feedback adjusted and velocity commands (if appropriate) are forwarded by the blending algorithm to the valve controller. When chambers of the gripper/cylinder are set to the position and pressure control functions, the position feedback adjusted and pressure feedback adjusted commands or a single command derived therefrom and the velocity command (if appropriate) are forwarded by the blending algorithm to the valve controller.

The blending algorithm(s) can use the geometric properties of the excavator, current actuator positions, and other factors to determine the amount of control action to be used for each actuator.

Figure 43:
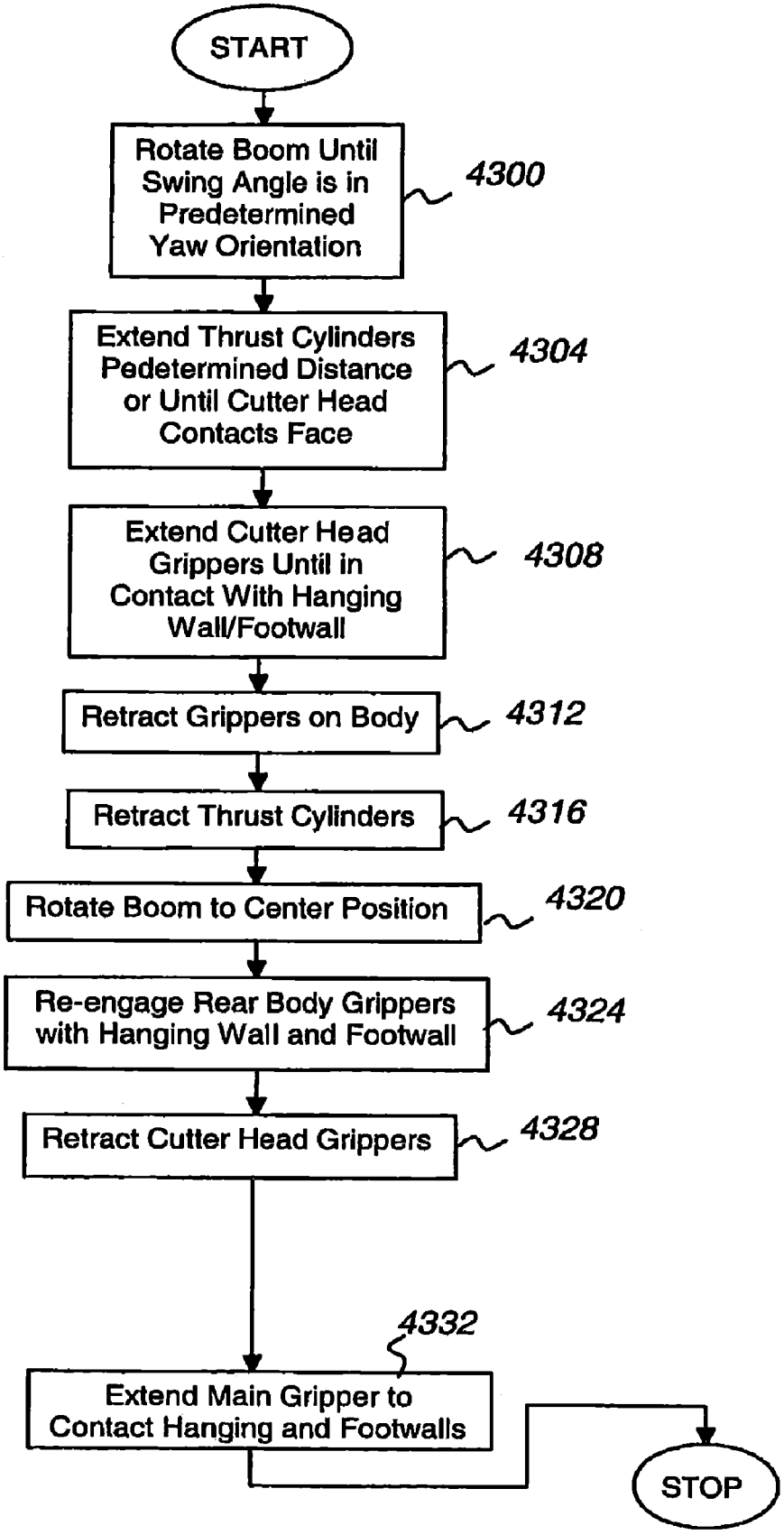
FIG. 43 is a flow chart showing the operation of the walk sequencer module according to an embodiment of the present invention.

The operation of the walk sequencer module will now be discussed with reference to FIG. 43. Although the sequence is intended for horizontal or near horizontal travel surfaces, it is to be understood that the sequence may with suitable modifications be configured for non-horizontal travel surfaces having a defined range of grades. Different algorithms can be used for different directions of travel and or differing terrains. For example, the module can use differing algorithms for walking up-dip versus down-dip. The general steps may be the same but the selected parameters would be different.

In step 4300, the boom is rotated until the swing angle is in a predetermined Yaw orientation.

In step 4304, the thrust actuators are extended a predetermined (walk) distance or until the cutter head contacts the face. When the thrust actuators are already at full extension, this step is deemed to have been performed.

In step 4308, the cutter head grippers 144 are extended until they are in contact with the hanging wall and footwall. The cutter head grippers are preferably set to the pressure control function or a combination of the pressure control and position control functions.

In step 4312, the rear grippers 204 and main gripper 200 are retracted fully.

In step 4316, the thrust actuators are retracted fully to slide the excavator forward from a first position to a second desired position.

In step 4320, the boom is rotated to the center boom position. The center boom position is set by the operator using actuators 3206*a*. Rotation of the boom rotates the excavator body to the desired Yaw orientation.

In step 4324, the upper rear grippers 204 are extended until they are in contact with the hanging wall. In step 4324, the rear grippers 204 are set to the differential position control function.

In step 4328, the cutter head grippers 144 are fully retracted.

In step 4332, the main gripper is extended into contact with the hanging wall.

The foregoing steps are repeated until the excavator is in the desired position.

As will be appreciated, the above steps can be used to move or walk the excavator backwards. In that event, steps 4300 and 4304 would be reconfigured so that the thrust actuators are retracted a sufficient distance such that, after the cutter head grippers are locked, the thrust actuators may be extended to slide the excavator backwards to the desired position.

Figure 44:
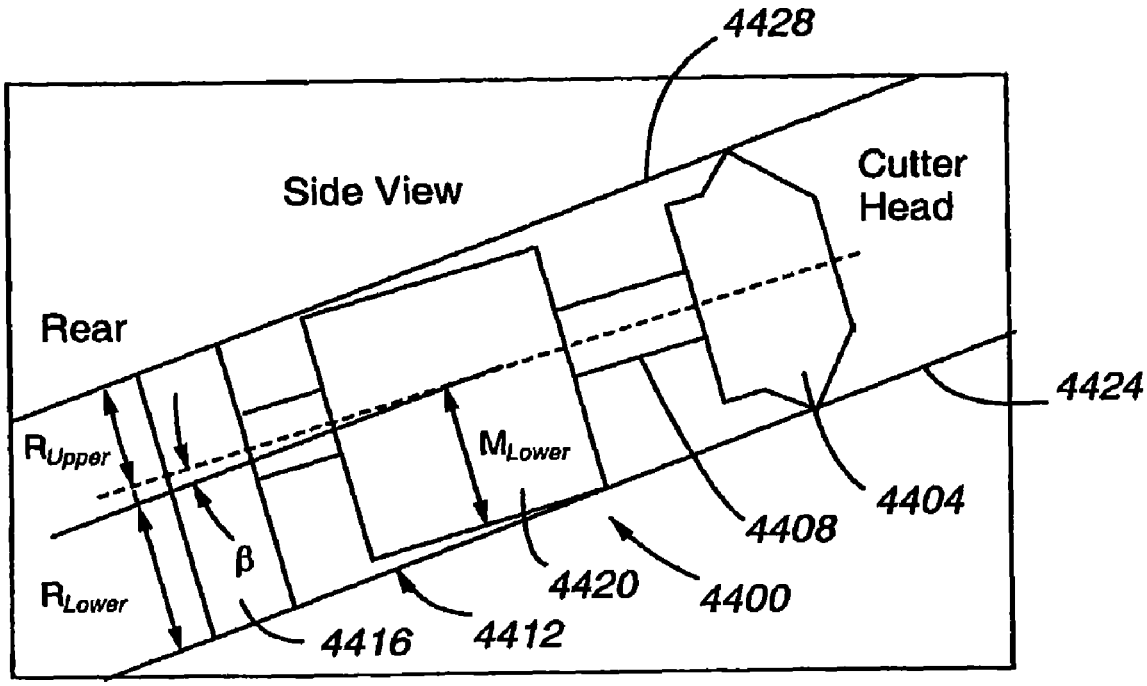
FIG. 44 is a side view of an excavator illustrating pitch control.
Figure 45:
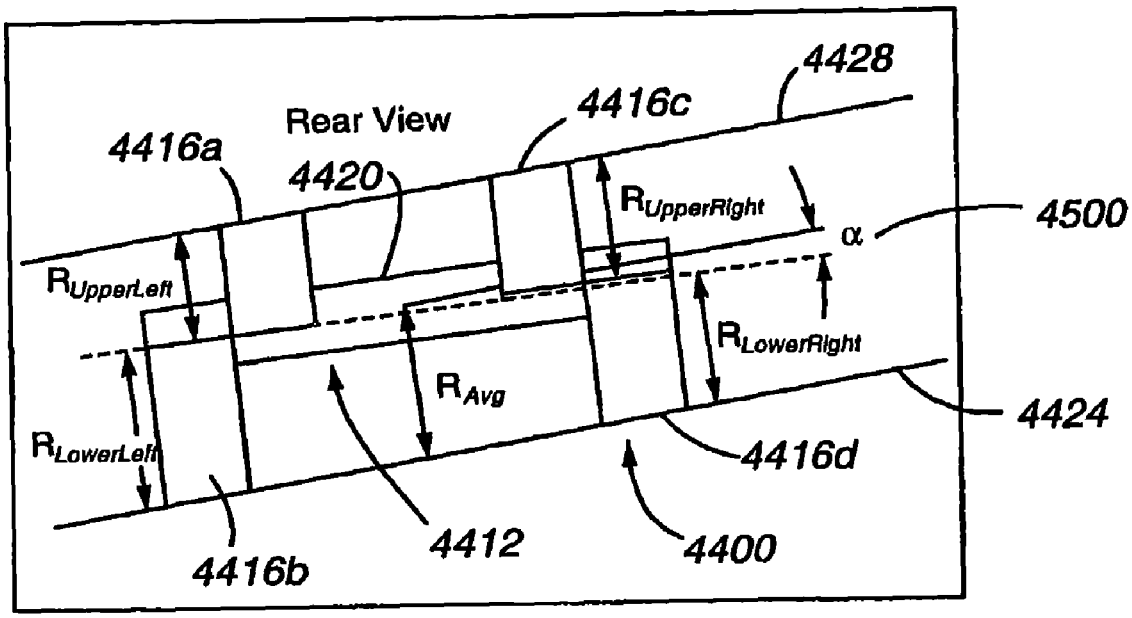
FIG. 45 is a rear view of the excavator of FIG. 44 illustrating roll control.
Figure 46:
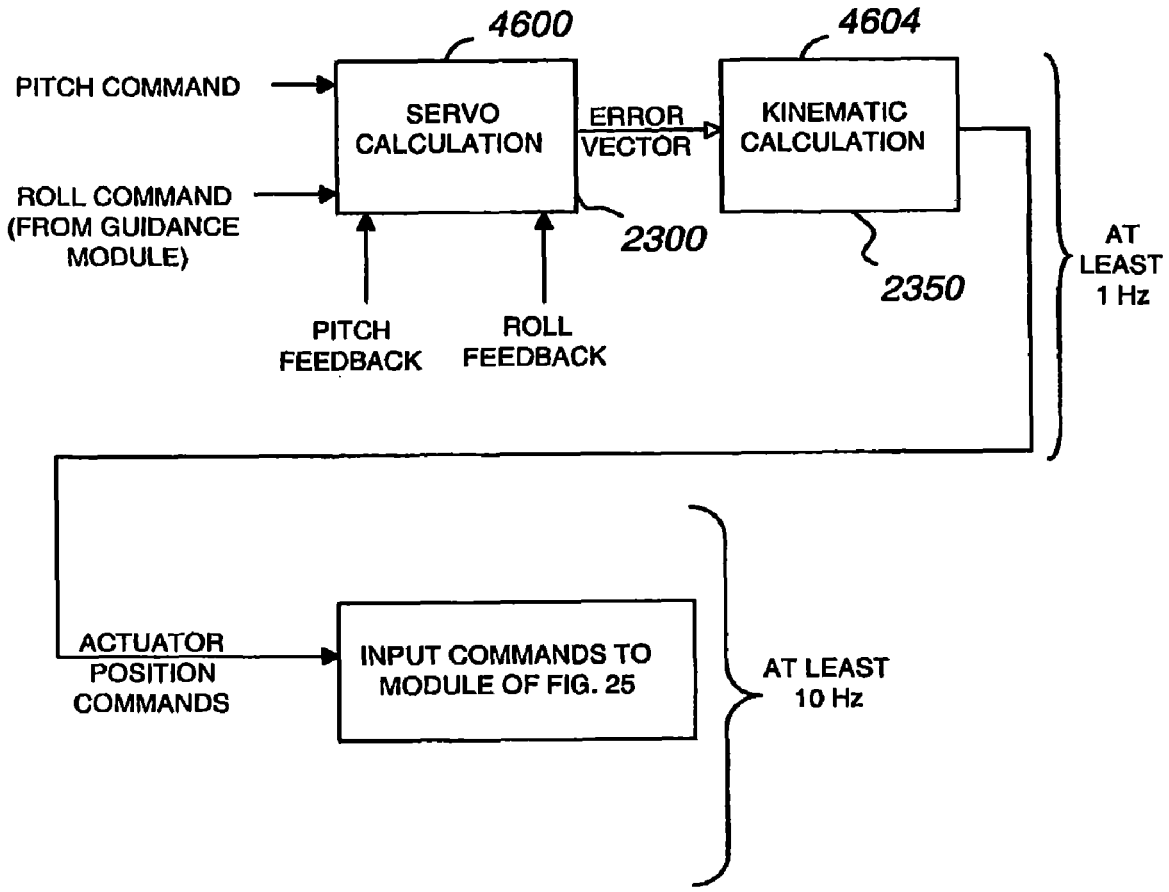
FIG. 46 is a flow chart illustrating the operation of the kinematic module.

FIGS. 44, 45, and 46 depict operation of the kinematic or steering module 4024. The kinematic module converts cylinder positions into attitude (pitch/roll) data and Z-offset commands and desired attitude data and Z-offset commands into cylinder positions and provides suitable voltage commands to the various servo valves of the controlled cylinders. Normally, steering or realization of a desired attitude is effected by adjusting the positions of a plane supported by the bottom main gripper 200 and the upper and lower rear grippers 204; that is, the excavator is supported on three corners of a triangle. Adjusting the height of the machine body differentially between these three points affects machine pitch and roll.

FIG. 44 depicts an excavator 4400 having a cutter head 4404, boom 4408, and body 4412. The body 4412 comprises rear grippers 4416 and main gripper 4420. The excavator 4400 is mining up dip, and the pitch of the excavator 4400 is being reduced to a more horizontal position. $M_{lower}$ represents the displacement of the lower main gripper which is in contact with the footwall 4424. The displacements of the two upper rear grippers is $R_{upper}$, with the upper rear grippers being in contact with the hanging wall 4428. The displacements of the lower rear grippers is $R_{lower}$, with the lower rear grippers being in contact with the footwall. To realize the desired pitch, $R_{lower}$ is increased while $R_{upper}$ is decreased.

FIG. 45 depicts the rear of the excavator 4400, with the excavator now performing roll reduction to a more horizontal position. $R_{avg}$ represents the average displacement of the two lower rear grippers 4416*b,d*. To adjust the roll as desired, $R_{lower\ left}$ is increased and $R_{lower\ right}$ is decreased to reduce the roll angle 4500. The upper rear grippers 4420 adjust to maintain contact with the hanging wall. In the automatic steering mode, the steering increments are limited in pitch and roll to aid the operator in avoiding getting the excavator stuck.

FIG. 46 depicts the operation of the kinematic module 4024 when the task supervisor has commanded the excavator 4400 to reposition itself. The kinematic module 4024 includes various submodules, namely servo calculation module 4600 and kinematic calculation module 4604. The kinematic module 4024 commands the various grippers to extend and retract, depending on the desired location of the cutting head relative to the excavation face. Differential position and force commands from the kinematic module are provided to the grippers to provide desired amounts of pitch and roll. The kinematic module continuously or semi-continuously using pitch and roll feedback determines whether or not the pitch and roll angles of the excavator have reached their commanded state and outputs connection commands to the gripper control (servo) valves.

The pitch and roll commands from the task supervisor and pitch and roll feedback signals from one or more of the sensors are provided to the servo calculation module 4600. The module 4600 compares the pitch and roll commands with the pitch and roll feedback signals, respectively, and outputs an error vector. The error vector comprises an adjustment for roll and an adjustment for pitch. The error vector is inputted into the kinematic calculation module 4604. Kinematic calculation module 4604 converts the pitch and roll adjustments into equivalent adjustments in cylinder position (e.g., cylinder length). These pitch adjustments are then provided as input to the pertinent control loops. Preferably, the above calculations are repeated at a frequency of at least about 1 Hz.

Figure 47:
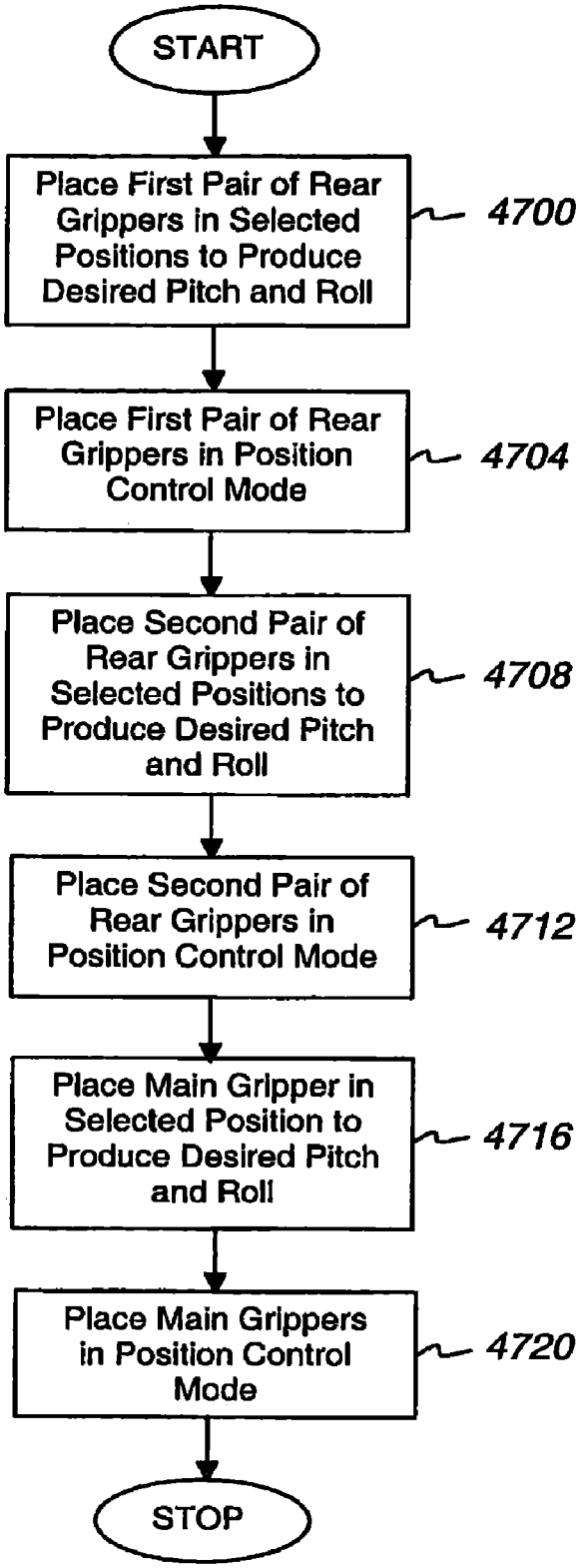
FIG. 47 is a flow chart illustrating the operation of the steering sequencer module.

Referring now to FIG. 47, the steering operation will now be described. The various steps may be performed sequentially in any order or simultaneously and are repeated until the desired pitch and roll are realized.

In steps 4700 and 4704, a first pair of adjacent rear grippers 4416*a,b* is placed in selected positions to produce the desired pitch and roll and then set to the position control function.

In steps 4708 and 4712, a second pair of adjacent rear grippers 4416*c,d* is placed in selected positions to produce the desired pitch and roll and then set to the position control function.

Finally, in steps 4716 and 4720 the main gripper is placed in the selected position to produce the desired pitch and roll and then set to the position control function.

The steps are repeated or recursively performed as needed to realize the desired pitch and roll.

A number of variations and modifications of the invention can be used. It would be possible to provide for some features of the invention without providing others.

For example in one alternative embodiment, a single operator or group of collocated operators control multiple excavation systems. Teleoperation permits the operator to control the excavator(s) in areas that are too narrow and have no operator access.

In another alternative embodiment, control of the excavator is partially manual and partially automated. Steering angles are controlled by the operator. Distribution of steering commands into hydraulic actuator position and force commands are controlled automatically. Hydraulic valves are automatically controlled to achieve commanded cylinder positions and forces. The cutting motions are controlled automatically. The repositioning motion is preprogrammed. Each repositioning step is controlled by the operator before it is executed. The automatic control functions are distributed between processors in the excavator, deployment system, and operator interface.

In yet another embodiment, the excavation system has a hydraulic system for powering various of the above components. The hydraulic system includes three primary components, namely a power pack, control valves, and the final drive motors and pistons. The hydraulic system can be readily and efficiently operated with its power pack separated from the remainder of the system. Depending on the power or motive needs of the excavator and/or carrier, the power pack can be mounted on the excavator or the deployment system or any combination with a link provided through one or more umbilicals.

In yet another embodiment, the navigation system is used with only limited remote sensing. An accurately defined vein model or map allows the excavator 100 to mine the orebody without real-time ore sensing (remote sensing). However, the map must be accurate. An unreliable model or map will require real time assaying or, at least, realtime differentiation between the orebody and surrounding (waste) rock, which can only be provided by remote sensing.

In yet another alternative embodiment, one or more of the umbilicals can include strength members to replace the cables.

In yet another alternative embodiment, an umbilical for hydraulic fluid can be omitted by using an on board tank and pump for the hydraulic fluid.

In another alternative embodiment, the body 160 and shoes 208, 212 are configured as telescopic cylinders. A sensor is positioned on the body 160 to monitor the position of the two telescopic cylinders.

In yet another alternative embodiment, the task supervisor is located on either or both of the pilot interface computer and excavator interface computer.

In yet another alternative embodiment, the steering and walking sequencer modules are combined into a common state machine.

In yet another alternative embodiment, the cutter head grippers are controlled individually, as in the case of the other grippers. When controlled together, the same commands are given to each gripper in the pair of grippers during a selected time interval. When controlled individually, differing commands can be given to each gripper in the pair of grippers during the selected time interval.

In yet another embodiment, the thrust actuator(s) is located in the excavator body such that the main gripper is between the thrust actuator(s) and the boom.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An excavation method, comprising:

providing an excavator comprising a cutter head for excavating in situ material, a body engaging the cutter head, and a plurality of grippers for applying pressure against opposing surfaces of an excavation to maintain the body in a selected position and orientation;

manually positioning the excavator in a selected first position adjacent to an excavation face;

comparing selected excavator sensed parameters against predetermined values to confirm that the excavator is properly configured;

commencing an automated first excavation sequence in which a first set of grippers engage opposing excavation surfaces of the excavation to maintain the body in a selected position and the excavator excavates material from the excavation face;

when a thrust actuator engaging the cutter head is extended a predetermined distance, commencing an automated repositioning sequence to reposition the excavator to a second position adjacent to the excavation face, wherein, in the automated repositioning sequence a second set of grippers, but not the first set of grippers, engage the opposing excavation surfaces; and when the excavator is in the second position, confirming that the excavator is properly configured for an automated second excavation sequence; and when properly configured, commencing an automated second excavation sequence, wherein the excavator has a rotatable boom engaging the cutter head and wherein the cutter head excavates the in situ material by rotating the boom back and forth across the excavation face while the cutter head is in contact with the excavation face for at least a portion of each boom rotation, and wherein a swing cycle optimization module automatically reverses the direction of boom rotation when at least one of a hydraulic pressure measured in at least one thrust actuator and a swing torque drops below a predetermined threshold.

2. The method of claim 1, wherein the sensed parameters include hydraulic pressure measurements and cylinder displacement measurements, wherein the boom is rotated by a swing cylinder and wherein the commencing step comprises the substeps:

rotating the boom a selected swing angle;

while the boom is rotating, controlling a thrust pressure in the thrust actuator by monitoring at least one of an overall thrust force and an individual cutter force;

when the hydraulic pressure in the swing cylinder and/or thrust actuator falls below a predetermined level, reversing rotation of the boom;

while the boom is rotating, controlling a thrust pressure in the thrust actuator by monitoring at least one of an overall thrust force and an individual cutter force; and when the hydraulic pressure in the swing cylinder and/or thrust actuator falls below a predetermined level, extending the thrust actuator a predetermined distance in preparation for a next boom rotation; and wherein the method further comprising:

detecting a stall condition when at least one of the following is true:

a boom rotational speed is less than a first predetermined value; and the swing torque is less than a second predetermined value; and in response to detecting a stall condition, relieving the thrust pressure by an amount that is a function of the difference between the rotational speed and the first predetermined value and/or the swing torque and the second predetermined value;

comparing pitch and roll commands against pitch and roll feedback signals;

based on the comparison, outputting an error vector, the error vector comprising an adjustment for roll and an adjustment for pitch;

converting the error vector into an equivalent adjustment in cylinder position of a selected gripper; and adjusting a cylinder position of the selected gripper according to the equivalent adjustment.

3. The method of claim 1, wherein the automated repositioning sequence comprises the substeps:

rotating the boom until a swing angle in a predetermined Yaw orientation;

extending the thrust actuator a determined distance;

extending the second set of grippers until the second set of grippers are in contact with the opposing excavation surfaces, wherein the second set of grippers are set to a pressure control function;

retracting the first set of grippers;

retracting the thrust actuator;

rotating the boom to a selected position relative to the body;

extending the first set of grippers until the first set of grippers are in contact with the opposing excavation surfaces, wherein the first set of grippers are set to a position control function; and retracting the second set of grippers.

4. The method of claim 1, wherein the grippers include a plurality of hydraulic actuators and a plurality of check valves, and the excavator includes a hydraulic system comprising a hydraulic fluid supply line in fluid communication with the check valves and the hydraulic actuators, a hydraulic fluid return line in fluid communication with the check valves and the hydraulic actuators, and an emergency retract line in fluid communication with the check valves and further comprising;

detecting a fault in the hydraulic system, wherein the fault is a hydraulic fluid pressure in the hydraulic fluid supply line falling below a predetermined threshold;

closing the check valves in response to the detecting step to maintain at least substantially hydraulic pressure in the hydraulic actuators; and pressurizing the check valves with the emergency retract line to open the check valves and effect drainage of the hydraulic fluid from the hydraulic actuators, wherein, in the pressurizing step, a corresponding pressure applied to each check valve is sufficient to overcome a respective hydraulic pressure exerted against the check valve by the corresponding hydraulic actuator.

5. The method of claim 1, wherein the grippers comprise at least one hydraulic actuator and further comprising:

setting at least one hydraulic fluid-containing cavity in each of a first set of the hydraulic actuators to a pressure control function in which a pressure in the cavity is controlled;

setting at least one hydraulic fluid-containing cavity in each of a second set of the hydraulic actuators to a position control function in which a position of the corresponding actuator is controlled;

wherein a gripper comprises first and second hydraulic actuators and wherein at least a first cavity in the first hydraulic actuator is set to the pressure control function and at least a second cavity in the second hydraulic actuator is set to the position control function;

wherein a first hydraulic actuator comprises first and second cavities for receiving hydraulic fluid and wherein the first cavity is set to the pressure control function and the second cavity is set to the position control function;

wherein the first and second sets of hydraulic actuators are at least partially overlapping; and setting at least one cavity in at least one of the hydraulic actuators to at least one of a differential position control function and a cooperating position/pressure control function.

6. The method of claim 1, further comprising:

receiving an attitude command containing desired settings for pitch and roll;

converting the attitude command into separate actuator control commands for each of the plurality of grippers; and forwarding the actuator control commands to each of the plurality of grippers; and thereafter receiving position feedback signals from each of the plurality of grippers.

7. The method of claim 6, further comprising:

converting the position feedback signals into pitch and roll values;

comparing the pitch and roll values with the pitch and roll values in the attitude command;

determining an error vector, the error vector comprises an adjustment for roll and an adjustment for pitch; and converting the adjustment for roll and the adjustment for pitch into actuator control commands.

8. The method of claim 1, wherein the excavator comprises a memory storing a profile of an excavation face and further comprising:

removing, by the cutter head, material from the face, wherein the boom is rotatably mounted on the body, wherein in the removing step the boom is rotated while the cutter head is in contact with the excavation face;

determining a revised profile of the excavation face after the removing step; and updating the profile of the excavation face stored in the memory, wherein the profile is a plan view of the excavation face; and wherein the profile is a cross-sectional side view of the excavation face at a plurality of selected points along the face.

9. An excavation method, comprising:

providing an excavator comprising a cutter head for excavating in situ material, a body engaging the cutter head, and a plurality of grippers for applying pressure against opposing surfaces of an excavation to maintain the body in a selected position and orientation;

manually positioning the excavator in a selected first position adjacent to an excavation face;

comparing selected excavator sensed parameters against predetermined values to confirm that the excavator is properly configured;

commencing an automated first excavation sequence in which a first set of grippers engage opposing excavation surfaces of the excavation to maintain the body in a selected position and the excavator excavates material from the excavation face;

when a thrust actuator engaging the cutter head is extended a predetermined distance, commencing an automated repositioning sequence to reposition the excavator to a second position adjacent to the excavation face, wherein, in the automated repositioning sequence a second set of grippers, but not the first set of grippers, engage the opposing excavation surfaces; and when the excavator is in the second position, confirming that the excavator is properly configured for an automated second excavation sequence; and when properly configured, commencing an automated second excavation sequence; and wherein the cutter head is mounted on a boom and comprises one or more excavating devices and at least one thrust actuator operatively engages at least one variable orifice valve for supplying hydraulic fluid to the at least one thrust actuator and further comprising:

monitoring a parameter that is at least one of (a) a thrust force applied on the cutter head by the at least one thrust actuator, (b) a force on a cutter; (c) a speed at which the boom is rotating, and (d) a swing torque by the boom; and when the parameter exceeds a selected threshold, opening the at least one variable orifice valve a selected amount to relieve a pressure in the at least one thrust actuator, wherein the selected amount is a function of at least one of the following:

(i) the amount by which the cutter force exceeds a selected value;

(ii) the speed at which the cutter force is increasing;

(iii) an amount of time that the selected value has been exceeded;

(iv) the amount by which the difference between a commanded boom rotational speed and an actual boom rotational speed exceeds a selected value;

(v) the speed at which the speed difference is increasing;

(vi) the amount by which the swing torque exceeds a selected value; and (v) the speed at which the swing torque is increasing.

10. The method of claim 9, wherein the monitored parameter is (a).

11. The method of claim 9, wherein the monitored parameter is (b).

12. The method of claim 9, wherein the monitored parameter is (c).

13. The method of claim 9, wherein the monitored parameter is (d).

14. The method of claim 9, wherein the selected amount is a function of one or more of the amount by which the cutter force exceeds a selected value, the speed at which the cutter force is increasing, and an amount of time that the selected value has been exceeded.

15. The method of claim 9, wherein the selected amount is a function of one or more of the amount by which the difference between a commanded boom rotational speed and an actual boom rotational speed exceeds a selected value, the speed at which the speed difference is increasing, and an amount of time that the selected value has been exceeded.

16. The method of claim 9, wherein the selected amount is a function of one or more of the amount by which the swing torque exceeds a selected value, the speed at which the swing torque is increasing, and an amount of time that the selected value has been exceeded.

17. An excavation method, comprising:

providing an excavator comprising a cutter head for excavating in situ material, a body engaging the cutter head, and a plurality of grippers for applying pressure against opposing surfaces of an excavation to maintain the body in a selected position and orientation;

manually positioning the excavator in a selected first position adjacent to an excavation face;

comparing selected excavator sensed parameters against predetermined values to confirm that the excavator is properly configured;

commencing an automated first excavation sequence in which a first set of grippers engage opposing excavation surfaces of the excavation to maintain the body in a selected position and the excavator excavates material from the excavation face;

when a thrust actuator engaging the cutter head is extended a predetermined distance, commencing an automated repositioning sequence to reposition the excavator to a second position adjacent to the excavation face, wherein, in the automated repositioning sequence a second set of grippers, but not the first set of grippers, engage the opposing excavation surfaces; and when the excavator is in the second position, confirming that the excavator is properly configured for an automated second excavation sequence; and when properly configured, commencing an automated second excavation sequence, wherein the sensed parameters include hydraulic pressure measurements and cylinder displacement measurements, wherein the excavator comprises a boom engaging the cutter head and body, and wherein the commencing step comprises the substeps:

rotating the boom a selected swing angle;

while the boom is rotating, controlling a thrust pressure in a thrust actuator by monitoring at least one of an overall thrust force and an individual cutter force;

when the hydraulic pressure in a swing cylinder and/or thrust actuator falls below a predetermined level, reversing rotation of the boom;

while the boom is rotating, controlling a thrust pressure in a thrust actuator by monitoring at least one of an overall thrust force and an individual cutter force; and when the hydraulic pressure in the swing cylinder and/or thrust actuator falls below a predetermined level, extending the thrust actuator a predetermined distance in preparation for a next boom rotation; and wherein the method further comprises:

detecting a stall condition when at least one of the following is true:

a boom rotational speed is less than a first predetermined value; and a swing torque is less than a second predetermined value; and in response to detecting a stall condition, relieving the thrust pressure by an amount that is a function of the difference between the rotational speed and the first predetermined value and/or the swing torque and the second predetermined value;

comparing pitch and roll commands against pitch and roll feedback signals;

based on the comparison, outputting an error vector, the error vector comprising an adjustment for roll and an adjustment for pitch;

converting the error vector into an equivalent adjustment in cylinder position of a selected gripper; and adjusting a cylinder position of the selected gripper according to the equivalent adjustment.

18. An excavation method, comprising:

providing an excavator comprising a cutter head for excavating in situ material, a body engaging the cutter head, and a plurality of grippers for applying pressure against opposing surfaces of an excavation to maintain the body in a selected position and orientation;

manually positioning the excavator in a selected first position adjacent to an excavation face;

comparing selected excavator sensed parameters against predetermined values to confirm that the excavator is properly configured;

commencing an automated first excavation sequence in which a first set of grippers engage opposing excavation surfaces of the excavation to maintain the body in a selected position and the excavator excavates material from the excavation face;

when a thrust actuator engaging the cutter head is extended a predetermined distance, commencing an automated repositioning sequence to reposition the excavator to a second position adjacent to the excavation face, wherein, in the automated repositioning sequence a second set of grippers, but not the first set of grippers, engage the opposing excavation surfaces; and when the excavator is in the second position, confirming that the excavator is properly configured for an automated second excavation sequence; and when properly configured, commencing an automated second excavation sequence, wherein the grippers comprise at least one hydraulic actuator and further comprising:

setting at least one hydraulic fluid-containing cavity in each of a first set of the hydraulic actuators to a pressure control function in which a pressure in the cavity is controlled;

setting at least one hydraulic fluid-containing cavity in each of a second set of the hydraulic actuators to a position control function in which a position of the corresponding actuator is controlled;

wherein a gripper comprises first and second hydraulic actuators and wherein at least a first cavity in the first hydraulic actuator is set to the pressure control function and at least a second cavity in the second hydraulic actuator is set to the position control function;

wherein a first hydraulic actuator comprises first and second cavities for receiving hydraulic fluid and wherein the first cavity is set to the pressure control function and the second cavity is set to the position control function;

wherein the first and second sets of hydraulic actuators are at least partially overlapping; and setting at least one cavity in at least one of the hydraulic actuators to at least one of a differential position control function and a cooperating position/pressure control function.

* * * * *